US006241004B1

(12) United States Patent
Ebisu et al.

(10) Patent No.: US 6,241,004 B1
(45) Date of Patent: Jun. 5, 2001

(54) METHOD AND APPARATUS FOR CONTINUOUS CASTING

(75) Inventors: Yoshio Ebisu, Sagamihara; Kazuyoshi Sekine, Yokohama, both of (JP)

(73) Assignee: EBIS Corporation, Kanagawa (JP)

( * ) Notice: Subject to any disclaimer, the term of this patent is extended or adjusted under 35 U.S.C. 154(b) by 0 days.

(21) Appl. No.: 09/180,515

(22) PCT Filed: Nov. 8, 1996

(86) PCT No.: PCT/JP96/03293

§ 371 Date: Nov. 11, 1998

§ 102(e) Date: Nov. 11, 1998

(87) PCT Pub. No.: WO97/43064

PCT Pub. Date: Nov. 20, 1997

(30) Foreign Application Priority Data

May 13, 1996 (JP) ..... 8-155942
Oct. 14, 1996 (JP) ..... 8-308593

(51) Int. Cl.[7] ..... B22D 11/115; B22D 27/02
(52) U.S. Cl. ..... 164/466; 164/476; 164/502
(58) Field of Search ..... 164/504, 468, 164/466, 502, 476

(56) References Cited

U.S. PATENT DOCUMENTS 4,567,937 * 2/1986 Ujiie et al. ..... 164/504
4,924,585 * 5/1990 Imai et al. ..... 164/468

FOREIGN PATENT DOCUMENTS 51-61438 * 5/1976 (JP) ..... 164/504
54-29294 * 9/1979 (JP) ..... 164/504
56-14065 2/1981 (JP) .
57-134245 8/1982 (JP) .
57-177858 * 11/1982 (JP) ..... 164/468
61-132247 * 6/1986 (JP) ..... 164/468
62-148065 7/1987 (JP) .
62-179855 8/1987 (JP) .
60-162559 * 12/1989 (JP) ..... 164/468
6-608 1/1994 (JP) .
6-126405 5/1994 (JP) .
7-214262 8/1995 (JP) .
1532189 * 12/1989 (RU) ..... 164/468

OTHER PUBLICATIONS

Flemings: "Solidification Processing", Fluid Flow, Mc–Graw–Hill, 1974, pp. 244–252.
H. Mizukami et al: "Effect of Electromagnetic Stirring at the Final Stage of Solidification of Continuously Cast Strand", Tetsu To Hagane, vol. 70 (1984), pp. 194–200.

* cited by examiner

*Primary Examiner*—Kuang Y. Lin
(74) *Attorney, Agent, or Firm*—Frishauf, Holtz, Goodman, Langer & Chick, P.C.

(57) ABSTRACT

Method and apparatus for continuous casting, especially casting of steel that can easily provide high quality steel that has no central segregation and central porosity. In other words, in the method and apparatus, central defects are to be eliminated first by identifying the solidifying conditions in the full range from the meniscus (the surface position of the upper portion of molten metal) to the crater end (a final solidification position), based on the type (profile) of continuous casting machine, type of steel, cross-sectional shape and size of a cast piece and the operating conditions such as casting speed, casting temperature and cooling conditions, with special attention paid to the pressure drop of liquid phase induced by the liquid flow between dendrites resulting from the solidification contraction in casting direction in the solid-liquid coexisting zone, second by calculating the condition of the formation of the above internal defects and their positions, and finally by applying an electromagnetic body force (Lorentz force) in the casting direction in the vicinity of the region where the internal defects are formed.

50 Claims, 56 Drawing Sheets

Figure 3 (a) Equilibrium phase diagram
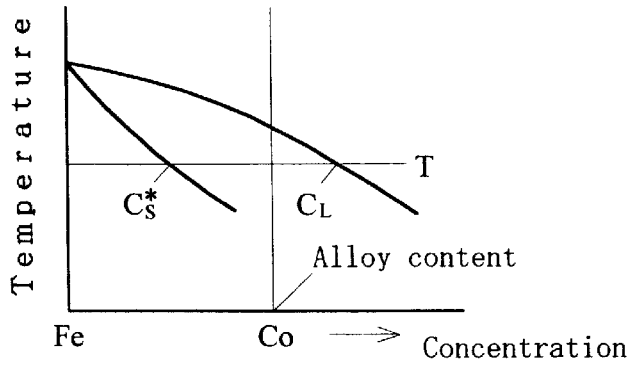
(b) Solute distribution for an equilibrium solidification type alloy at the temperature T
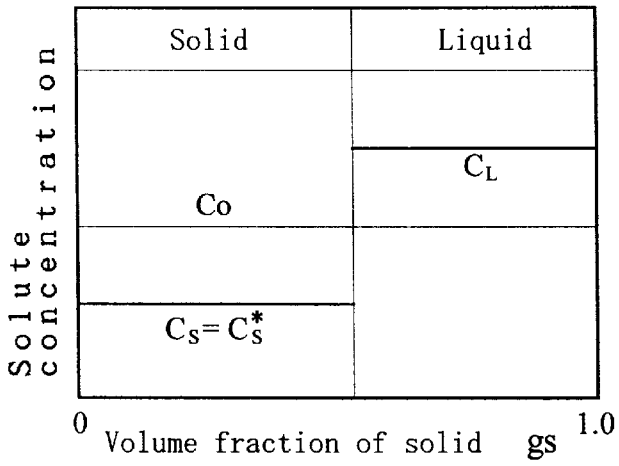
(C) Solute distribution for a nonequilibrium solidification type alloy at the temperature T
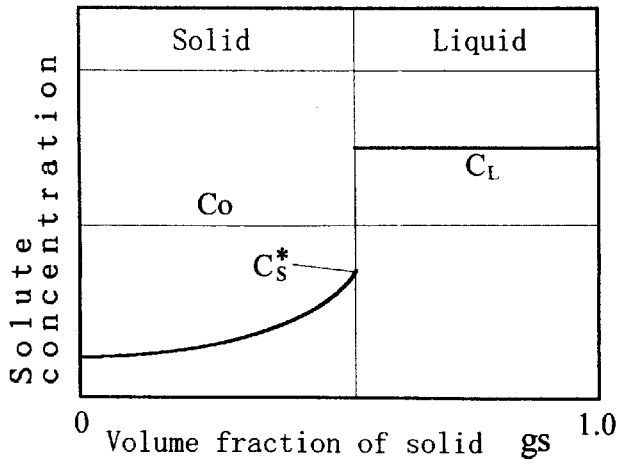

Figure 6
(a)
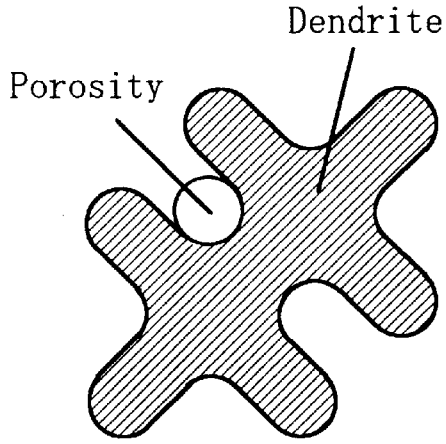
(b)
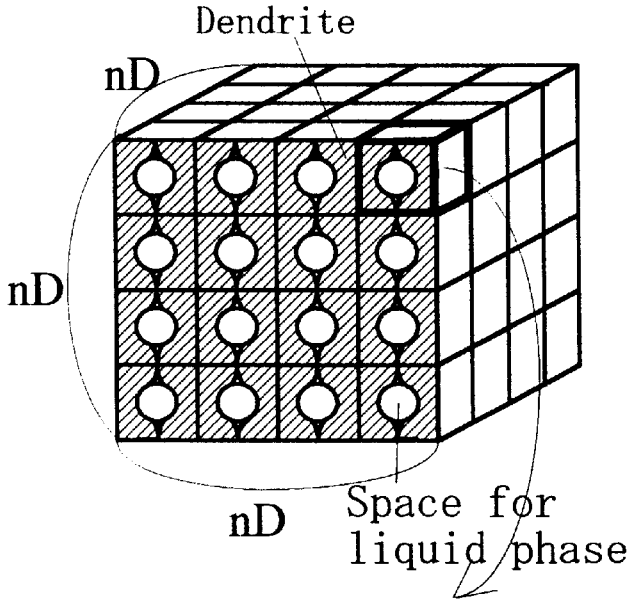
(c)
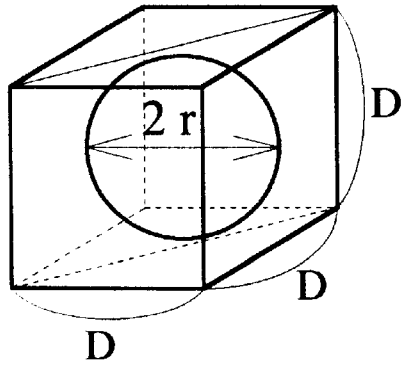

Figure 9
(a)
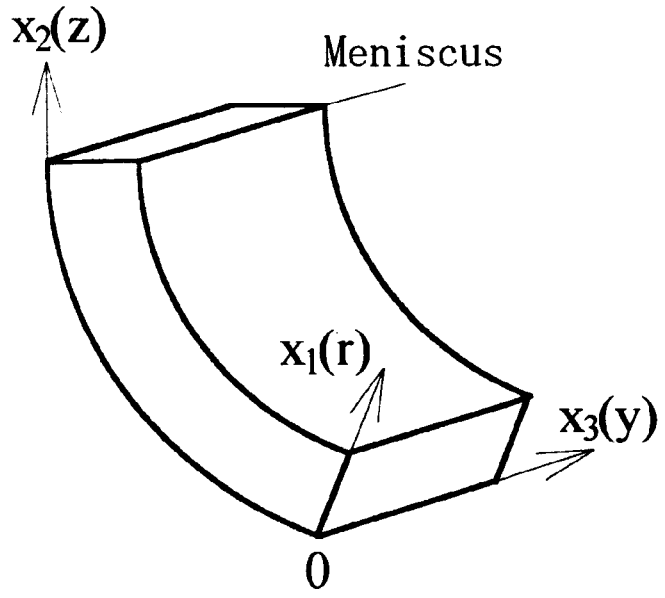
(b)
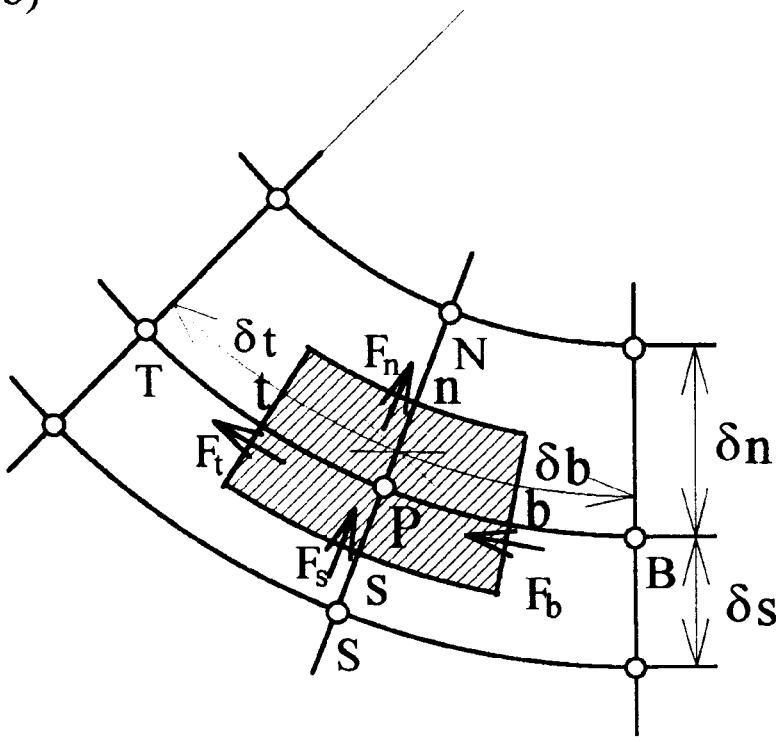

Figure 10(a) Main program
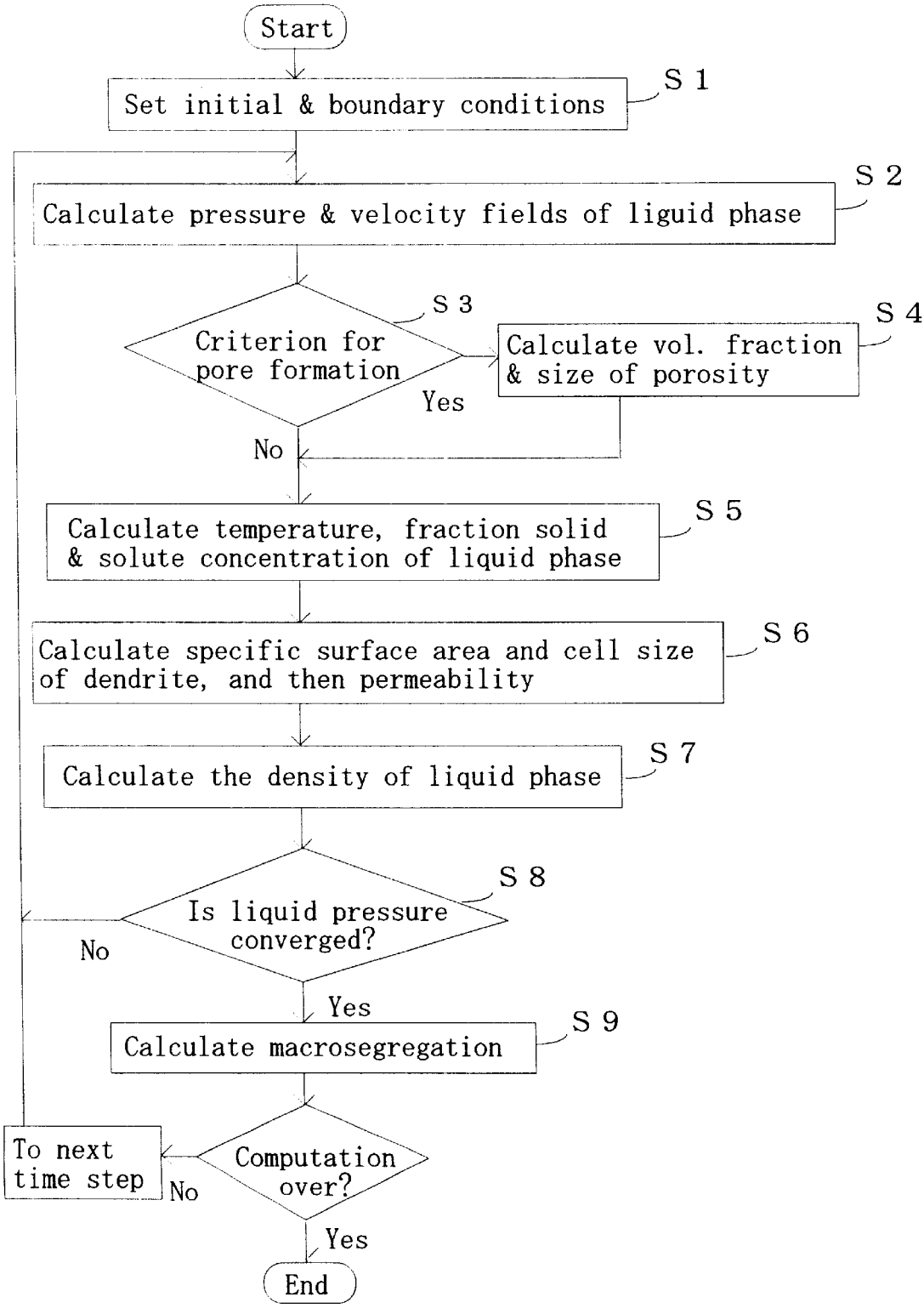

Analysis of the flow field by the extended SIMPLER method (*) : Refer to eq. (E. 106).
Note that the updated velocity field be used.

Figure 14
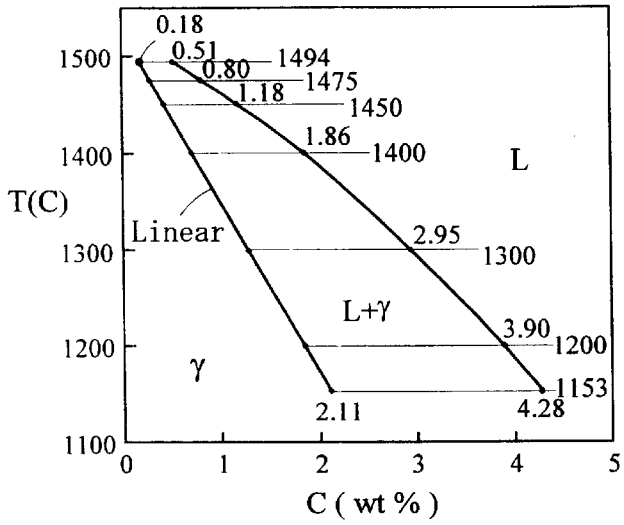
Figure 15
(a) 1 C − 1 C r Bearing steel
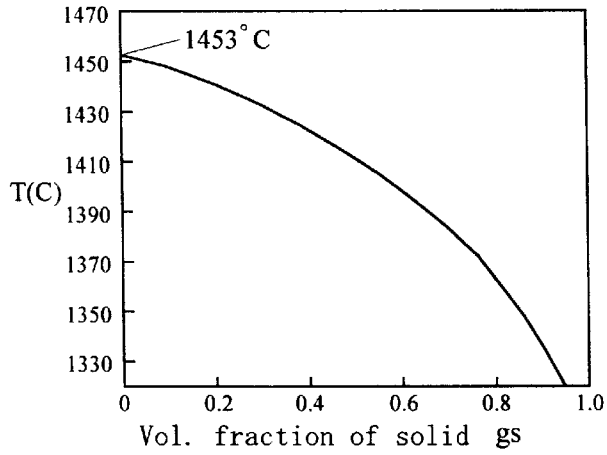
(b) 0. 5 5 % Carbon steel
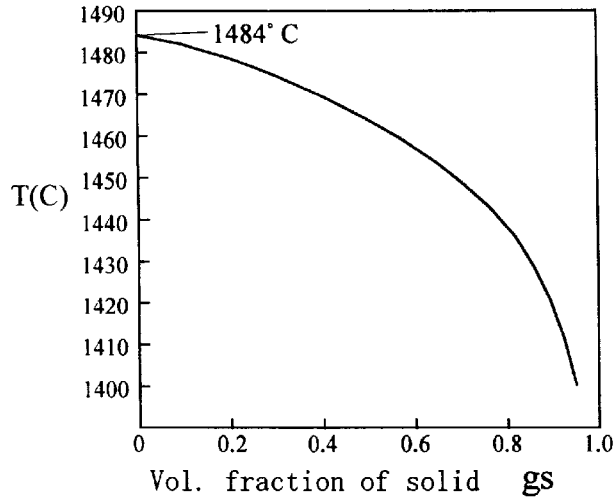

Figure 16
(a) 1C−1Cr Bearing steel
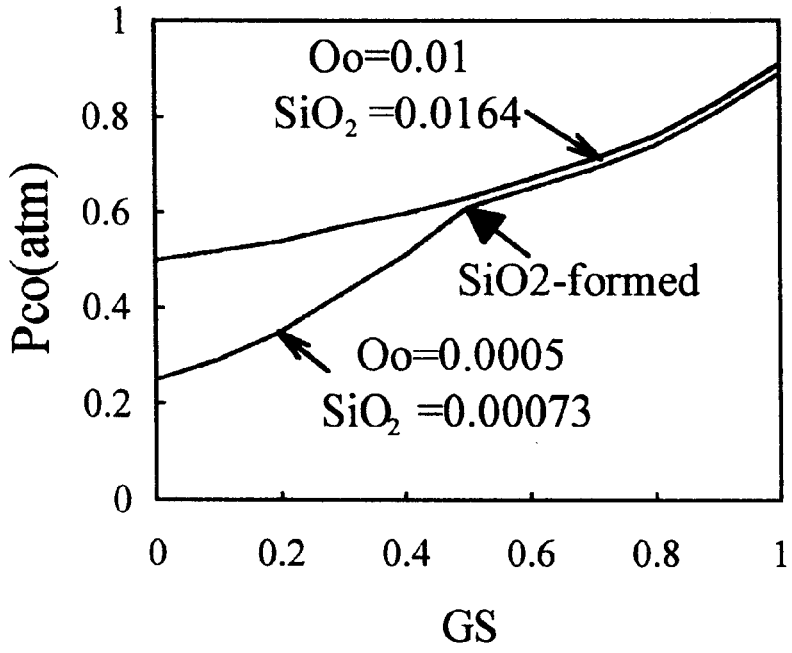
(b) 0.55% Carbon steel
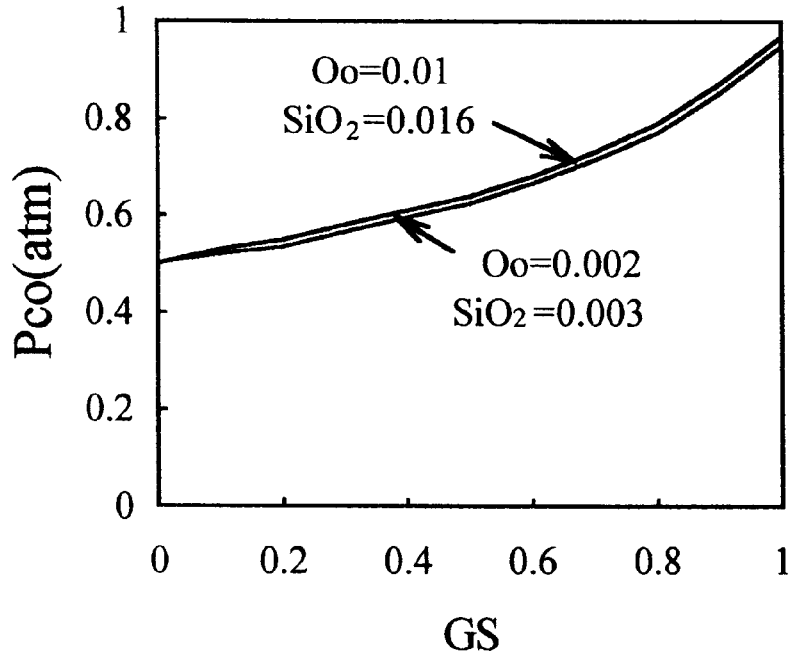

Figure 17
(a)
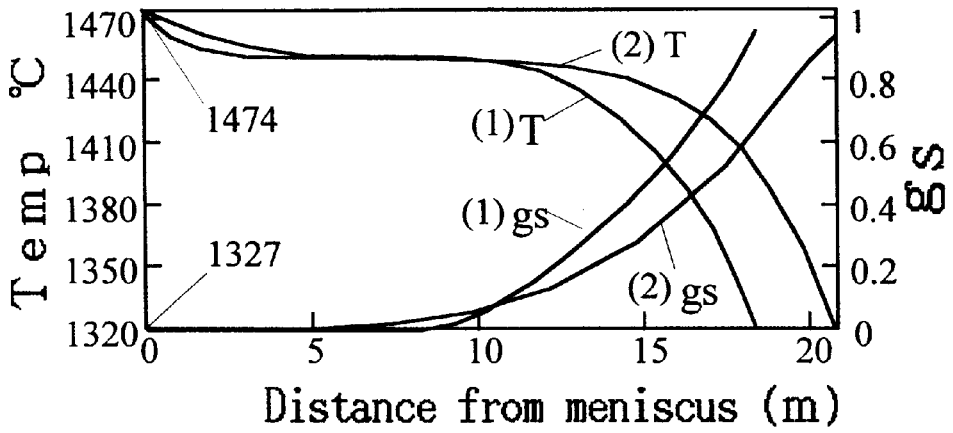
(b)
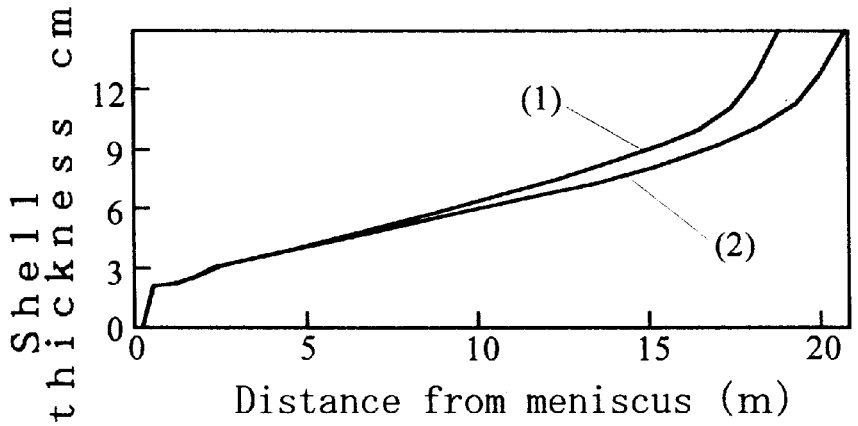

(a) Values computed by eqs. (28) and (29)

(b) Values computed by eq. (31) (A and n are determined A=7.28, n=0.39 so as to be das=35 $\mu$m at the surface element)

(a) Schematic diagram (b) Horizontal cross section

Figure 36
(a)
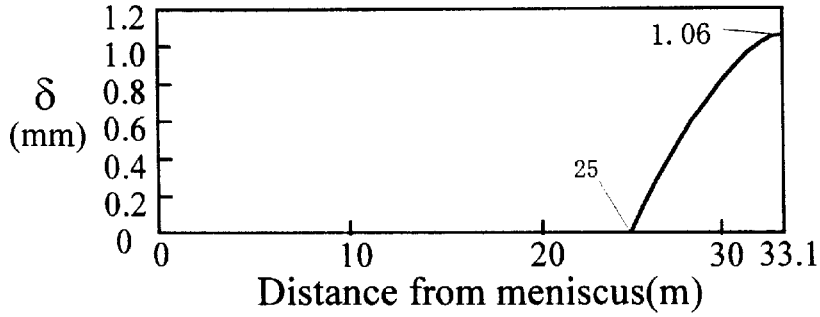
(b)
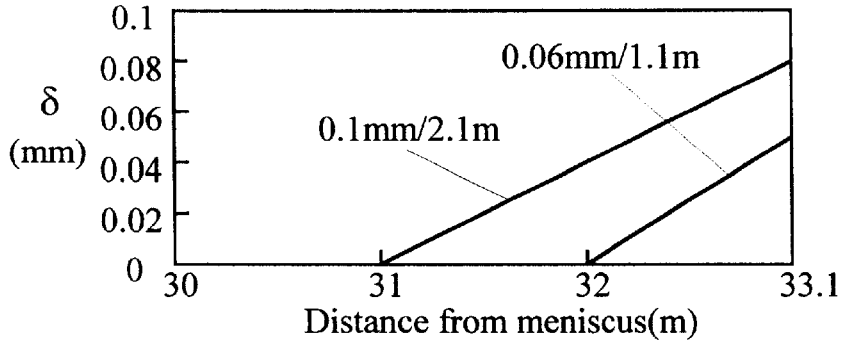
(c)
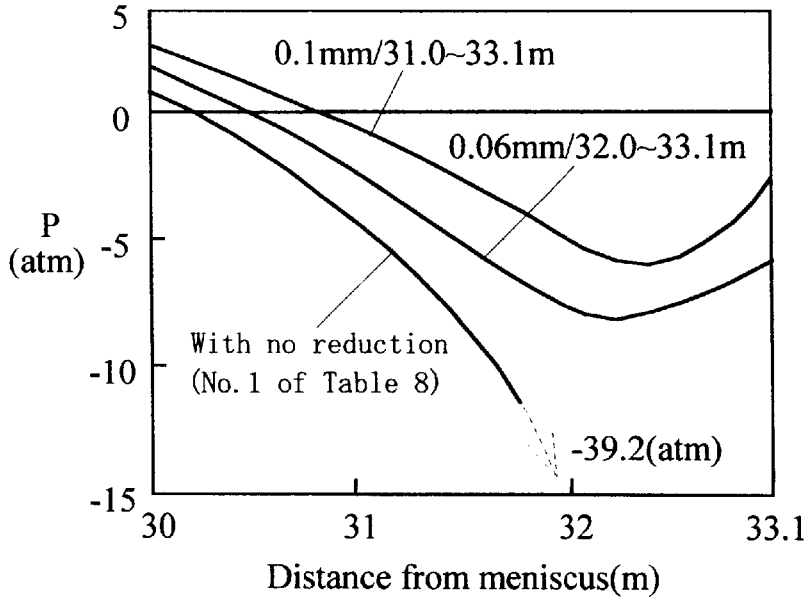

Figure 39
(a)
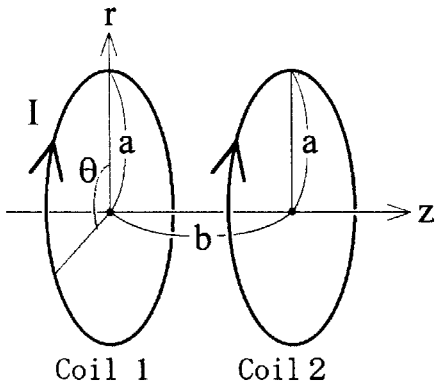
(b)
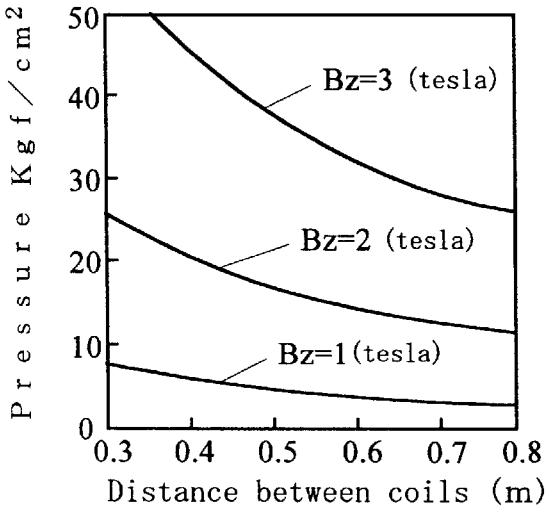
Figure 40
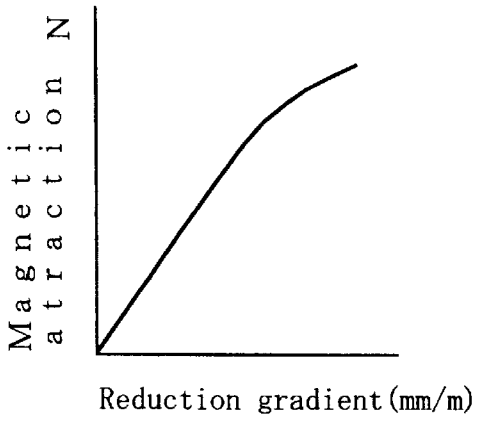

Figure 41
(a) X1 (r) staggered grid
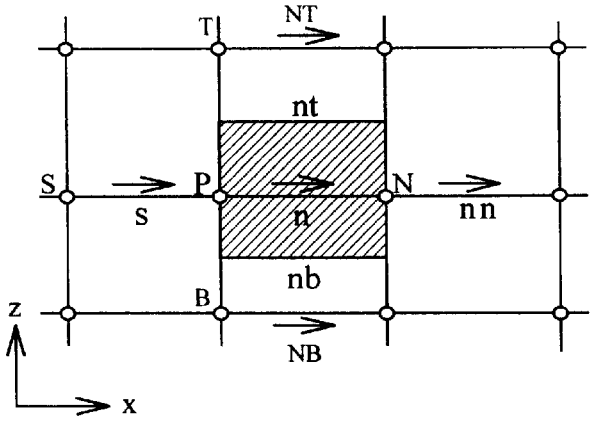
(b) X2 (z) staggered grid
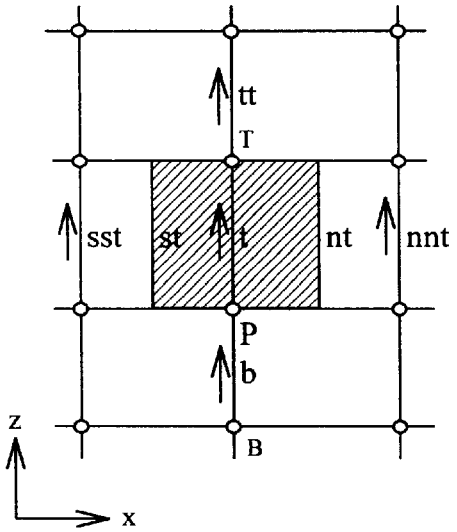
(c) X3 (y) staggered grid
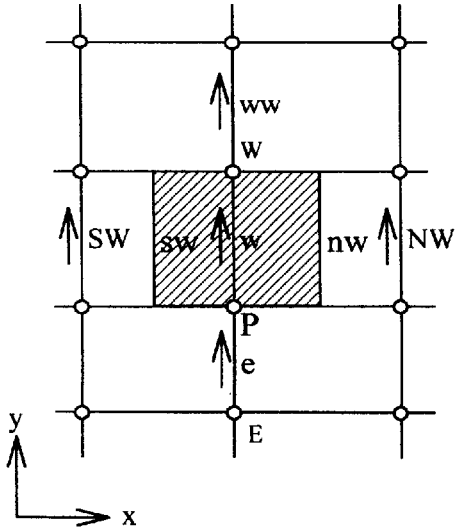

Figure 47
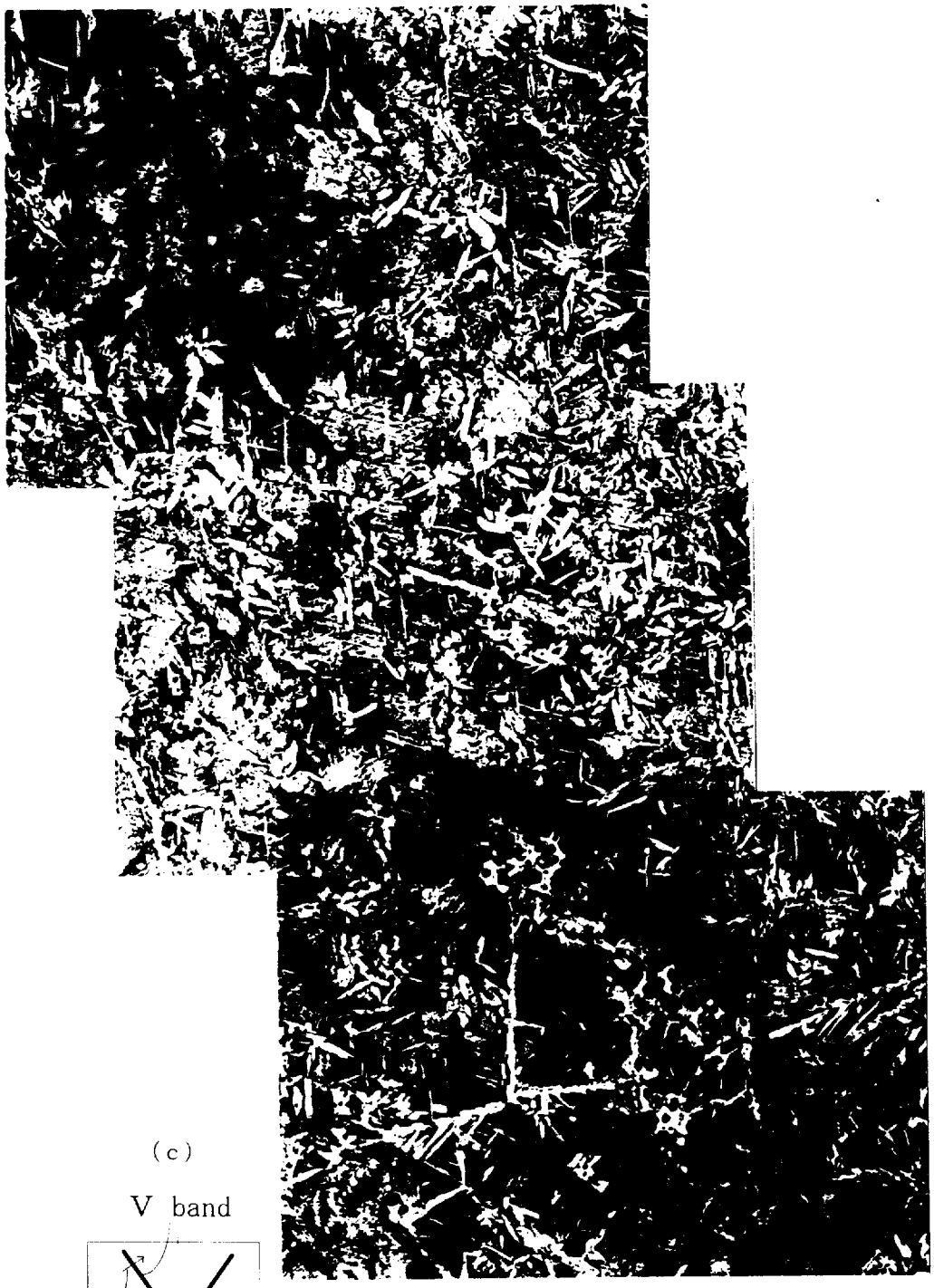
(c)
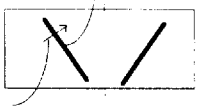
(x 5 0)

Figure 58
(a)
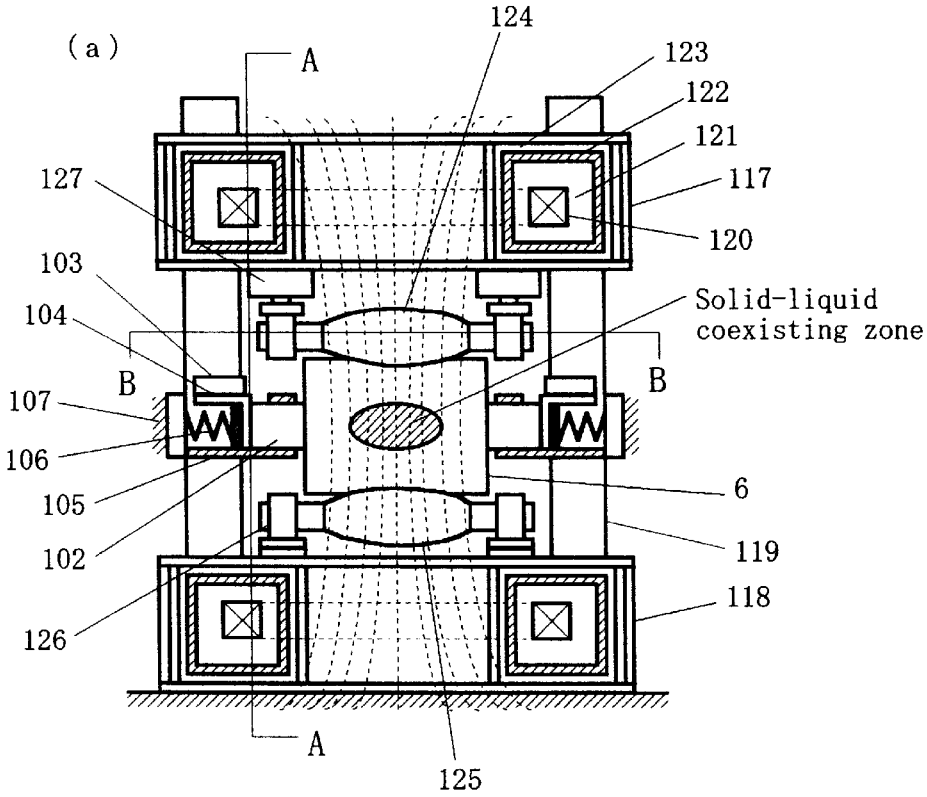
(b) AA cross section
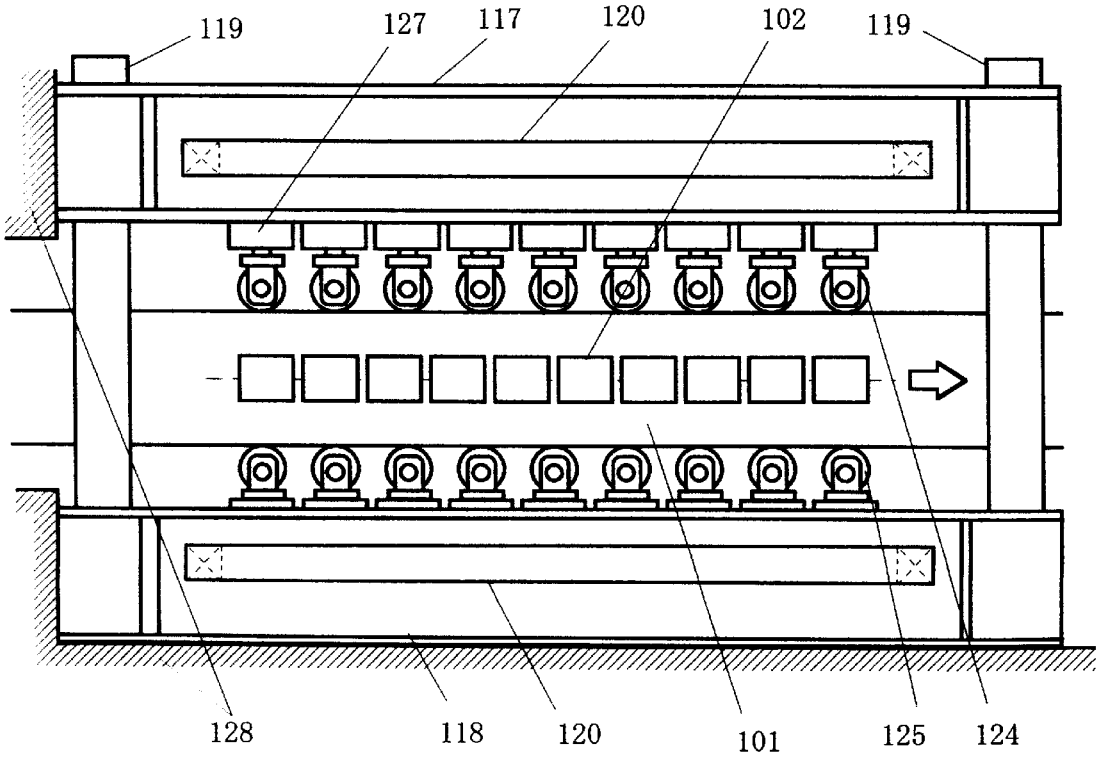

Figure 59
(a) BB cross section of Figure 58(a)
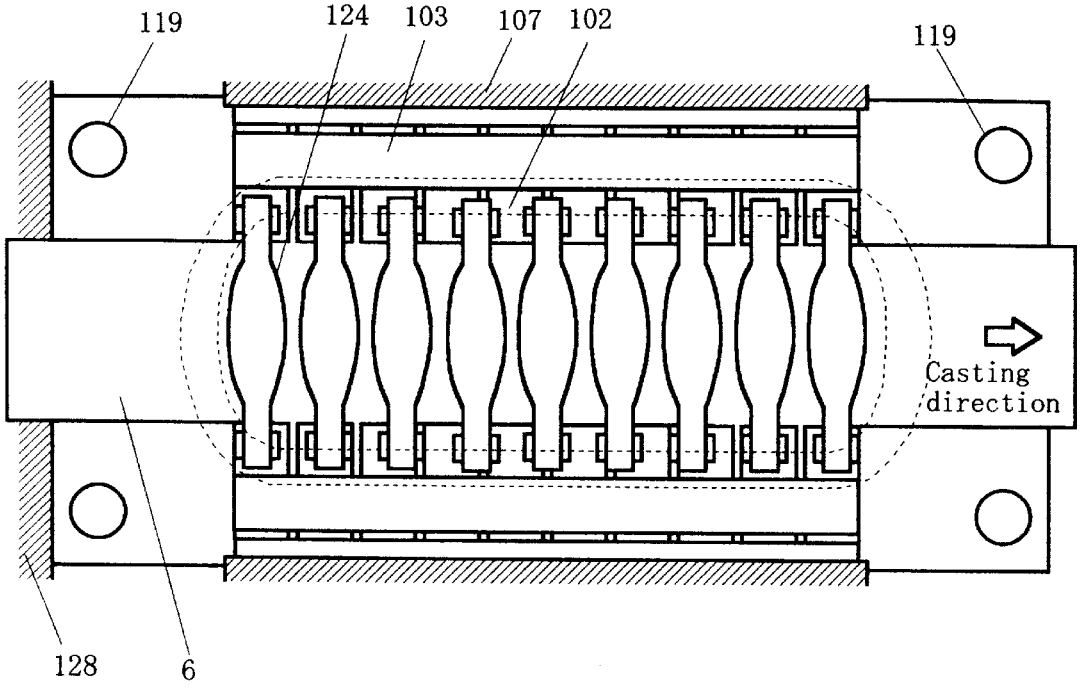
(b)
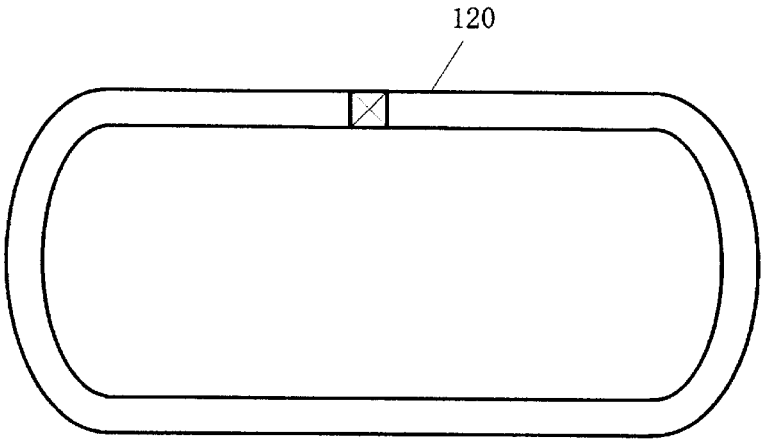

Figure 60
(a) Parallel type
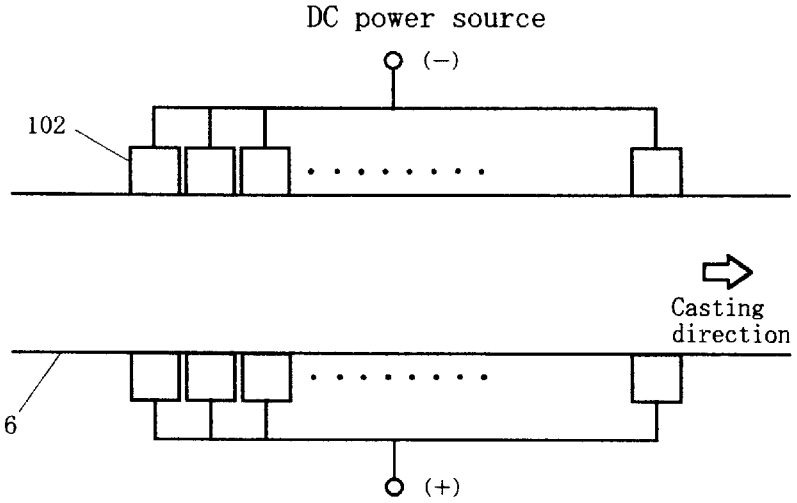
(b) Series type
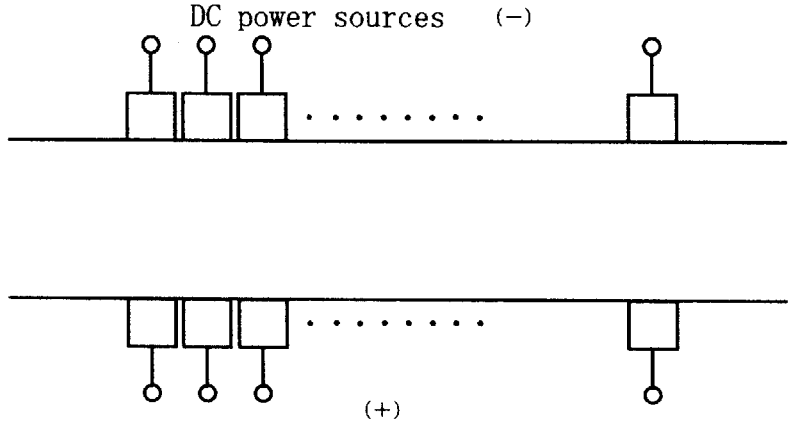
(c) Mixed type
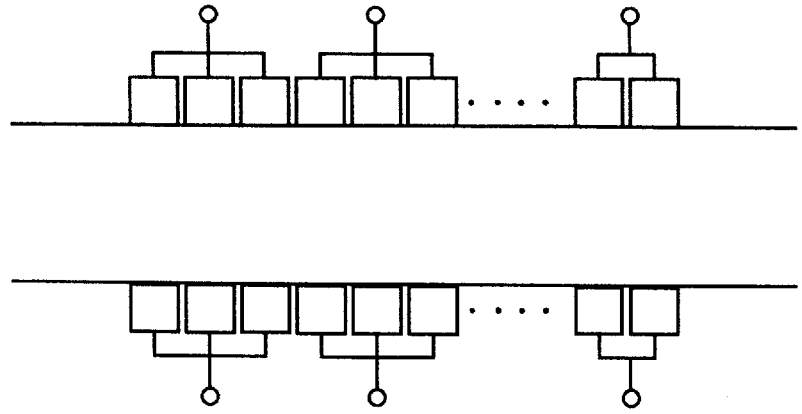

Figure 63
(a)
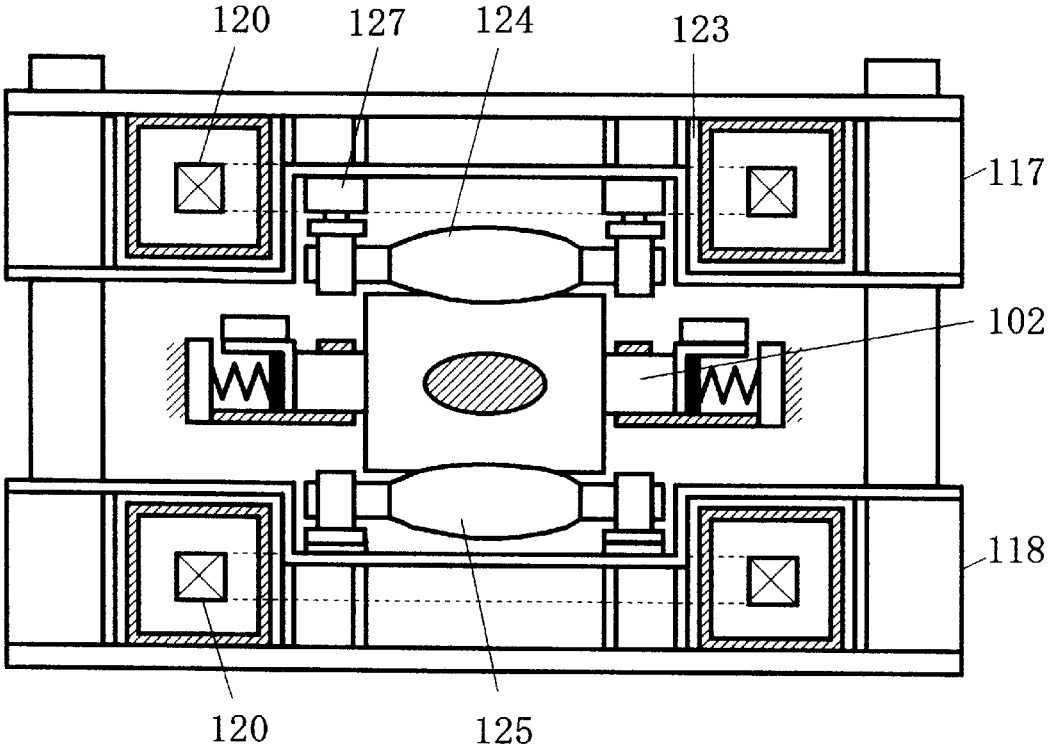
(b)
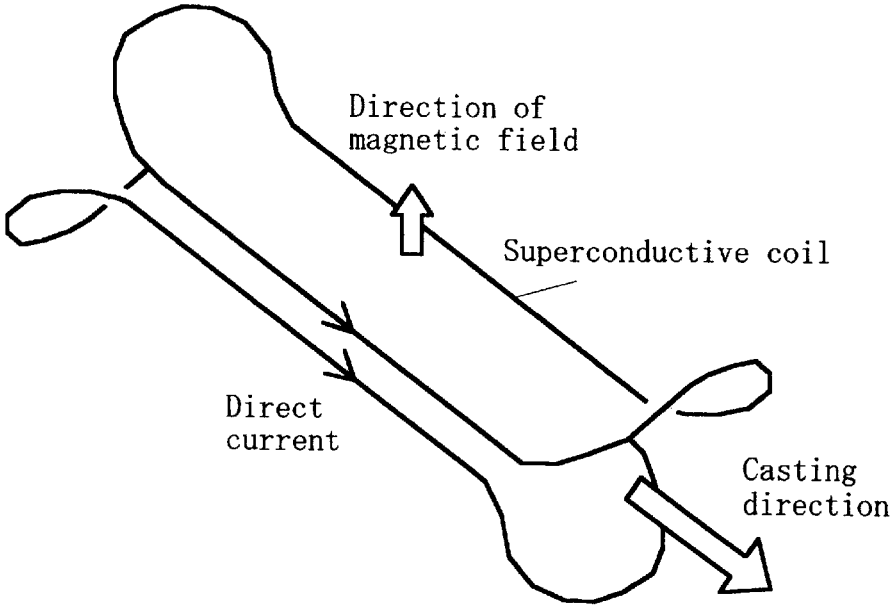

METHOD AND APPARATUS FOR CONTINUOUS CASTING

TECHNICAL FIELD

This invention is concerned with continuous casting, particularly with a suitable continuous casting method and apparatus to produce highly qualified steels without segregation and porosity.

BACKGROUND ART

With regard to the continuous castings of carbon steels, low alloy steels, specialty steels and so on, more than twenty years have passed since the present vertical-bending-type continuous casting machines began to operate. And it has been said that these technologies became mature. On the other hand, the demand for the quality is increasing its severity year after year and the pressure to the cost-down also is increasing simultaneously. Aside from the problems such as breakout, etc. that often became a problem in the early period of the operating history, there still remains (1) central segregation and (2) central microporosity as the major problems concerning the quality.

The central segregation is the segregation having V characters that takes place with a periodicity in the middle of the thickness in the final solidification zone, and is generally called V segregation. The central microporosity is the microscopic void that forms in an interdendritic region also in the middle of the thickness in the final solidification zone. Summarizing these defects, they are to be called the central defects(internal defects) thereafter in this specification.

Next, the effects of the central defects on the quality of the steel products are briefly stated as follows.

(1) The Case of Thick Plate:

Hydrogen coagulates and precipitates into these central defects, and so-called hydrogen induced cracking results during usage. Also, upon welding, the weld cracking occurs starting these defects.

(2) The Cases of Rod and Wire:

Cracking takes place starting the microporosity during drawing.

(3) The Case of Thin Plate:

Upon pressing or during cold rolling, banded defects form, which result from the irregularity in hardness. This irregularity is caused by the coexistence of hard and soft spots due to segregation. The above defects takes place during the solidification process of continuous casting and lead to a poor quality product. The segregation formed during the solidification process remains in final products and can not be eliminated. Tentatively, there is a method of eliminating the macrosegregation by diffusion heat treatment. However, this method is not favorable both economically and technically because a long period of heat treatment at a high temperature is required. As for the microporosity, it is possible to smash them by hot rolling. But whether or not it can completely eliminate them depends on the quantity of the porosity. Furthermore, an attention must be paid to the fact that the microporosity accompany segregation in many cases.

Like this, the central defects is the problem associated with the essence of solidification phenomena, and the present situation is that it is very difficult to solve by means for the accumulation of know-how or by means for trials and errors based improvement. Although there is some difference in degree, these central defects(internal defects) are common to all the steel grades of slabs, blooms and billets. They exist from the beginning of the continuous casting history: Thus, they are an old but at the same time a new problem.

Among the measures that have been carried out until now to improve the internal defects, several important technologies will be reviewed in the following.

(1) Prevention of the Bulging

It has been said that the central segregation is formed in slabs with broad width when the solid part of the solidifying shell or the cast piece between supporting roll pitches was bulged by internal pressure of the steel melt. Although this happens by the flow of high solute concentration liquid within the solid-liquid coexisting zone which is induced by the deformation of the solidifying shell, the detailed mechanism is not clarified satisfactorily. Therefore, to reduce the bulging to as small extent as possible, such measures as shortening the roll pitches or dividing one roll into sub-rolls in the longitudinal direction have been employed. Besides, the misalignment of rolls is said to be responsible for an interdendritic fluid flow, thus causing the segregation. However, the internal defects can not be eliminated even if these mechanical disturbances are removed, considering the fact that the central segregation occurs even in the blooms and billets where the bulginess hardly become the problem.

(2) Strengthening of Secondary Cooling(Please Refer to Refs. (1) and (2) at the End of this Specification)

This is the method of intensively cooling the vicinity of the final solidification position (the crater end) to compress the solid-liquid coexisting phase by contraction force due to thermal stress so as to compensate the solidification contraction, thereby reducing central porosity. It has been reported according to the Refs. (1) and (2) that the improvement was made to some extent.

On the other hand, the main stream at present is the method of compressing the solidifying shell and give compressive deformation to central solid-liquid coexisting phase in the vicinity of final solidification position to control the interdendritic fluid flow, thereby reducing the internal defects. This method is divided into soft-reduction and hard-reduction depending on the amount of reduction.

(3) Soft-Reduction Method at the Last Stage of Solidification(Please Refer to Refs. (3) and (4))

With this method to improve the central segregation, the solid-liquid coexisting zone is compressed to compensate the solidification contraction which takes place continuously with the progress of solidification. With respect to the soft-reduction amount, a slope needs to be attached so as to correspond to the continuously arising solidification contraction as precisely as possible. For example, it is shown in Ref. (3) that the central segregation was improved by the real machine test of a carbon steel bloom that used the compressive crown roll with roundness attached. Also, in Ref. (4), examples are shown about theoretical estimates of reduction gradient necessary for the case of high carbon steel blooms (0.7 to 1 wt % C) with 300×500 mm section. According to the estimates, the gradient of 0.2 to 0.5 mm/m is required. However, various problems must be overcome to realize this method on a real machine, which will be stated below.

① Usually, the soft-reduction is carried out in the range of a couple of meters in the vicinity of the final solidification zone, which becomes approximately 0.3 mm/m in the case of the blooms of the above Ref. (4).

This means that the inclination of 0.3 mm per 1m needs to be attached to the solidifying shell. Thus, the reduction amount must be controlled with great accuracy by means for a multi-rolled reduction apparatus, etc.

② There is a difficulty that if the amount of reduction is not enough, the effect can not be expected, and that if the amount is excessive on the contrary, the interdendritic liquid flows backward to the upstream resulting in the channel segregation (i.e. inverse V segregation).

③ Required amount of reduction differs depending on the operating conditions such as a steel grade, dimensions in cross section, casting speed and cooling condition. Therefore, a great amount of labor and cost is necessary for these trials and errors to find an appropriate condition even in the case of a few steel grades.

④ Since the soft reduction method often gives rise to the new problem of internal cracking(Ref. (5)), a consideration must be taken into to prevent this.

Thus, it is not easy to make use of this method to achieve the purpose.

(4) Continuous Forging Method (Refs. (7) and (8))

Next, stated is the hard-reduction method in which the solid-liquid coexisting phase in the vicinity of the final solidification zone is mechanically largely deformed thereby squeezing the high solute concentration liquid to the upstream to prevent the central segregation (V segregation). There are two methods in this: One is to use large diameter rolls (Ref. (6)), and the other is the continuous forging method in which the shell is continuously forged using anvils (Refs. (7) and (8)). Because both belong to the same category in their concepts, only the latter is described in the following. As shown in FIG. 42, the vicinity of the final solidification zone is forged by anvils while moving toward casting direction together with the anvils. It has been reported that by repeating this cyclically, the high solute concentration liquid within the solid-liquid coexisting zone is squeezed into the upstream region with low volume fraction of solid, thus enabling it possible to suppress the central segregation. Also, it is said that the internal cracking can be avoided by setting up an appropriate forging condition. It is possible to control the segregation ratio Ke ($=\overline{C}/C_0$, $\overline{C}$=average solute concentration, $C_0$=solute content) to be Ke<1 by changing the volume fraction of solid at the time of forging.

The most important point of this method is to clarify the flow phenomenon in the solid-liquid coexisting zone at the time of forging. However, the authors of this reference have derived the relationship between segregation ratio Ke and the volume fraction of solid at the time of squeezing taking into account only the conservation law of solute elements. In their model, the liquid flow in the solid-liquid coexisting zone has not been treated explicitly, that is to say, the influences of the flow of solute concentrated liquid in the dendritic scale on the segregation has not been clarified. Therefore, while it is controllable as for the average macrosegregation in a macroscopic inspection range of the solid-liquid coexisting zone, the information about so-called semi-macrosegregation in much smaller inspection range (dendritic scale) can not be obtained. The semi-macrosegregation remains to some degree in their method.

Accordingly, the mechanism of the formation of the semi-macrosegregation belongs to a future subject and the flow phenomenon of the ejected liquid phase needs be clarified. In this connection, there is a possibility that the V segregation has already been formed when forged: in this case, the questions are raised on how the ejected liquid behaves, on if it remains as the semi-macrosegregation, etc.

In the above references, the blooms having nearly square cross section have been studied where the shape of solid-liquid coexisting zone can be approximated by a cylindrical form, and so when the solidifying shell is compressed in an iso-concentric fashion, the flow pattern will become comparatively simple. But in the case of slabs having broaden width, it is questionable whether or not the flow becomes a simple upstream pattern. In any case, it is not easy at all to predict the flow pattern of the solute concentrated liquid and to evaluate its influences when the solid-liquid coexisting zone is mechanically deformed to a large extent.

(5) Electromagnetic Stirring (Refs. (9) and (10))

This is the method of stirring the solid-liquid coexisting zone by an electromagnetic force in the vicinity of the final solidification zone to disperse the central segregation (Ref. (9)). For example, there is a method of spiral-stirring within the cross section of a solidifying shell. Another method is that the electromagnetic force is applied within the secondary cooling zone or within the mold with the aim of transiting columnar structure to equiaxed structure. The latter method is based on the prerequisite that the equiaxed structure is preferred to the columnar structure as for the central segregation, but the theoretical basis is poor. These methods are not an essential solution and are not the mainstream at present.

(6) The Combination of the Above Methods (1) to (5)

The bulging prevention measure has been esteemed consistently until the present as a fundamental technology and the following combinations are carried out based on this.

For example, it has been reported for carbon steel slabs of 0.08 to 0.18 wt % C in Ref. (10) that with the combination of short roll pitch with sub-segmented rolls (bulging prevention), taper-alignment method (gradually narrowing the gaps between the rolls in the downstream direction to correspond to the contraction of the cast piece due to solidification contraction and temperature drop--)--and strengthened cooling+electromagnetic stirring in the secondary cooling zone, the central segregation was improved compared to the case with no measures taken.

It is also stated in Ref. (11) that the central porosity reduces when the equiaxed structures are developed by simultaneously adopting low casting temperature and electromagnetic stirring for the carbon steel blooms and round billets in which the equiaxed structures are difficult to develop. Furthermore, it is reported that the central segregation and porosity can be reduced by adjusting the reduction amount in the final solidification zone and by developing the equiaxed grains via electromagnetic stirring within the mold.

(7) Cast Rolling Method in a Thin Slab Casting

So-alled mini-mill, that concisely sums up a steel making plant, has become increasingly popular because of such advantages as recycling of raw materials, the energy saving, a low plant construction cost and the gentleness to the earth environment in comparison with a large scaled conventional blast furnace.

With the mini-mill, thin slabs with the thickness of 50 mm or 60 mm (so-called near-net-shape-castings made as close to the size of the final products as possible) are cast, instead of large sectioned conventional castings with the dimensions of 200 mm or 300 mm.

Here, The Cast Rolling method (Ref. (12)) will be described as an example. This method is characterized by gradually compressing and thinning solidifying shell (reduction ratio of 10 to 30%) by rolls the range including the solid-liquid coexisting and liquid phases. This method is supposed to be born from an idea that the solidifying shell can be reduced during solidification considering that there is a limit to make thin at inlet nozzle position, by which the following effects are reported.

①. Because dendrites are mechanically destroyed, equiaxed fine grains are formed.

②. As a result, the macrosegregation is fairly decreased.

However, the flow behavior of high solute concentration liquid induced during heavy deformation of the solid-liquid coexisting zone is unpredictable, and therefore it is not easy to control so as to avoid detrimental defects such as inverse V segregation, etc.

So far, key technologies to improve the internal quality of continuous castings of steels were reviewed from a vast amount of literature. Historically speaking, they trace back to the taper-alignment method for the control of the bulging that causes segregation, progress into the shortened roll pitch/divided roll method, strengthened secondary cooling, electromagnetic stirring and presently become soft/hard-reduction methods or the combination of the electromagnetic stirring and the soft-reduction. Although the technology has been improving meanwhile, it has not yet reached to the essential solution of the problem.

OBJECT OF THE INVENTION

All of the aforementioned technologies are trials and errors based measures based on the empirical and qualitative insights into the solidification phenomena. Therefore, it is inevitable to take a vast amount of time and labor to obtain appropriate conditions every time when the steel grade, the shape and dimensions of the cross section, the machine profile and the operating conditions (casting speed, temperature, cooling method, etc.) are changed. Despite that, many cases have been seen that the optimal conditions can not necessarily be obtained. In conclusion, although the individual technology has succeeded in reducing the segregation temporarily to some extent, there was the inconvenience that the essential solution of the problem can not be obtained, because the solidification behavior is not grasped based on solidification theory, or more precisely speaking, because the mechanism of the formation of the central defects is not satisfactorily clarified.

The purpose of this invention is to solve the aforementioned inconveniences in the conventional technologies, and to provide with the method and apparatus especially in the continuous casting of steels that always can get the good steel with no central segregation and porosity easily, even if the steel grade, the shape and dimensions of cross section, the machine profile, the operating conditions (the casting speed, temperature, cooling method, etc.) are changed or furthermore even if the casting speed is increased to raise productivity.

DISCLOSURE OF INVENTION

Thereupon, this invention tries to eliminate the above-mentioned internal defects by exerting an electromagnetic body force (Lorentz force or simply termed electromagnetic force) toward the casting direction in the solid-liquid coexisting zone which is prolonged along the casting direction at the central part of cast piece. The aim is to complete the feeding of interdendritic liquid toward the casting direction. More specifically, this invention investigates the solidification mode of whole range from meniscus (top surface position of the melt) to the crater end (final solidification position) when the type of the machine, the steel grade, the shape and dimensions of cross section and the operating conditions (casting speed, casting temperature, cooling condition, etc.) are given, with the special attention paid to the pressure drop of the liquid phase due to the interdendritic liquid flow (Darcy flow) which is caused by the solidification contraction in the solid-liquid coexisting zone. This invention possesses the calculation means to figure out the condition for the formation of the internal defects, the position of the formation and the electromagnetic body force required to suppress the internal defects. And it is equipped with the electromagnetic booster (Exerting means for electromagnetic body force) to exert the above-mentioned electromagnetic body force toward the casting direction in the vicinity of the position where the internal defects are formed. Thus, this invention is comprised by the above-mentioned constitution thereby trying to achieve the aforementioned purposes.

BRIEF DESCRIPTION OF DRAWINGS

FIG. 3 is the diagrams for explaining solute redistribution of alloy elements. (A) shows the equilibrium phase diagram for Fe and a certain alloy element, (b) shows the solute distribution for the case of an equilibrium solidification type alloy and (c) shows that for the case of a non-equilibrium solidification type alloy.

FIG. 6 shows the formation site of microporosity and the space size of interdendritic liquid. (a) the formation site of the porosity. (b) and (c) the model for calculating the space size of the liquid.

FIG. 9(*a*) shows the coordinates system used for the numerical analysis and (b) the topology of the discretization. The meanings of the symbols in (b) are similar as those of FIG. 8.

FIG. 10(*b*) is the outline of the flowchart that shows the fluid flow analysis by the momentum equation in the numerical analysis.

FIG. 14 shows the linearized data of Fe—C phase diagram.

FIG. 15 shows the relationships between the temperature and volume fraction of solid for the steels used by the numerical analysis. They were obtained by using the non-linear multi-alloy model. (a) is in the case of 1 C-1 Cr bearing steel and (b) is in the case of 0.55% carbon steel.

FIG. 16 shows the effects of oxygen content on the equilibrium CO gas pressures in interdendritic liquid phase with no CO gas bubbles (refer to eqs. (49) to (58)). (a) is in the case of 1 C-1 Cr bearing steel and (b) is in the case of 0.55% carbon steel.

FIG. 17 shows the distributions of temperature T and volume fraction of solid gS at the center element (a) and the distributions of solidifying shell thickness (b) at the steady state in the example No. 1 for carrying out the invention (vertical continuous casting). The distributions (1) show the case that only the temperature was calculated and the distributions (2) the case that the thermal conductivity of the liquid was multiplied 5 times considering the Darcy flow.

FIG. 36 shows the results calculated to preliminarily examine the effects of soft-reduction in the example No. 3 for carrying out the invention. (a) shows the distribution of the reduction required to compensate the net solidification contraction (computed toward downstream from the reference position of 25 m from the meniscus where the volume fraction of solid at the center is 0.1). (b) shows linear reduction gradients in the neighborhood of the crater end. (c) shows the computational results showing the degree of relaxation of the liquid pressure drop for the given reduction gradients.

FIG. 39 is the schematic diagram showing the attractive forces generated between the coils in the case that superconductive coils are used as an apparatus to generate DC magnetic field. (a) shows cylindrical coordinates system (r, θ, z). (b) shows the results calculated for the cases that the magnetic flux densities Bz at the center z=b/2 are set 1,2 and 3 (Tesla) (a is fixed at 0.8 m). Symbol I denotes the electric current in coil, and the pressure (Kgf/cm$^2$) are the values of the attractive forces divided by the cross-section area of coil.

FIG. 40 is a schematic diagram for explaining the relationship between magnetic attraction and reduction gradient (mm/m). Most of the deformation is concentrated to the dendritic skeleton of the central part of solid-liquid coexisting zone where the mechanical strength is extremely low in comparison with solid, and the relationship between the magnetic attraction and the reduction gradient (in other words displacement) becomes slightly nonlinear.

FIG. 41 is the diagrams for explaining the staggered grids used for the discretization of momentum equation. (a) is the staggered grid in $X_1$(r) direction, (b) is that in $X_2$(z) direction and (c) is that in $X_3$(Y) direction respectively.

FIG. 47 is the microstructure of the V pattern in as cast specimen in the atmosphere.

FIG. 58 is the specific diagram in which the electromagnetic booster by this invention is installed to the continuous castings having rectangular cross-sections such as bloom and billet. (a) shows cross-section diagram and (b) shows the AA side view. The broken lines of (a) denote DC magnetic field and the arrow of (b) denotes casting direction.

FIG. 59 is the ground plan of the electro-magnetic booster of FIG. 58. (a) shows the BB cross-section of FIG. 58 and (b) the race-truck-type superconductive coil.

FIG. 60 shows the circuit diagrams of DC electrodes. (a) is parallel type, (b) series type and (c) mixture type.

FIG. 63 is the specific diagram of the electromagnetic booster by this invention in which the distance between the superconductive coils is narrowed in comparison with that of the booster of FIG. 58. (a) shows the cross-section and (b) the horse-saddle type superconductive coils.

| Explanation of Reference Symbols | |
|---|---|
| 1 | Electromagnetic booster |
| 1a | High rigid frame |
| 1b | Cast piece |
| 1c | DC rotating electrode |
| 1d | Spring |
| 1e | Fixed axle |
| 1f | Nonmagnetic roll |
| 2 | Ladle |
| 3 | Tundish |
| 4 | Nozzle |
| 5 | Water-cooled mold |
| 6 | Cast piece |
| 7 | Bending rolls |

-continued

| Explanation of Reference Symbols | |
|---|---|
| 8 | Unbending rolls |
| 9 | Detecting section |
| 10 | Computer, CPU |
| 11 | Final controlling section |
| 12 | Display unit |
| Symbols 13 to 101 missing | |
| 102 | Electrode |
| 103 | Flat bus bar |
| 104 | L-shape bus bar |
| 105 | Insulating electrode box |
| 106 | Spring |
| 107 | Electrode-fixing frame |
| 108 | Plane milling toll |
| 109 | Gas shield box to prevent oxidization |
| 110 | Electrode box room |
| 111 | Plane milling tool room |
| 112 | Gas inlet |
| 113 | Gas inlet |
| 114 | Cutting tool |
| 115 | Discharging outlet of cut chips |
| 116 | Air gap to release oxidation-preventing gas |
| 117 | Upper frame |
| 118 | Lower frame |
| 119 | Pillar |
| 120 | Superconductive coil |
| 121 | Cooling chamber for superconductive coil |
| 122 | Rigid frame to hold superconductive coil |
| 123 | Outer cooling chamber |
| 124 | Upper rolls |
| 125 | Lower rolls |
| 126 | Bearing |
| 127 | Oil-hydraulic cylinder |
| 128 | Rigid frame both fixable and movable in the longitudinal direction of cast piece |
| 129 | Upper split rolls |
| 130 | Lower split rolls |
| 131 | Flexible bus bar or cable |

A. Numerical Analysis of Solidification Phenomena

In order to know the position of internal defects and their morphologies precisely, the mechanism of the formation of the internal defects must be clarified, and further it is inevitable to perform numerical analyses of the solidification phenomena on the basis of solidification theory. Then first, the theory of the numerical analysis in the computational means for this invention will be described in detail. Subsequently, the mechanism of the formation of the internal defects will be stated.

A-1. Theoretical Equations for the Numerical Analysis of the Solidification Phenomena The equations are described in the following sections that these inventors conceived for the numerical analysis of solidification phenomena on the basis of the solidification theory.

(1) The Energy Equation

The energy equation is given by Eq. (1) that describes the energy conservation for a certain volume element in the solid-liquid coexisting zone.

Figure 7:
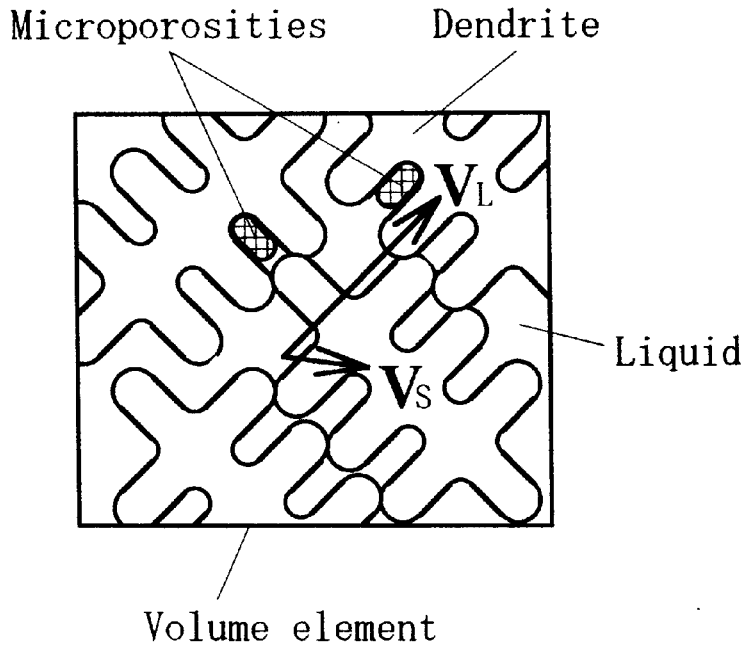
FIG. 7 shows the schematic diagram of the volume element used for the numerical analysis. $V_L$ is flow velocity vector of the interdendritic liquid and $V_S$ is deformation rate vector of the dendrite crystal.

As shown in FIG. 7, the volume element is regarded sufficiently large compared to dendrite arm spacing (spacing between the branches of dendrite crystal) and small enough to be able to judge the changes of such physical quantities as temperature T, volume fraction of solidgs , etc.

$$\frac{\partial}{\partial t}(\overline{c\rho}T) + \nabla \cdot \{(c_P^L \rho_L g_L v_L + c_P^S \rho_S g_S v_S)T\} = \nabla \cdot (\bar{\lambda} \nabla T) + S \tag{1}$$

The details of each symbol are listed in Table 1 at the end of this description. The first term on the left of the equation is the change of the heat capacity per unit volume and time, the second term is the divergence (outgoing heat quantity per unit volume and time) due to interdendritic liquid flow and deformation of solid, the first term on the right is the divergence due to heat conduction and S heat source term. S consists of the sum of the latent heat of fusion, the effect of solid deformation and the heat of Joule by electric current as shown in Eq. (2).

$$S = \bar{\rho} L\left(\frac{\partial g_S}{\partial t} + v_S \cdot \nabla g_S\right) + Q_J \tag{2}$$

Also, the average heat capacity $\overline{c\rho}$ in Eq. (1) is given as Eq. (3) using the volume fractions of solidgS and liquid $g_L$.

$$\overline{c\rho} = C^L{}_P \rho_L g_L + c^S{}_P \rho_S g_S \tag{3}$$

Here, introducing the volume fraction of porosity $g_V$, the following relation holds.

$$g_S + g_L + g_V = \tag{4}$$

Also, the temperature dependencies of specific heat C, density ρ and thermal conductivity λ are taken into account both for solid and liquid. The suffix L denotes liquid and the suffix S solid. Furthermore, Eqs. (1) and (2) can of course be applied to the liquid and solid phases and the phases including porosity in addition to the solid-liquid coexisting zone.

(2) The Solute Redistribution Equation

Figure 4:
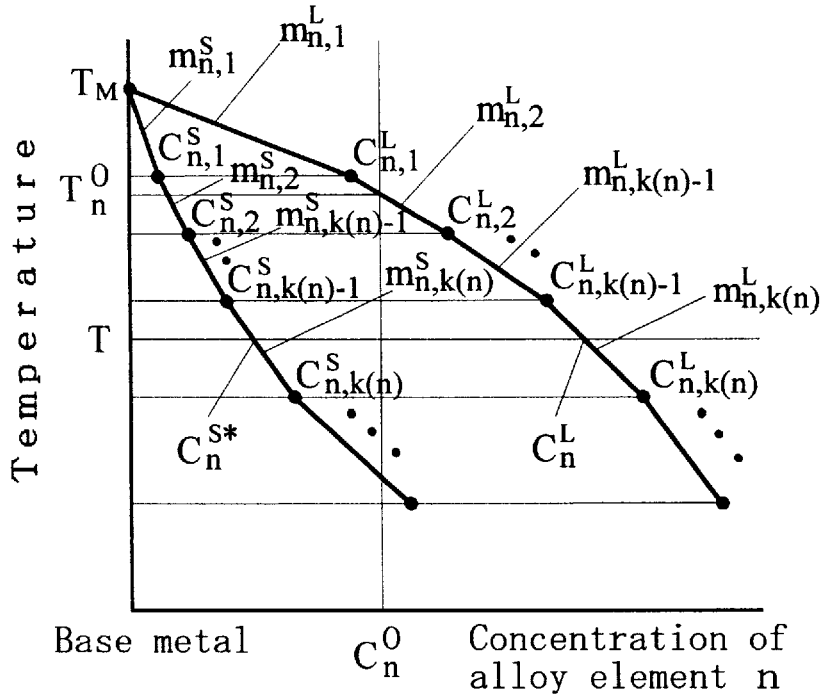
FIG. 4 shows local linearization model of a nonlinear binary phase diagram.

Solute atoms dissolve in solid and liquid, and their distributions are determined by the equilibrium phase diagrams and the diffusion rates in each phase. For example, carbon atoms diffuse promptly in solid phase (at high temperature) as well as in liquid phase. On the other hand, the diffusion rate of silicon atoms in solid is very slow. Thereupon, it is assumed in this invention that while all alloy elements diffuse completely in interdendritic liquid phase, only carbon diffuses but other elements do not regarding the diffusion in solid. In other words, carbon is regarded as an equilibrium solidification type element as shown in FIG. 3(*b*) and others non-equilibrium solidification type elements as shown in FIG. 3(*c*). Considering the nonlinearities of liquidus and solidus lines in equilibrium phase diagram as shown in FIG. 4, the relationship between the solute concentration of solid $C^{S*}$ and that of liquid $C_L$ at the liquid-solid interface is expressed by Eq. (5) (please refer to Ref. (15) for detailed derivation).

$$C_n^L - C_n^{S*} = A_{n,k(n)} C_n^L + B_{n,k(n)} \tag{5}$$

where, $$A_{n,k(n)} = 1 - \frac{m_{n,k(n)}^L}{m_{n,k(n)}^S} \tag{6}$$

$$B_{n,k(n)} = \frac{m_{n,k(n)}^L}{m_{n,k(n)}^S} \cdot C_{n,k(n)-1}^L - C_{n,k(n)-1}^S \tag{7}$$

$m^L$ and $m^S$ are the slopes of liquidus and solidus lines respectively, and other symbols are shown in FIG. 4 where the suffix n denotes alloy element and the suffix k the locally linearized segment number of the liquidus and solidus lines. In order to derive the conservation law of solute elements within liquid and solid phases, it is necessary to take into account the flow of solute concentrated liquid and also the deformation in the mushy phase. The solute conservation law including these effects is expressed by the next equation.

$$\frac{\partial}{\partial t}(\overline{C_n}\overline{\rho}) + \nabla \cdot \left(\rho_L g_L C_n^L v_L + \rho_S g_S \overline{C_n}^S v_S\right) = \nabla \cdot (D_n^L \rho_L g_L \nabla C_n^L) \tag{8}$$

The first term on the left of Eq. (8) is the change in the average solute mass, the second term is the divergence due to the interdendritic liquid flow and the deformation of the mushy zone, and the right side is the diffusion term in the liquid. The detailed explanation of the symbols is given in Table 1 at the end of this description. Next, the mass conservation law or the continuity equation is given by the following equation.

$$\frac{\partial \overline{\rho}}{\partial t} + \nabla \cdot (\rho_L g_L v_L + \rho_S g_S v_S) = 0 \tag{9}$$

Eq. (8) does not explicitly describe $C_n^L$ itself, the solute concentration in liquid phase. Therefore, by combining Eqs. (5) to (9), a series of equations for equilibrium and non-equilibrium solidification type alloys are derived as follows.

$$\frac{\partial C_n^L}{\partial t} + v_L \cdot \nabla C_n^L = \nabla \cdot (D_n^L \nabla C_n^L) + S \tag{10}$$

$$S = \hat{A}_n \frac{\partial g_S}{\partial t} - \hat{B}_n \frac{\partial g_V}{\partial t} + \hat{C}_n \nabla \cdot (g_S v_S) - \hat{D}_n v_S \cdot \nabla \overline{C_n}^S \tag{11}$$

Here, the coefficients for the equilibrium solidification type alloys (denoted by suffix j) are given by Eqs. (12) to (15).

$$\hat{A}_j = \frac{A_{j,k(j)} C_j^L + B_{j,k(j)}}{(1-\beta) g_L} \cdot \left[1 - \frac{(1-\beta)(1 - A_{j,k(j)}) g_S (g_L + g_S)}{\{(1-\beta) g_L + (1 - A_{j,k(j)}) g_S\}\{(1-\beta) g_L + g_S\}}\right] \tag{12}$$

$$\hat{B}_j = \frac{A_{j,k(j)} C_j^L + B_{j,k(j)}}{(1-\beta) g_L} \cdot \left[\frac{(1-\beta)(1 - A_{j,k(j)}) g_S^2}{\{(1-\beta) g_L + (1 - A_{j,k(j)}) g_S\}\{(1-\beta) g_L + g_S\}}\right] \tag{13}$$

$$\hat{C}_j = \frac{A_{j,k(j)} C_j^L + B_{j,k(j)}}{(1-\beta) g_L} \tag{14}$$

$$\hat{D}_j = \frac{g_S}{(1-\beta) g_L} \tag{15}$$

Likewise, the coefficients for the nonequilibrium solidification type alloys (denoted by suffix i) are given by Eqs. (16) to (19).

$$\hat{A}_i = \frac{A_{i,k(i)} C_i^L + B_{i,k(i)}}{(1-\beta) g_L} \tag{16}$$

$$\hat{B}_i = \frac{(1 - A_{i,k(i)})}{(1-\beta) g_L}\left(C_i^{L,old} + \frac{B_{i,k(i)}}{A_{i,k(i)}}\right) \cdot \left(\frac{1 - g_V^{old} - g_S^{old}}{1 - g_V - g_V}\right)^{\frac{A_{i,k(i)}}{1-\beta}} \tag{17}$$

$$\hat{C}_i = \frac{C_i^L - \overline{C_i}^S}{(1-\beta) g_L} \tag{18}$$

$$\hat{D}_i = \frac{g_S}{(1-\beta) g_L} \tag{19}$$

Furthermore, solidification contraction β is defines by $$\beta = \frac{\rho_S - \rho_L}{\rho_S}. \tag{20}$$

(3) The Relationship Between Temperature and Volume Fraction of Solid

Given the volume fraction of solid gS, the corresponding solute concentration of liquid $C_n^L$ can be determined and then the temperature is defined as a function of $C_n^L$. Thus, $$T = T(C_1^L, C_2^L, \ldots) \tag{21}$$

Here, it is assumed that the liquidus temperature of a multi-alloy system during solidification is determined by the superposition of the temperature drops in the binary phase diagrams of mother metal and each alloy element. Then, the relation of Eq. (21) can be expressed by Eqs. (22) and (23) (Ref. (15)).

$$T = T_{k-1} + \sum_{n=1}^{N} m_{n,k(n)}^L (C_n^L - C_{n,k(n)-1}) \tag{22}$$

Where, $$T_{k-1} = T_M - \sum_{n=1}^{N} (T_M - T_n^0) + \sum_{n=1}^{N} \sum_{k=1}^{k(n-1)} m_{n,k}^L (C_{n,k}^L - C_{n,k-1}^L) \tag{23}$$

The details of each symbol are shown in Table 1. Also, N denotes the number of alloy elements.

Next, differentiating Eq. (22) with respect to time and substituting the above-mentioned Eg. (10) to it, the temperature-volume fraction of solid relationship of Eq. (24) is obtained.

$$\frac{\partial T}{\partial t} + v_L \cdot \nabla T = S \tag{24}$$

Where, S is given by Eq. (25).

$$S = \left(\sum_{n=1}^{N} m_{n,k(n)}^L \hat{A}_n\right) \frac{\partial g_s}{\partial t} - \left(\sum_{n=1}^{N} m_{n,k(n)}^L \hat{B}_n\right) \frac{\partial g_V}{\partial t} + \left(\sum_{n=1}^{N} m_{n,k(n)}^L \hat{C}\right) \nabla \cdot (g_S v_S) - \frac{g_S}{(1-\beta) g_L} v_s \cdot \left(\sum_{n=1}^{N} m_{n,k(n)}^L \nabla \overline{C}_n^s\right) + \nabla \cdot \left(m_{n,k(n)}^L \hat{D}_n^L \nabla C_n^L\right) \tag{25}$$

Ⓐ$_n$, Ⓑ$_n$, Ⓒ$_n$ and Ⓓ$_n$ in the above equation are given with the aforementioned Eqs. (12) to (20).

(4) The Darcy Equation

It is well known that the flow of the interdendritic liquid is described by Darcy's equation as follows (refer to p.234 of Ref. (14)).

$$v_L = -\frac{K}{\mu g_L}(\nabla P + X) \tag{26}$$

Where, the vector $V_L$ is the flow velocity of interdendritic liquid, $\mu$ is the viscosity of the liquid, K is the permeability, P is the liquid pressure and X is the body force vector such as gravitational/centrifugal forces that includes the electromagnetic body force (the Lorentz force).

Besides, K is a constant determined by dendrite morphology (the geometrical structure of dendrite), and is given by the following equation of Kozney-Carman (Ref. (17)).

$$K = \frac{(1-g_S)^3}{fS_b^2} \tag{27}$$

Here, Sb is the surface area per unit volume of the dendrite crystals (termed specific surface area), f is a dimensionless constant having the value of 5 as determined from flow experiments through porous media. Although K is basically a tensor quantity having anisotropy, it is obtained by the following two methods.

Method 1: Determination of the Permeability by a Dendrite Solidification Model

In order to determine Sb in the equation of K, it is necessary to define a concrete dendrite morphology and take into account the solute diffusions in solid and liquid.

Figure 5:
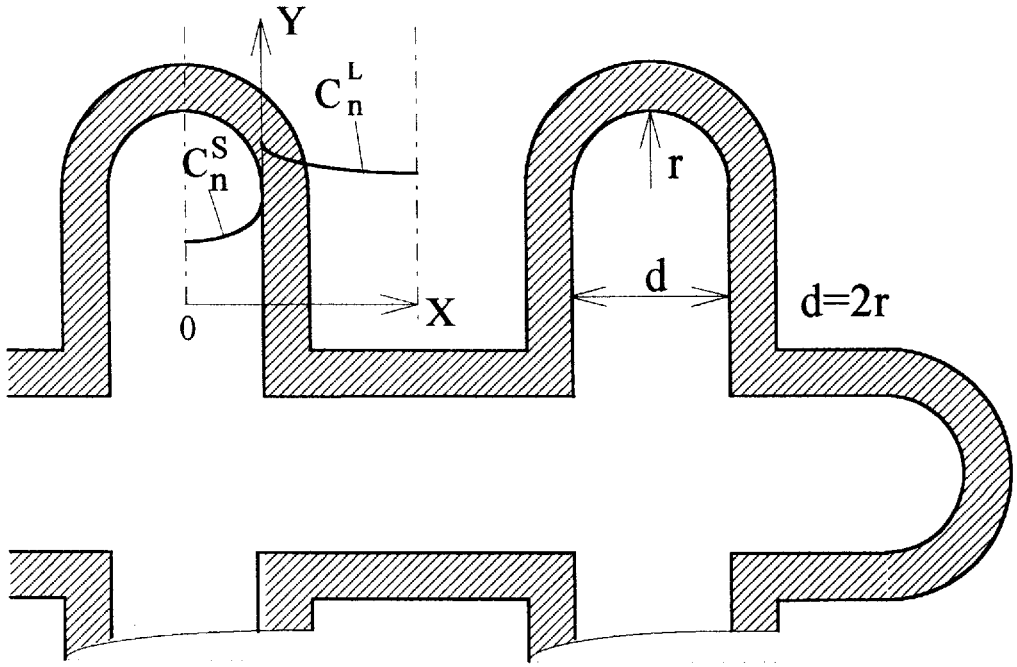
FIG. 5 is the schematic diagram showing a dendritic solidification model.

Kubo and Fukusako (Ref. (18)) made a dendritic solidification model where a dendrite is modeled to comprise trunks and branches with cylindrical shape and tips with half-spheres as shown in FIG. 5, and derived conservative law of a solute element at solid-liquid interface. Introducing the super-cooling phenomena (refer to pages 152 and 266 of Ref. (14)) due to the curvature effects at the cylindrical and spherical interfaces, they derived the equation of Sb and showed that the calculated values of the permeability K agreed well with the measured values.

In FIG. 5, the shaded portion denotes high solute concentrated region where the solute atoms are rejected from the interface. Also, d is the diameter of dendrite cell, r the radius of half-sphere of dendrite tip.

Thereupon, extending their method to the aforementioned nonlinear multi-alloy model, these inventors derived the following equation.

$$Sb = \alpha\left[-\sum_{n=1}^{N}\frac{m_{n,k(n)}^{L}}{D_n^L}(A_{n,k(n)}C_n^{L^*}B_{n,k(n)})\frac{\partial g_S}{\partial t}3\phi(1-g_S)g_S\rho_S\frac{L}{\sigma_{LS}T}\right]^{\frac{1}{3}} \tag{28}$$

Where, $\alpha$ is the correction factor introduced to correct the errors of various physical properties. $C_n^{L^*}$ is the solute concentration of liquid at solid-liquid interface and can be approximated as $C_n^{L^*}=\overline{C}_n^{L}$ (average sloute concentration of liquid)$=C_n^{L}$. $\phi$ and $\sigma_{LS}$ are shown in Table 1.

From Eq. (28), Sb and then K at time t+$\Delta$t can be calculated from $C_n^{L}$, $g_S$ and the solidification rate $\partial g_S/\partial t$ at tme t.

Furthermore, it is known from Stereology that the relationship between Sb and dendrite cell diameter d is given by the following equation.

$$Sb = \frac{6\phi g_S}{d} \tag{29}$$

Where, $\phi$ is the configuration factor that is $\phi=1$ for sphere and $\phi=2/3$ for cylinder (The Application of Powder Theory, Maruzen Co., Ltd. (1961), p. 87, p. 132). Since the neighboring dendrite cells collide with each other when $g_S$ becomes about 0.7, the value of d at $g_S=0.7$ is calculated from Eq. (29) and is regarded as the size of dendrite cell at the time of the completion of solidification ,i.e., dendrite arm spacing.

Method 2: Determination of the Permeability by an Empirical Method

Substituting Eq. (29) into Eq. (27) and taking f=5, Eq. (30) is obtained.

$$K = \frac{(1-g_S)^3 d^2}{180\phi^2 g_S^2} \tag{30}$$

When the dendrite is chunky, $\phi$ may be set $\phi=1$ (Ref. (19)). The dendrite arm spacing, DAS, is determined by local solidification time $t_f$ as the following empirical relation (from p.146 of Ref. (14)).

$$das=A(t_f)^n \tag{31}$$

Where, A and n are materials constants and the diameter of dendrite cell d can be evaluated from Eq. (31) by substituting the elapsed time from the beginning of solidification instead of $t_f$.

Although Eq. (30) is a simplistic equation, it can not describe the accelerated solidification phenomena at the central portion. Also, it lacks rigidity when treating segregation.

(5) The Momentum Equation

The flow of the liquid in a complete liquid region is described by the Second Law of Newton, i.e., (mass)×(acceleration)=(force acting on body). In other words, this is equivalent to the conservation law of momentum that says "the time change of the momentum (=mass×velocity) is equal to the force acting on the body" as shown in Eq. (32).

$$\frac{d}{dt}(\rho v) = \sum_i F_i \tag{32}$$

The right side of Eq. (32) is the sum of pressure, viscosity force, body force, etc. Thereupon, the momentum equation regarding the liquid flow during the solidification process can be expressed by Eq. (33). The meanings of symbols are given in Table 1.

$$\frac{\partial}{\partial t}(\rho_L g_L v_i^L) + \nabla\cdot(\rho_L g_L v_L v_i^L) = \nabla\cdot(\mu\nabla v_i^L) - \nabla P + \sum X_i - \frac{\mu g_L}{K}v_i^L (i=1,2,3) \tag{33}$$

Eq. (33) is solved so as to satisfy the continuity equation of Eq. (9). The suffix i denotes each component in a given coordinates system (for example, $v_1=v_x$, $v_2=v_y$, $v_3=v_z$ in (x, y, z) orthogonal coordinates system). The left side of Eq. (33) is the inertia term into which the volume fraction of liquid $g_L$ was introduced for the convenience when combining with Eq. (9) (the continuity equation). The first on the right is the viscosity force term, the second is the pressure term, the third is the sum of various body forces and the fourth is the resistant force term due to Darcy flow.

Eq. (33) enables it possible to treat the whole region as one without distinguishing the liquid, the solid-liquid coexistence and the solid regions. That is, that the equation becomes a usual momentum equation by setting $g_L=1$ and K=a large number, that it becomes Darcy resistance-controlled in the solid-liquid coexisting zone (inertia and viscosity forces become negligibly small) and that the liquid velocity $v_i^L$ becomes practically zero by setting $\mu$=a large number) (Ref. (20)).

(6) The Treatment of Pearlitic Transformation

In the case that the surface of solidifying shell is strongly cooled, the pearlitic transformation may take place because of the temperature drop at the surface layer. The volume fraction of pearlite $g_p$ is given by Eq. (34) from the nucleation and growth theories in the continuous cooling process.

$$g_P = 1 - \exp(-V_{ex});\ V_{ex} = \int_0^t f(T)(t-\tau)^3\, d\tau \tag{34}$$

Where, Vex is the extended volume of pearlite particle, t is the time and T is the temperature. The function of temperature f (T) is obtained from the TTT diagram for a given steel (Ref. (21)). The latent heat of the pearlitic transformation is given by $\rho L_P \partial g_P/\partial t$ ($L_P$: latent heat of the transformation) and is incorporated into the source term of Eq. (2).

A-2. Discretization of the Equations

The above equations for describing the solidification phenomena have been formulated by using the symbols of the gradients ($\nabla(\ )$ or grad ( )), the divergences ($\nabla\cdot(\ )$ or div ( )), etc. of scalars and vectors in order to make the operation of equations easier, to express in concise form and to be available to all coordinates systems. Next, in order to carry out the computation by computer, it is necessary to express these equations according to each coordinates system such as orthogonal and cylindrical systems and then implement volume integrals with regard to the volume element such as shown in FIG. (7) to write them down into concrete forms. This process is called discretization.

Discretization was done on the basis of the method by Patankar (Ref. (20)) in this invention. Below its outline is stated.

In general, when a scalar or a vector of a physical quantity is represented by $\phi$, the conservation law regarding $\phi$ is expressed by Eq. (35).

$$\frac{\partial(\rho\phi)}{\partial t} + \nabla\cdot(\rho v\phi) = \nabla\cdot(\Gamma\nabla\phi) + S \tag{35}$$

Where, $\rho$ is density, V is velocity, $\Gamma$ is diffusion coefficient regarding $\phi$, S is source term regarding $\phi$. The velocity field must satisfy the condition of continuity which is given by the following Eq. (36).

$$\frac{\partial\rho}{\partial t} + \nabla\cdot(\rho v) = 0 \tag{36}$$

Figure 8:
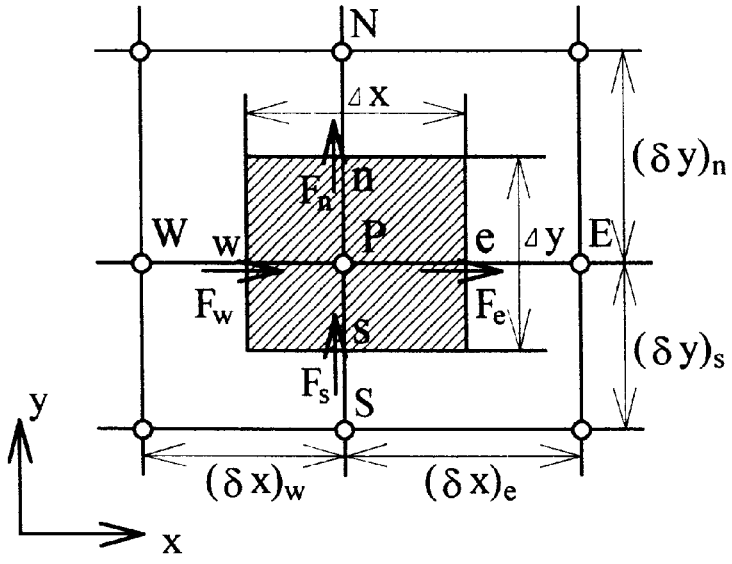
FIG. 8 is the diagram for explaining discretization (quoted from p. 97 of Ref. (20)). Shaded area shows the control volume element and the points denoted by the circles are called grid points. Fe, Fw, Fn, Fs at the control volume faces e, w, n, s show the incoming and outgoing of a physical quantity $\phi$.

Eqs. (35) and (36) are expressed by defferential form. Therefore, taking the case of 3 D orthogonal coordinates as the example, carrying out the volume intergral $\iiiint dtdxdydz$ (t is time) in the volume element as swon in FIG. 8 and tidying up with respect to $\phi$, a siries of Eqs. (37) to (46) are obtained (refer to p. 101 of Ref. (20)). In FIG. 8, the shaded area denotes the control volume element and the points denoted by the circles are called grid points. Fe, Fw, Fn, Fs, Ft, Fb at the control volume faces e, w, n, s, t, b (t and b denote the faces parallel to the paper) denote the incoming and outgoing of a physical quantity $\phi$.

$$a_P\phi_P = \Sigma a_{nb}\phi_{nb} + b \tag{37}$$

Where, the suffix P denotes the defined position of the physical quantity $\phi$ (not necessarily be geometrical center) within the volume element. The suffixes nb denote 6 neighboring definition points (E,W,N,S,T,B). These are called grid points. In addition, $a_{nb}(a_E, a_W, a_N, a_S, a_T, a_B)$ are the coefficients given by Eq. (38).

$$a_{nb} = D_{nb}A(|P_{nb}|) + \langle \pm F_{nb}, 0\rangle \tag{38}$$

Further, $a_P$ on the left of Eq. (37) is given by Eq. (39).

$$a_P = \sum a_{nb} + a_P^{old} - S_P\Delta V \tag{39}$$

$$a_P^{old} = \rho_P^{old}\Delta\frac{V}{\Delta t} \tag{40}$$

The source term b on the right of Eq. (37) is given by Eq. (41).

$$b = S_c\Delta V + a_P^{old}\phi_P^{old} \tag{41}$$

Where, the upper suffix 'old' means the value at time t in the computational step from time t to time t+$\Delta$t. $\Delta$V is the volume of the volume element. $D_{nb}$ is the diffusion term regarding the physical quantity $\phi$ in each face (e, w, n, s, t, b) of the volume element and is given by the following Eq. (42).

$$D_{nb} = \frac{\Gamma_{nb}A_{nb}}{\delta_{nb}} \tag{42}$$

$\Gamma_{nb}$ and $A_{nb}$ are the diffusion coefficients and the areas of the faces defined at these control volume faces, respectively. $\delta_{nb}$ correspond to the distances $(\delta x)_e$, $(\delta x)_w$, . . . between the grid points as shown in FIG. 8. $F_{nb}$ are the flow terms representing the incoming and outgoing quantities of $\phi$ passing through the faces (e, w, n, s, t, b) and is given by the following Eq. (43).

$$F_{nb} = (\rho v)_{nb}A_{nb} \tag{43}$$

The signs of Eq. (38) are defined plus (+) when flowing into the volume element and minus (−) when flowing out. Also, the symbol '< >' of the second term on the right side of Eq. (38) means to take the larger of $\pm F_{nb}$ or 0. For example, consider the case that $\phi$ is taken as temperature. F w becomes effective because of flowing in at the face w, thus $T_P$ is influenced by the upstream side of temperature Tw. On the other hand, $-F_e$ becomes ineffective because of flowing out at the face e, thus $T_P$ is uninfluenced by the downstream side of temperature $T_E$. Thus, this operation can take into account the physical rationality (note that the effect of the fluid flow is included in the function A(|P|) as well as mentioned below). $P_{nb}$ is the Peclet number that describes the degree of the relative effects by the flow and diffusion, and is defined by the next Eq. (44).

$$P_{nb} = \frac{F_{nb}}{D_{nb}} \tag{44}$$

The function A(|P|) is given by Eq. (45).

$$A(|P|) = \langle 0, (1-0.1|P|)^5\rangle \tag{45}$$

Considering that the source term S becomes a function of $\phi$ in general, it is linearized as the following Eq. (46), $$S = S_c + S_p\phi_P \tag{46}$$

in which $S_c$ and $S_p$ are the constants determined by the meaning of the equation.

The results of discretization of the various equations described in the above section A-1 are presented at the end of this description. Regarding the coordinates system, the orthogonal curvilinear coordinates system was used so as to fit the profile of the cast piece that is elongated and curved to casting direction as shown in FIG. 9. Each discretization equation has been written down according to this coordinates system. Since the cylindrical and Cartesian coordinates (3D orthogonal) systems are included as simple cases of the orthogonal curvilinear coordinates, the discretization equation can be applied to these systems as well with minimum amount of corrections, for instance by eliminating unnecessary terms from the equation. Accordin to the above manipulation, each discretization equation becomes applicable to various cast piece profiles and cross-sections.

A-3. Analysis of the Defects (1) The Macrosegregation

The average solute concentration of the solid-liquid coexisting zone is defined by Eq. (47) for an equilibrium solidification type alloy (j type), as shown in FIG. 3(*b*). (Note that $g_L+g_S+g_V=$)

$$\overline{C_j} = \frac{1}{\bar{\rho}}(C_j^L \rho_L g_L + C_j^S \rho_S g_S) \tag{47}$$

Also it is defined by Eq. (48) for a non-equilibrium solidification type alloy (i type) from FIG. 3(*c*).

$$\overline{C_i} = \frac{1}{\bar{\rho}}\left(C_i^L \rho_L g_L + \rho_s g_s \int_0^{g_S} C_i^{s*}\, d g_s\right) \tag{48}$$

When $\overline{C}_n > C_n^0$, segregation is defined positive; and when $\overline{C}_n < C_n^0$, negative.

(2) The Influence of Dissolved Gas in Melt Steel

It is well known that the dissolved gas in the melt steel concentrates in interdendritic liquid phase as solidification proceeds and causes gas-caused microporosity. Here in this description, the method of analysis is described according to the paper of Kubo et al (Ref. (19)).

Since the main cause of gas porosity in cast steels is CO gas, it is asssumed that CO is the only gas source. Then, CO gas forms by the next reaction.

$$C_L + O_L = CO\ (gas) \tag{49}$$

The equilibrium CO gas pressure $P_{CO}$ is given by Eq. (50).

$$P_{CO} = C_L \cdot O_L / K_{CO} \tag{50}$$

Where, $C_L$ is the carbon concentration in the liquid phase, $O_L$ is that of oxygen and $K_{CO}$ is the equilibrium constant.

Provided that oxygen also reacts with Si that is usually added as a deoxidizer to form $SiO_2$ (solid) (the effect of Mn is neglected), the mass conservation laws regarding C and O are given by the following Eqs. (51) and (52).

$$C_L g_L + C_S g_S + \alpha_C \cdot P_{CO} g_V / T = C_0 \tag{51}$$

$$O_L g_L + O_S g_S + \alpha_O \cdot P_{CO} g_V / T + (1-\gamma)\Delta SiO_2 = O_0 \tag{52}$$

Where, $g_V$ is the volume fraction of gas porosity.

The carbon and oxygen concentrations in the solid phase are given by the following equations using the equilibrium partition ratios.

$$C_S = k_{Fe-C} C_L \tag{53}$$

$$O_S = k_{Fe-O} O_L \tag{54}$$

Similarly, Eqs. (55) to (58) hold with respect to the reaction of Si and O.

$$Si_L + 2O_L = SiO_2\ (solid) \tag{55}$$

$$K_{SiO_2} = Si_L \cdot O_L^2 \tag{56}$$

$$Si_L g_L + Si_S g_S + \gamma \Delta SiO_2 = Si_0 \tag{57}$$

$$Si_S = k_{Fe-Si} Si_L \tag{58}$$

$P_{CO}$ and $g_V$ during solidification can be obtained by solving the above simultaneous equations (Eqs. (50) and (52) to (58)). Also, it is clear that the information about the formation of the non-metallic inclusion $SiO_2$ can be obtained as a result of computation, although it is not mentioned in this description. The meanings of symbols and the physical properties of the materials used in this description are listed in Table 3 at the end of this description.

(3) The Effective Radius and Growth Law of Porosity

As shown in FIG. 6, the porosity is considered to form at the neck of dendrite where the local free energy becomes minimum (Ref. (19)). Then, defining the effective radius r of the porosity, r is modeled as follows.

Now, it is assumed that one liquid space exists between a pair of dendrite arms and that these small spaces are three-dimensionally distributed as shown in FIG. 6(*b*). Then, taking D as 3D mean value of the distances between the dendrite arms and n as the number of the liquid spaces, the volume fraction of liquid $g_L$ is approximated by Eq. (59).

$$g_L = \frac{\frac{4}{3}\pi r^3 n^3}{(nD)^3} = \frac{4\pi r^3}{3D^3} \tag{59}$$

Also from FIG. 6(*c*), the relationship between r, D and dendrite cell size d is shown by Eq. (60).

$$2r + d = \sqrt{2} D \tag{60}$$

Then, from Eqs. (59) and (60), Eq. (61) of the radius r is obtained.

$$r = \alpha_d \cdot \frac{0.43865(1-g_s)^{\frac{1}{3}} d}{1 - 0.8773(1-g_s)^{\frac{1}{3}}} \tag{61}$$

However, considering the difficulty to accurately evaluate r for the real complicated dendrite morphology, a correction factorn $\alpha_d$ was introduced and set to be 0.7 by experience. From the above equation, it can be seen that as $g_S$ increases, r decreases and that as the cooling rate increases, r decreases.

In the case that the dissolved gas is not taken into account, the equilibrium gas pressure becomes 0. Even in this case, the shrinkage-caused porosity form when the liquid pressure becomes less than the critical pressure. In this case, the equation regarding the growth of once formed internal porosity is given from the continuity equation of Eq. (9) as follows (the influence of the deformation of solid is ignored).

$$dg_V = \frac{\rho_S - \rho_L}{\rho_S} dg_S + \frac{dt}{\rho_L} \nabla \cdot (\rho_L g_L v_L) \tag{62}$$

The first term on the right is the contribution due to solidification contraction, and the second term is the contribution due to the divergence of liquid phase. When d $g_V > 0$, the porosity grows; when d $g_V < 0$, the porosity reduces (or disappears).

A-4. Method of the Numerical Analysis

All the discretization equations and various sub-equations necessary for the computation have been obtained as above-mentioned. There are seven equations in total that comprise the basis of the solution method: Namely, the energy equation, the solute redistribution equation (although there are as many numbers of equations as alloy elements, they are counted as one for brevity), the temperature-volume fraction of solid equation, 3 components of the flow velocity equations regarding Darcy or momentum equation, and the pressure equation. Correspondingly, there are seven major variables: Namely, the temperature T, the volume fraction of solid $g_S$, the solute concentration of liquid $C_n^L$, 3 conponents of the flow velocity vector and the liquid pressure. Therefore, the solution can be obtained by solving these discretization equations under the initial and boundary conditions. Since these variables have interaction with each other (it is called coupling), it is necessary to obtain the converged solution by an iterative computational method.

Furthermore, the microscopic phenomena characterized by the permeability K determined by dendrite morphology, the liquid density$\rho_L$ as a function of solute concentrations and temperature and the formation of interdendritic microporosity ($g_v$) get deeply involved in the solidification phenomena of the heat and fluid flow in macroscopic scale. With regard to the solid velocity, theoretical or measured values are used.

The numerical method developed by these inventors is described below according to the flowcharts (FIG. 10(*a*) and FIG. 10(*b*)).

①. Set initial and boundary conditions, etc. (Step S1 of FIG. 10(*a*)). The iterative convergency steps from time t to time t+Δt are as follows.

②. Calculate pressure and velocity fields of the liquid phase for a given field pattern of liquid, solid and mushy zones and given field patterns of permeability and liquid density (Step S2 of FIG. 10 (a)). Here, either the Darcy equation or the momentum equation (including Darcy flow resistance) may be selected. In the case of the former method, solve the pressure equation to obtain the pressure field and calculate the velocity field by using thus obtained pressure field. In the case of the latter, the velocity and pressure fields are calculated by an extended SIMPLER method described later on.

③. Judge the criterion of the formation of microporosity from the pressure field (step S3 of FIG. 10(*a*)). If pores form, calculate the volume fraction of the porosity and their sizes (step S4 of FIG. 10(*a*)).

④. Based on the calculated liquid flow field, the volume fraction of porosity and the heat extraction rate from the surface of the cast piece, solve by coupling the energy equation, the solute redistribution equation and temperature-volume fraction of solid equation to obtain temperature, volume fraction of solid and solute concentration of liquid (step S5 of FIG. 10(*a*)).

⑤. Based on the calculated fields of the temperature, the volume fraction of solid and the solute concentration of liquid, calculate specific surface area Sb and the size of dendrite cell d and subsequently the permeability K using the dendrite solidification model (step S6 of FIG. 10(*a*)).

⑥. Calculate the liquid density based on the temperature and the solute concentration of liquid (step S7 of FIG. 10(*a*)).

⑦. Check if the liquid pressure field is converged (step S8 of FIG. 10(*a*)). If converged, calculate the macrosegregation from Eqs. (47) and (48) (step S9 of FIG. 10(*a*)): if not, go back to ② and repeat the computations. That is that since the permeabilities calculated in ⑤ and the liquid densities calculated in ⑥ affect the flow velocity field of liquid phase, the computations are repeated using these values.

Next, the method of calculating the pressure and the flow velocity distributions using the momentum equation in above ② is described in detail.

①. Set the velocities at time t as the initial values (step S1 of FIG. 10(*b*)).

②. Calculate the coefficients $a_P$, $a_N$, $a_S$, $a_T$, $a_B$, $a_W$, $a_E$, b of the velocity discretization equations and $v_1$, $v_2$, $v_3$ (step S2 of FIG. 10(*b*)).

③. Calculate the coefficients of the pressure discretization equation (Eq. (E. 86)) (step S3 of FIG. 10(*b*)).

④. Introduce the boundary conditions for pressure (step S4 of FIG. 10(*b*)).

⑤. Calculate the liquid pressure field from the pressure discretization equation (step S5 of FIG. 10 *b*))

⑥. Calculate the velocity field from the velocity discretization equation based on the calculated pressure field (step S6 of FIG. 10(*b*)).

⑦. Check if the velocity field satisfies the condition of continuity (step S7 of FIG. 10(*b*)): If not satisfied, obtain the corrected values of pressure by solving the pressure correction equation (Eq. (E. 118)) and then correct the velocity field from Eqs. (E. 112) to (E. 117) (step S8 of FIG. 10(*b*)). And return to ②.

As above mentioned, the solution method of calculating pressure and velocity fields using the momentum equation was newly developed by these inventors in which various modifications/expansions were incorporated on the basis of SIMPLER method, one of the numerical methods in the field of heat and fluid flow analyses. Therefore, this method is named the Extended SIMPLER method in the sense that the method was extended to embody the solid-liquid coexisting zone.

Furthermore, TDMA method (Tridiagonal-matrix algorithm, p.52 of Ref. (20)) suitable for iterative convergency calculation was used to solve the various discretization equations presented in this description.

Finally, the features of the computer program of the numerical method of this invention are described below.

(1) The above-mentioned numerical method is applicable to the continuous castings with various cross-sections and machine profiles (vertical, vertical-bending and bending casters, etc.). Also, various analytical functions are available from a simple case of calculating only temperature and volume fraction of solid to the highest level of incorporating the effects of the deformation of cast piece, electromagnetic body force (Lorentz force), etc. in addition to all aforementioned equations. Accordingly, an appropriate calculation level may be selected depending on the purposes; thus the highest level is not always necessary.

The levels of the numerical analysis defined in this description are as follows.

Level 1: The Governing Equations are the Energy eq. and the Darcy eq.

The function is porosity analysis.

Experimentally or theoretically determined relationship between temperature and the volume fraction of solid is used.

Level 2: The Governing Equations are the Energy eq., the Temperature-Volume fraction of solid eq., the solute redistribution eq. and the Darcy eq.

The function is macrosegregation analysis. No calculation of porosity.

The multi-alloy model is used.

Level 3: The Porosity Analysis is Added to Level 2.

Level 4: The Governing Equations are the Energy eq., the Temperature-Volume fraction of solid eq., the solute redistribution eq., and the momentum eq.

The function is macrosegregation analysis. No porosity analysis.

The multi-alloy model is used. The Darcy flow resistance is included in the momentum equation.

Level 5: The Porosity Analysis is Added to Level 4.

Furthermore, this program is installed with the functions to handle the deformation of cast piece and the electromagnetic force. Also, the influences of the heat of Joule and the latent heat of pearlitic transformation are taken into account in the energy equation. The output includes the metallurgical informations in microscopic scale such as macrosegregation, microporosity, etc. in addition to temperature, volume fraction of solid, liquid pressure and velocity in macroscopic scale.

(2) The above-mentioned numerical method adopts a non-steady solution method which makes it possible to analyze through the whole process from the time of pouring into dummy bar box to the steady state and further to the final stage of solidification after the stoppage of pouring. It is also possible to analyze the effects of the changes in the casting speed and cooling condition, etc. throughout the process. Whether or not the steady state is reached is judged by observing the temperature changes.

In conventional methods handling this kind of problem, it is common to use a steady method by the use of spatial coordinates system where the equations are written using a coordinates system fixed in space and the steady state solution is obtained by iterative computation (thus, the computational domain is fixed in space). However, there are the shortcomings in them that the important part of non-steady state can not be analyzed. On the contrary, the above-mentioned non-steady method possesses the advantages that enables it possible to accurately respond to the changes in various external factors (thermal, mechanical, etc.).

(3) With respect to a vertical-bending type, etc., the cast piece undergoes bending deformation. Accordingly, the topologies (the distance, area, volume etc.) of the object for analysis changes as shown in FIG. 9(*b*), and also, the components of gravitational force changes as shown in FIG. 9(*a*). To correspond to these changes, they are updated as time proceeds.

(4) The boundary condition at the surface of cast piece is given either by the heat transfer coefficient h at the surface (thereafter called h-method) or by the surface temperature Tb itself (thereafter called Tb-method). With h-method, Tb response is obtained; with Tb-method, h response is obtained. For example, when a particular surface temperature distribution is desirable, obtain h by using Tb-method, and determine the corresponding cooling condition from the relationship between h and the cooling condition (such as the quantity of water-spray).

(5) In the mushy region where the liquid pressure drop occurs, the flow direction of the liquid phase can be regarded mainly as one-dimensional flow towards the casting direction. Therefore, solving Darcy Eq. (26) with respect to the body force $X_Z$ in Z direction (casting dir.), Eq. (63) results.

$$X_z = -\left(\frac{\partial P}{\partial z} + \frac{\mu g_L}{K} V_z\right) \tag{63}$$

Accordingly, after the pressure and velocity field is obtained (with no porosity formation), define the P distribution optionally to prevent the formation of porosity (for example, by taking the pressure gradient from the position of P=0 to the crate end as $\partial P/\partial Z=0$), and calculate $X_Z$ (the sum of the gravitational force in Z dir. and the Lorentz force) from Eq. (63). Thus, it is possible to obtain the required electro-magnetic body force distribution (Lorentz force).

(6) Considerable amount of input data are given by external functions. For example, the operating conditions (casting temperature, casting speed, surface cooling condition, etc.) are given by the functions of time, position, etc.

(7) The merit of the nonlinear multi-alloy model developed in this invention is to able to expand the applicability of the above-mentioned numerical method by fitting to the non-linearity in the phase diagrams. Thus, the method can be applied to many important commercial alloys regardless of ferrous, nonferrous, stainless steel, etc. For example, as for the carbon steels of C=0.1 to 0.51% with peritectic reaction, the relationship between temperature and the volume fraction of solid can be obtained by neglecting the peritectic reaction and smoothly approximating the δ and γ solidus lines. It is of course possible to apply to the carbon steels less than 0.1% C.

Figure 10B:
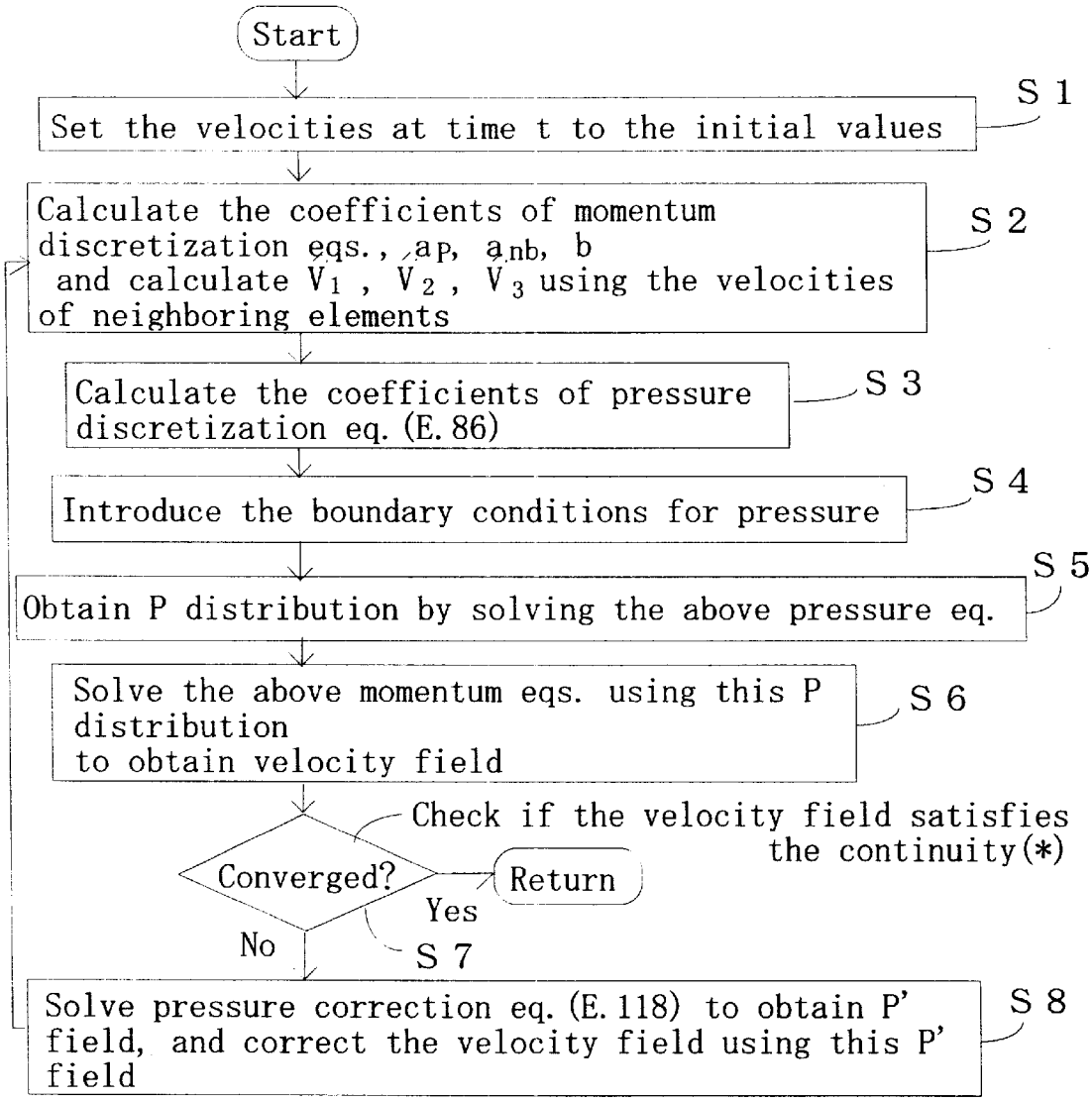
FIG. 10(*a*) is the outline of the main program that shows the flow of the calculation in the numerical analysis.

The items of the above (1) to (6) are not included in FIG. 10 because it becomes very complicated. Furthermore, in this computer program, the solid phase in the solid-liquid coexisting zone is assumed not to flow (yet the deformations accompanying the bending/unbending and the soft-reduction are acceptable). Regarding this assumption, even if the solid crystals are assumed to move in the region with quite a low fraction of solid (to say about 0.3 or less), the resulting effects can be neglected. This is shown by the examples for carrying out the invention (mentioned later) where the liquid pressure drop due to the interdendritic liquid flow is very small indeed. Thus, the above assumption is adequate.

A-5. Computational Example of the Numerical Analysis

Figure 11:
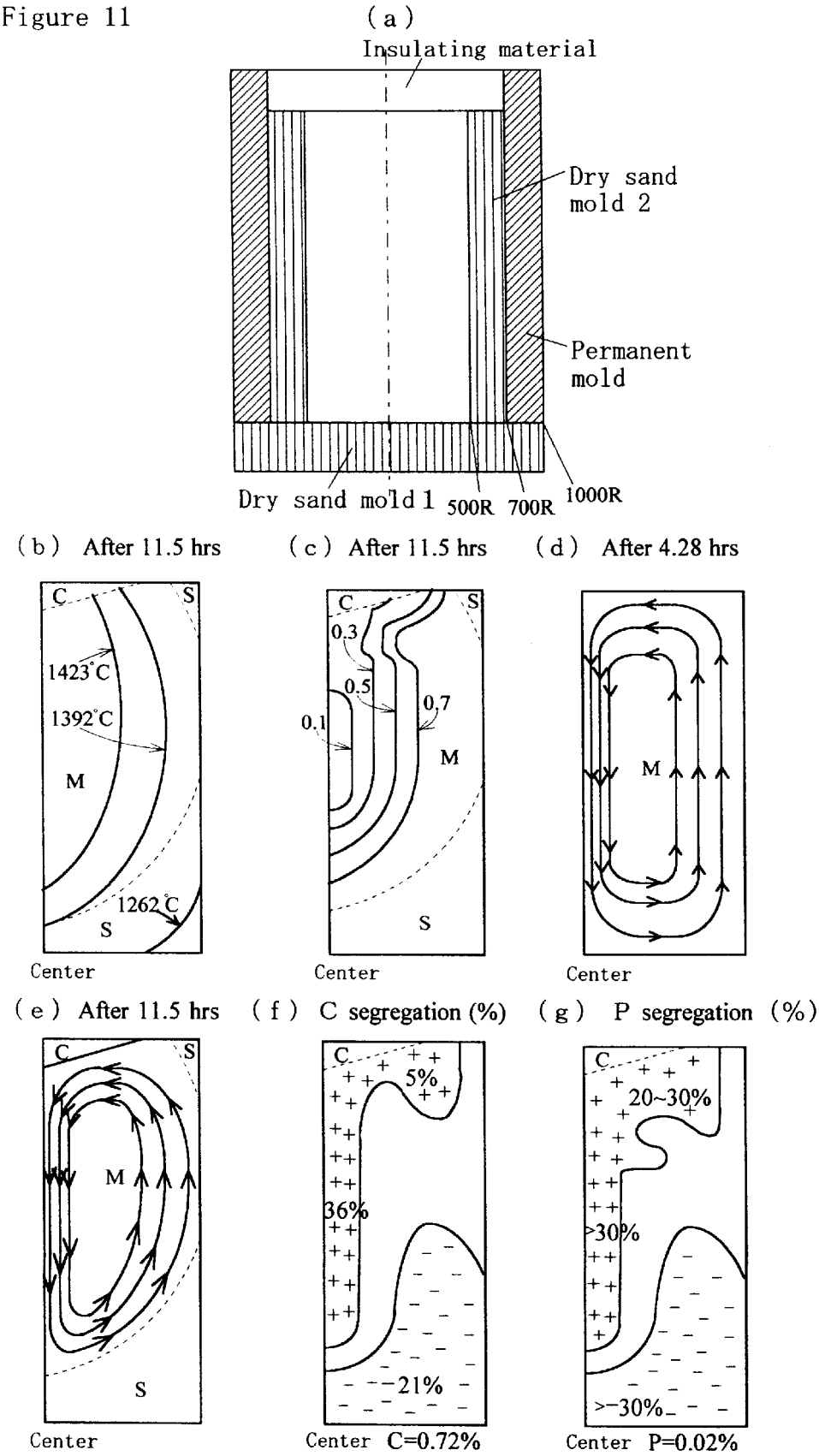
FIG. 11 shows the numerical results of a large steel ingot (1 m diam.×3 m height) chosen as an example to show the validity of the numerical analysis. is the casting design. (b) shows an example of the contours of temperature during solidification (after 11.5 hours). Symbol S denotes solid, symbol M solid-liquid coexisting zone (mushy zone), symbol C shrinkage cavity and the broken lines show the boundaries of these phases. (c) is the contour of the volume fraction of solid at the same time as (b). Numbers in the diagram denote the volume fraction of solid (0 to 1). (d) shows the liquid flow pattern after 4.28 hours when the whole region became mushy. The portion with high density of streamlines means where the flow velocity is high. It is about 3.5 mm/s at the center where the velocity is high. (e) shows the interdendritic liquid flow pattern after 11.5 hours. The velocity is about 0.1 mm/s at the center. (f) and (g) show the distributions of the macrosegregation after solidified. The segregation is expressed by $(\overline{C}-C_0/C_0)\times 100\%$ ($\overline{C}$=calculated concentration, $C_0$=alloy content). (f) is the case of carbon: the positive segregation is more than 30% at the central portion and about 5% at the upper O.D. where the A segregation usually takes place. The negative segregation is biggest in the lower part near the center (−21%) and becomes lesser near middle O.D.(−10%) (g) is the case of phosphorus which shows the same trend as carbon, although both positive and negative segregation emerge more prominently.

As an computational example, the steel of 0.72% C-0.57% Si-0.70% Mn-0.02% P-0.01% S-remainder Fe (wt %) was chosen which has a marked tendency that the liquid density decreases as the solute concentrations of the interdendritic liquid increases during solidification. The numerical analysis was done for the solidification process of the steel cast into the mold of 1 m diameter×3 m height as shown in FIG. 11(*a*). The initial temperature was set at 1475° C. (superheat 13° C.). The physical properties used are those of the 0.55 wt % carbon steel given in Table 2 and Table 3 at the end of this description.

The computation was started from the time that the mold was filled with the melt. During about 10 minutes until the substantial solidification from the mold wall begins, the liquid basically flows descent at the mold wall side and ascent at the central region and is turbulent flow. In other words, ① The flow velocity is about 10 cm/s at the rapid flow region, ② The temperature inversion layer appears where the temperature at the central part becomes lower than that at the side. Thus, the flow pattern is that of turbulent, the temperature distribution becomes quickly uniform (the temperature difference is less than 2° C.) and most of the superheat is lost. After that, such situation continues until about 2 hours when the liquid phase disappears and all area becomes a solid-liquid coexisting zone. In the meantime, the flow velocity gradually becomes small.

Solidification begins from the bottom, spreads to the side and finally ends at somewhat upper position from the central part of the ingot (solidification time is 20.9 hrs).

It is seen that the isolines of temperature and volume fraction of solid after 11.5 hours are largely curved as shown in FIG. 11(*b*) and (*c*). This can not be expressed by mere temperature calculation, thus reflecting the effect of liquid flow in the solid-liquid coexisting zone which follows next. In these diagrams, the symbol C denotes shrinkage cavity, M solid-liquid coexisting zone (mushy zone) and S solid zone.

As shown in FIG. 11(*d*) and (*e*), the interdendritic liquid flow is such that the flow pattern becomes descend at the central portion and ascend at the side portion. Although the temperature at central portion is higher than that at the outside (accordingly light), and the interdendritic solute concentrations of liquid are lower at the central portion than at the outside portion (accordingly heavy), the balanced liquid density at the central portion becomes heavier than that at outside; therefore resulting in the above-mentioned flow pattern. This flow pattern continues to the latter half of the solidification. As pointed out from the solidification theory by Flemings et al (p.244 to 252 of Ref. (14)), the positive segregation takes place by the flow from lower temperature portion (higher solute concentrations) to higher temperature portion (lower solute concentrations): The negative segregation takes place by the reversed flow (from higher to lower temperature). Shown in FIG. 11(*f*) and (*g*) are the segregation distributions for C and P, respectively. The other elements (Si, Mn, S) shows the same trend; thus reflect well the macrosegregation found in large steel ingots.

Since the number of elements used is relatively small (7 in radius dir.×30 in height dir. evenly partitioned), it is not possible to express the locally concentrated V segregation themselves at the center or A segregation themselves at the upper part of the ingot (refer for example p.244 of Ref. (14)). However, the formation processes of the segregation are well grasped, thus showing the validity of this simulation.

The above calculation is the results of the strictest analysis that uses a prescribed dendrite solidification model and applies the momentum equation to the whole ingot without distinguishing the liquid and mushy zones (analysis level 4 but no porosity analysis done). The computational error was evaluated by the difference between the heat extraction from the ingot Qout and the heat loss of ingot Qlost by, $|(Qout-Qlost)/Qout\times 100|(\%)$. In the case of only temperature calculation, the total amount of errors till the end of solidification was less than 0.1%.

B. The Mechanism of the Formation of the Internal Defects

Many literatures are published about the internal defects of cast steels.

Figure 43:
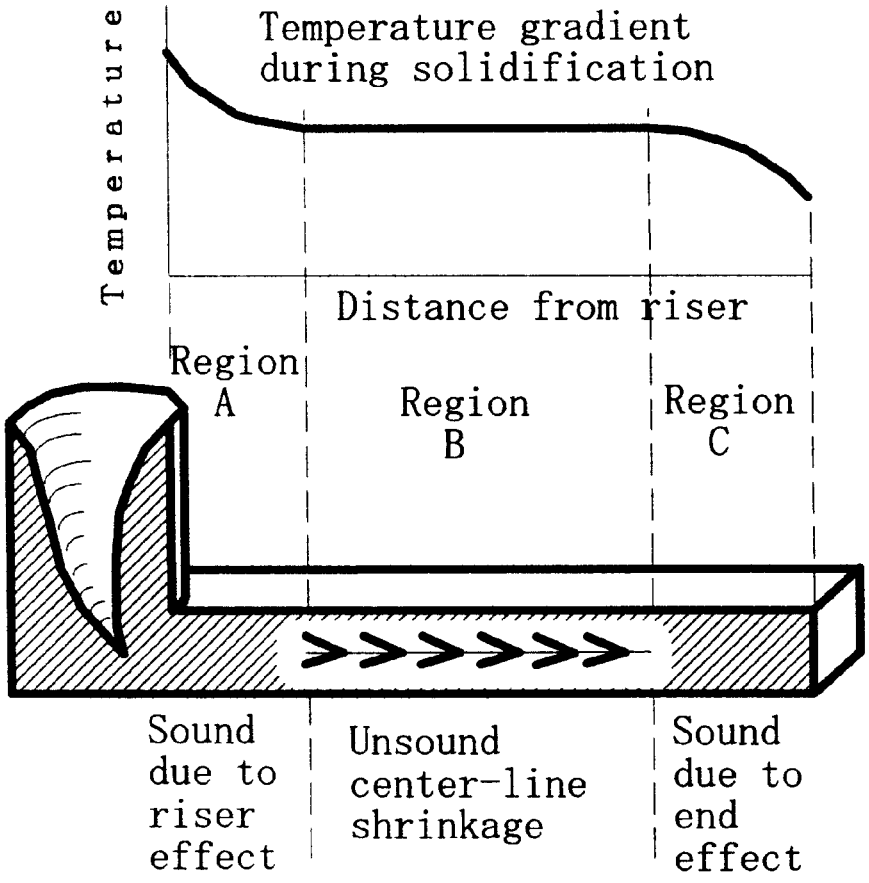
FIG. 43 shows the formation of centerline shrinkage in cast steel (from Ref. (14), p. 242).

FIG. 43 schematically shows the central defects (internal defects) that takes place in an elongated cast steel bar. The regions A and C in the diagram are sound due to the feeding effects of interdendritic liquid. The region B is unsound because of the difficulty of the liquid feeding and results in the formation of the interdendritic microporosity along the centerline. It is known that this microporosity usually exhibits the form of V characters pointing the feeding direction as shown in FIG. 43 and, in many cases, accompany V form of macrosegregation (so-called V segregation) (for example Ref. (34)).

There are few papers that clearly distinguished V form of microporosity and segregation in the past literatures. For example, Pellini (Ref. (35)) has called them centerline shrinkage without distinguishing. The central defects (internal defects) in continuous castings of steels are essentially the same as those of the above-mentioned cast steels. Therefore, summing up the V forms of porosity and segregation as one regardless of the existence or the degree of these defects, they are called the central defects in this description.

The central defects form in the case that the interdendritic liquid feeding is insufficient. Thus, it can be said that the flow of the liquid phase in solid-liquid coexisting zone (or mushy zone) plays a decisive role to the formation of the central defects. As the driving force that causes this liquid flow, the following factors are pointed out:

(1) The flow due to the solidification contraction that is induced by the density difference of the solid and liquid during solidification. In addition, the effects of the thermal contraction associated with the temperature drops of the solid and liquid phases are included.

(2) The flow due to the density difference within the liquid phase (natural convection). The liquid density $\rho_L$ depends not only on the temperature but also on the solute concentrations in the liquid phase, as shown in the following Eq. (64).

$$\rho_L=\rho_L(C_1^L, C_2^L, \ldots, C_n^L, T) \tag{64}$$

(3) Forced flow due to mechanical deformation from outside such as bulging, unbending, soft-reduction, etc. This is more comprehensible when imaging the flow of the water upon squeezing or bending the water absorbed sponge. Additionally, intensively cooling cast piece to cause the thermal contraction enters to this classification.

These inventors conducted a series of preliminary numerical analyses to investigate the above-mentioned factors (1) and (2) on the central defects. The results are summarized as follows.

①. The macrosegregation forms prominently in large steel ingot. This is because the interdendritic liquid flow occurs in the wide range for a long period. When decreasing the size of the ingot for the same alloy, the range of the mushy zone becomes narrow, but the flow pattern shows the same tendency as those in FIG. 11(*d*) and (*e*). However, since the solidification time is shortened, this flow is limited to relatively small range and the segregation does not form practically. This coincides with the experiences. Thus, when the solidification rate is increased, the natural convection caused segregation due to the density difference in liquid phase barely takes place.

Figure 12:
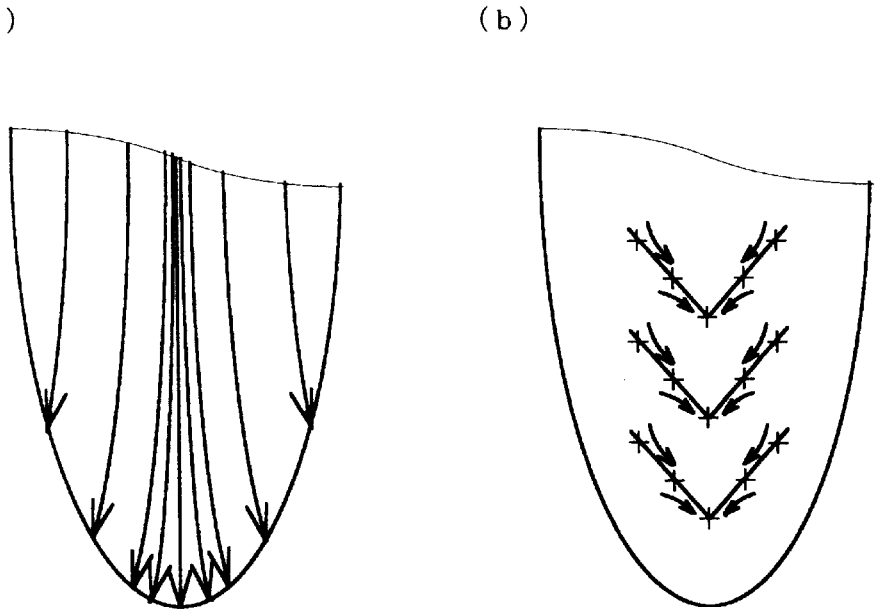
FIG. 12 shows the interdendritic liquid flow pattern induced by solidification contraction that was confirmed by the numerical analysis (a). The schematic diagram of V defects is shown in (b). Flow velocity is high at the central portion as denoted by high density of streamlines in (a). The flow to the lateral direction is extremely smaller compared to that to the casting direction. (b) shows the V defects that in dendritic scale possess locally prominent positive segregation (+) and simultaneously accompany microporosity along the V pattern. The arrows indicate the interdendritic liquid flow where the liquid of the surroundings flows in along the V defects.

②. In continuous casting, the flow pattern is not that of the natural convection type due to the difference in liquid density as seen in the examples described later on, but that of the simple solidification contraction caused flow in the casting direction. With slabs, the cooling intensity often differs in lateral direction. Even in this case, as far as "normal solidification" takes place, the degree of the difference in macrosegregation within the plate is relatively small; thus, acceptable from practical point of view. This also is attributed to the rapid solidification rate. The Darcy flow pattern in the normal solidification is, as shown in FIG. 12(*a*), slightly outward (in the figure, the outward flow is somewhat magnified to emphasize this pattern). Besides, in the vicinity of the central portion where the central defects form, the flow velocity in the casting direction is overwhelmingly larger in comparison with that in the thickness direction; thus, the flow velocity in the thickness direction is negligibly small.

The above-mentioned numerical analyses were done for the whole cast piece ranging from the meniscus to the final solidification position using Level 3 analysis. From a viewpoint of the whole Darcy flow pattern, the influence of the outlet flow from the nozzle is small.

From above, it can be said that the major internal defects taking place in continuous castings are the V pattern defects that form in the final solidification position within the cross-section and that the solidification contraction caused flow is most deeply involved as a governing factor.

Next, the mechanism of the formation of the V pattern defects is explained.

Since the main flow in the mushy zone, elongated along the casting direction, occurs in the casting direction, most of the liquid pressure drop due to the Darcy flow takes place in that direction. In particular, the pressure drop becomes largest at the central portion of the cross-section and its neighborhood. Then, if the liquid pressure P reaches to the critical condition given by Eq. (65), porosity forms (p.239 of Ref. (14)).

$$P \leq P_{gas} - \frac{2\sigma_{LG}}{r} \tag{65}$$

Where, Pgas is the equilibrium partial gas pressure within the porosity in equilibrium with the dissolved gas in the liquid, $\sigma_{LG}$ is the surface tension at the liquid-porosity interface, and r is the radius of curvature of the porosity given by Eq. (61). The porosity is arranged along the V patterns as shown in FIG. 12(*b*). In the case that the V segregation develops, it is considered that triggered by the formation of the porosity the Darcy flow in the casting direction shifts from the normal pattern of FIG. 12(*a*) to the flow pattern of as indicated in FIG. 12(*b*). In other words, the liquid flows in along the V patterned voids from the lower temperature portion (higher solute concentrations) to the higher temperature portion (lower solute concentrations) and results in the local positive segregation band where the solute concentrations are higher than the average; thus forming the V segregation. It is considered that once the porosity is formed, such liquid flow takes place in a simultaneous manner with the formation of porosity.

If the flow velocity from the lower to higher temperature is increased and reaches to the condition given by Eq. (66), the local remelting phenomenon would occur (p.249 of Ref. (14)).

$$+\frac{v_L \cdot \nabla T}{\partial T / \partial t} < 0 \tag{66}$$

When such remelting is brought about, the Darcy flow resistance of the remelted portion becomes lower than that in the surroundings and the flow is progressively increased resulting in more remelting. Consequently, the V segregation would appear more notably. The degree of the segregation depends on the extent of this channeling phenomenon (according to the second term on the left of Eq. (66)).

Figure 44:
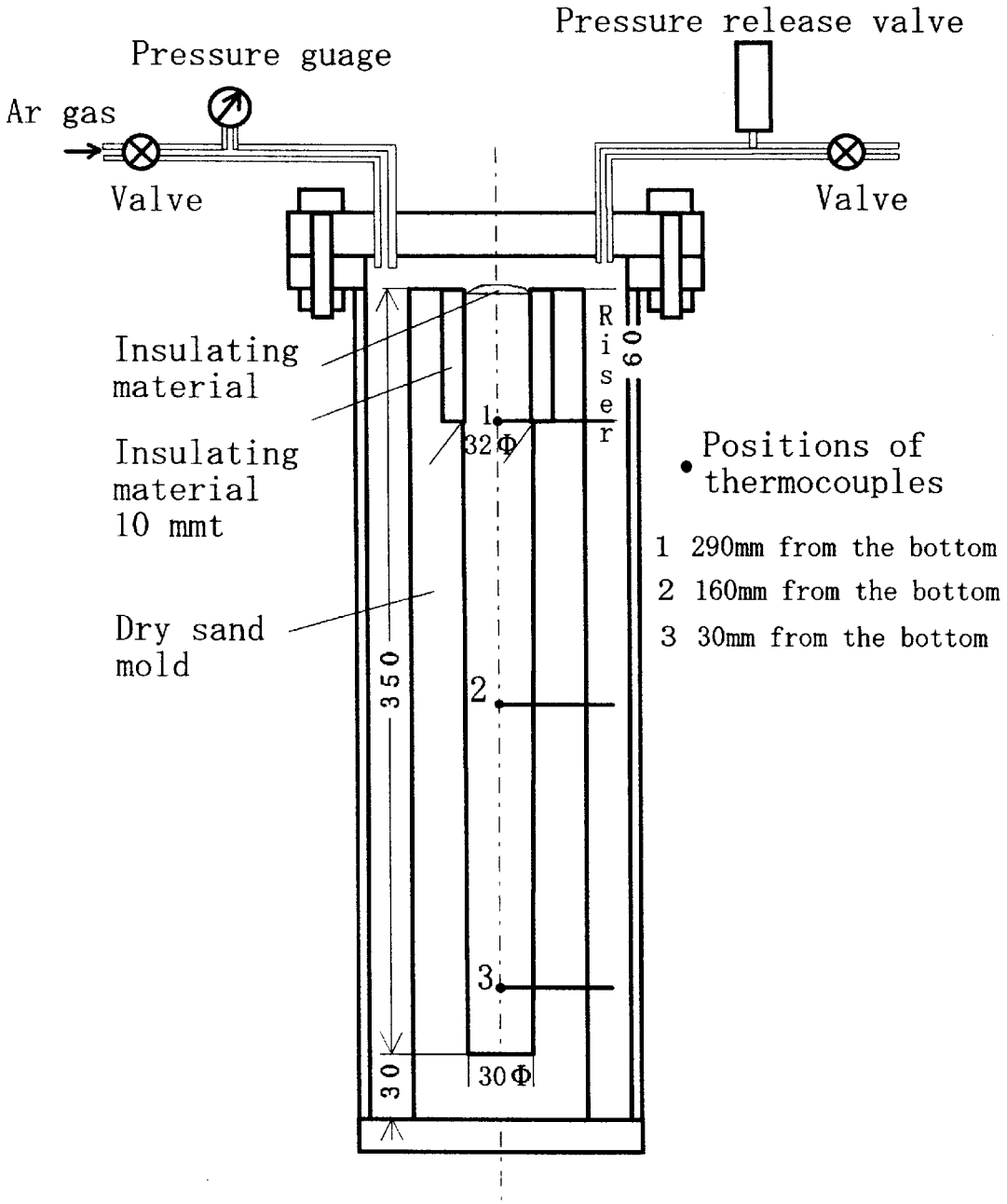
FIG. 44 is the schematic diagram of the experimental apparatus for pressurized casting.

In order to examine the above argument of the formation of the central defects, a carbon steel was melt by a high frequency induction furnace and cast into the tapered dry sand mold of 32 to 30 mm diam.×350 mm long as shown in FIG. 44. Further, as a means to enhance the interdendritic liquid feeding, the mold was placed in a pressurized cylindrical vessel as shown in FIG. 44, and pressurized by argon gas after poring.

Figure 45:
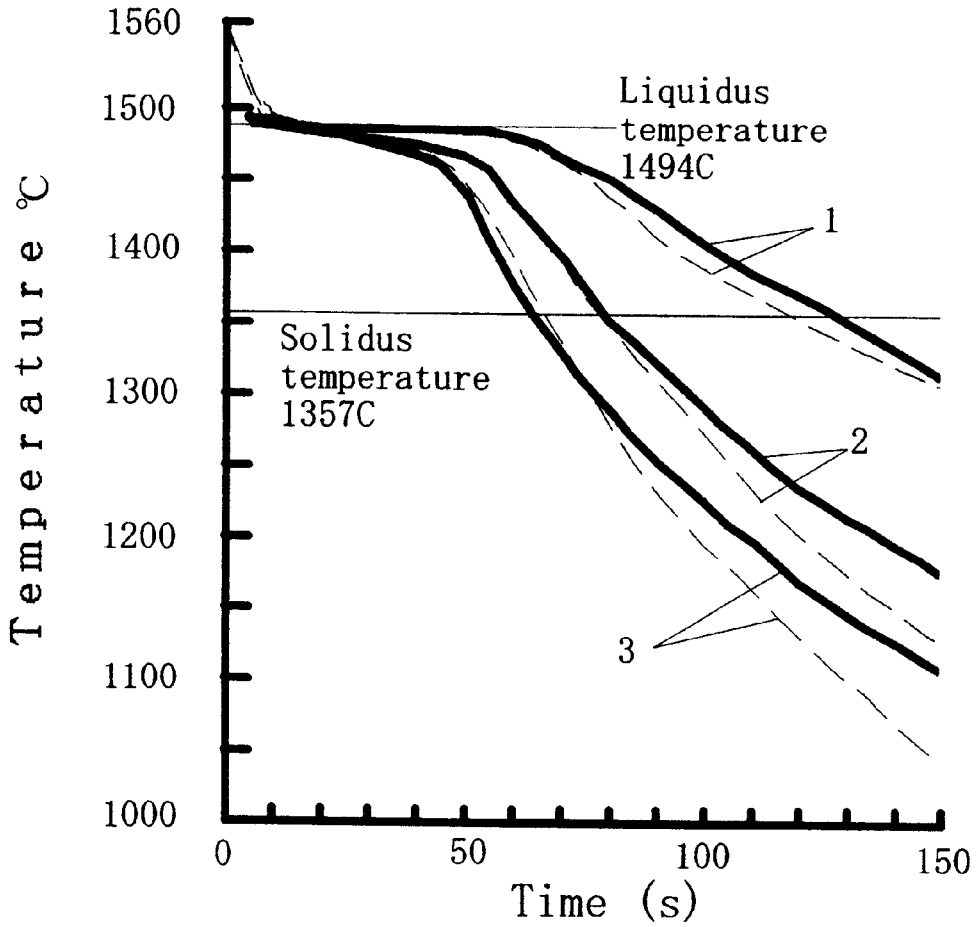
FIG. 45 shows the measured and calculated temperature histories in the atmospheric casting experiment.

The chemical composition of the cast specimen is shown in Table 4. The casting temperature was 1560 to 1580° C., the pouring time was about 10 seconds. The oxygen and nitrogen contents were 50 to 120 ppm. As to the No. 1 specimen cast in the atmosphere, the thermocouples were inserted at 3 locations along the center as shown FIG. 44 to measure the temperature changes during solidification. The measured temperatures were shown in FIG. 45.

In addition to the casting experiments, the numerical analyses by this invention were carried out from the beginning of pouring to the end of solidification and compared with the experiments by tracking the formation process of internal defects. The physical properties used are shown in Tables 2 and 3. The chemical compositions were set those of Table 4. As to the mold, the thermal conductivity was set 0.0036 cal/cms° C., the specific heat 0.257 cal/g° C., the density 1.5 g/cm3. As to the insulating material of the riser, the thermal conductivity was set 0.0003 cal/cms° C., the specific heat 0.26 cal/g° C. the density 0.35 g/cm3.

TABLE 4

The chemical compositions of the pressurized cast specimens (wt %)

| No | C | Si | Mn | P | S |
|---|---|---|---|---|---|
| 1 | 0.40 | 0.28 | 0.42 | 0.024 | 0.018 |
| 2,3 | 0.31 | 0.18 | 0.22 | 0.045 | 0.017 |

The calculated temperatures (denoted by the broken lines in FIG. 45) at each location of No. 1 specimen have well agreed with the measured values.

Figure 46:
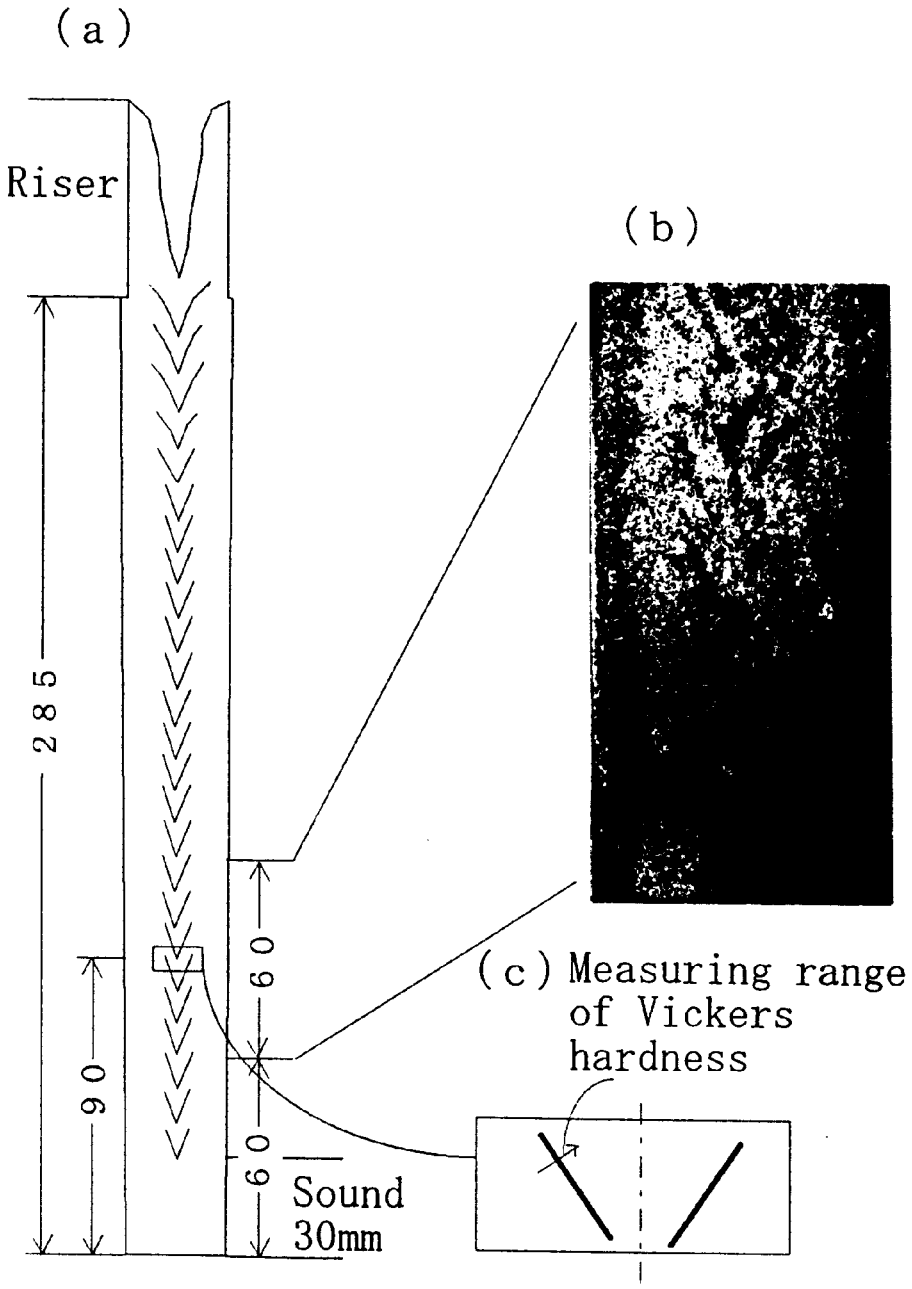
FIGS. 46*a* and *b* show the sketched diagram as cast macrostructure in the atmosphere.
Figure 48:
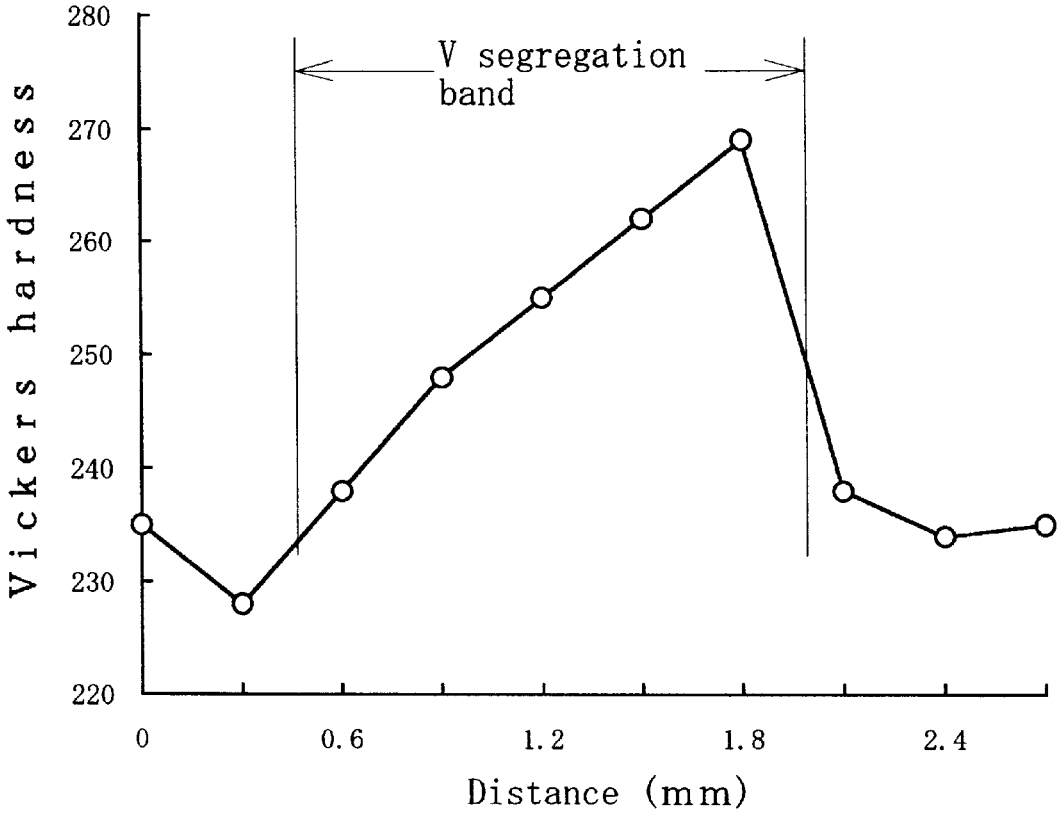
FIG. 48 shows the variation in Vickers hardness in the vicinity of the V pattern in as cast specimen in the atmosphere (load 1 kgf and 10 sec).

The macrostructure of No. 1 specimen etched by 0.4% nital solution is shown in FIG. 46. FIG. 46(*a*) shows the schematically sketched V patterns by naked eye observation and FIG. 46(*b*) a part of as etched macrostructure where the dark etched central V defects are clearly visible. The macrostructure consists of the columnar structure at very near surface and the fine equiaxed structure. FIG. 46(*c*) shows the position of microstructure and the measuring position of Vickers hardness. The microstructure and the result of the Vickers hardness measurement are shown in FIG. 47 and FIG. 48, respectively. In FIG. 47, the needlelike white portion is ferrite and the dark etched matrix is pearlite.

The dark etched band flowing from upper left to down right of FIG. 47 shows that the ferrite is scarce at the band and so the carbon concentration there is higher than that in the surroundings. Measuring the Vickers hardness across this flow as shown in FIG. 46(*c*), the resulting hardness was higher in the V band with increased pearlite than that in the surroundings as shown in FIG. 48. In addition, the hardness once decreased at the vicinity of the V band and subsequently increased to rise the right as shown in FIG. 48. This is considered to be attributed that when the V band is formed, the higher solute concentration liquid flows in (in this case, from left side) along the V band.

Also, it was confirmed by the color check inspection on the central cross-section that the microporosity distributed along the V pattern. The volume of the shrinkage cavity (of FIG. 46(*a*)) was about 1% of the total volume of the casting. This is quite smaller than the solidification contraction 4% of the casting, showing that most of the defects exist as the microporosity in the V band.

It was thus confirmed that the V patterned defects consist of the microporosity arranged in V characters and V segregation bands (the positive segregation).

Figure 49:
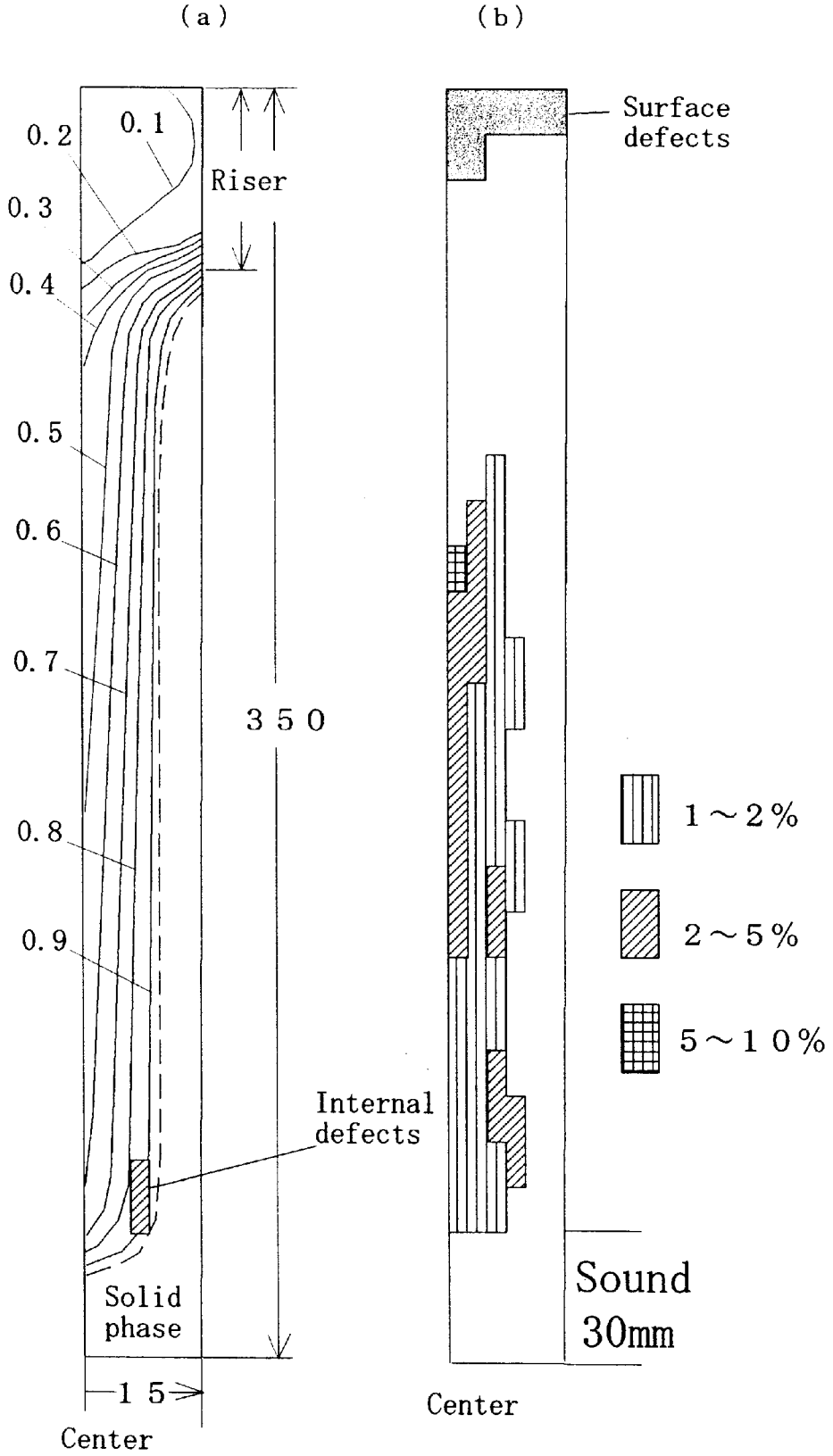
FIG. 49 shows the results of the numerical analysis for as cast specimen in the atmosphere. (a) is the volume fraction of solid distribution 55 seconds after pouring when internal porosity begins to form. (b) is the volume fraction of porosity (percent) distribution after solidified.

Shown in FIG. 49 is the results of Level 3 analysis for the No. 1 specimen where the formation process of microporosity was analyzed. The porosity distribution after solidified (FIG. 49(*b*)) is in good agreement with the real V pattern (FIG. 46(*a*)). From the numerical results, the internal porosity form 55 seconds from the start of pouring and the distribution of volume fraction of solid at that time is shown in FIG. 49(*a*).

The range of the porosity is denoted by the hatched area. By Level 2 analysis assuming no porosity formation, the pressure drop due to the Darcy flow became the biggest 63 seconds after from the start of pouring at the position of 75 mm from the bottom: the pressure was −20.5 atm. Considering the above results, the computations were performed by changing the atmospheric pressure in the range from 10 to 25 atm. The results indicated that the critical pressure for the formation of porosity is 20 atm. Thus, as the pressure was increased, the volume fraction of porosity decreased. Therefore, it is expected that the porosity completely disappears with more than 20 atm.

Figure 50:
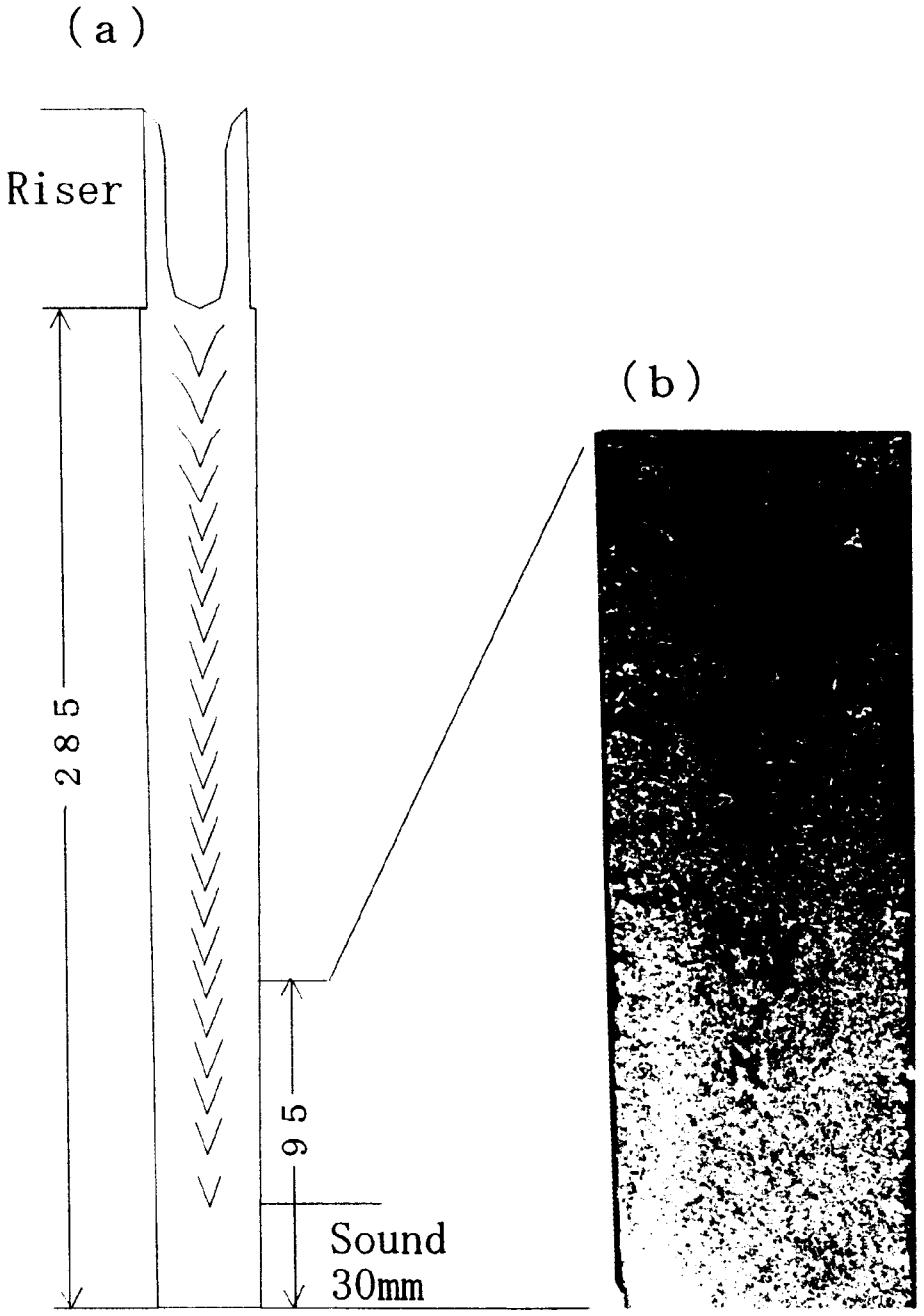
FIGS. 50*a* and *b* show the macrostructure of the pressurized casting at 10 atm.

Based on the above investigations, in No. 2 specimen, the pressurization was started (the volume fraction of solid at the center is about 0.3) and kept at 10 atm from after 30 seconds from pouring to the end of solidification. The macrostructure is shown in FIG. 50. Although the volume fraction of porosity was decreased compared to No. 1 specimen, the V defects are prominently visible.

Figure 51:
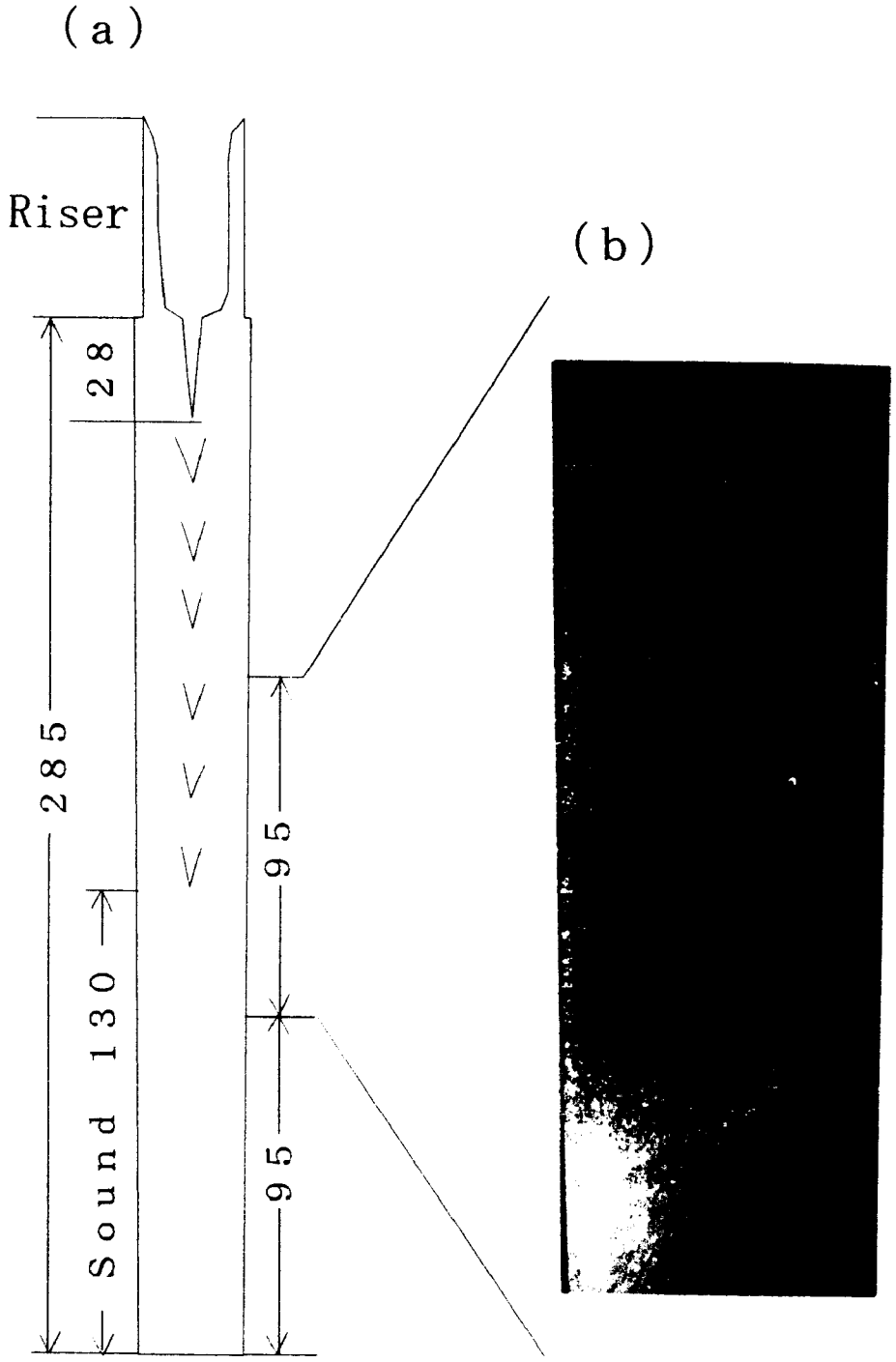
FIGS. 51*a* and *b* show the macrostructure of the pressurized casting at 22 atm.

On the other hand, as shown in FIG. 51 of the macrostructure of No. 3 specimen cast at 22 atm, the sound region without V segregation and porosity extended from 30 mm to 130 mm showing that the pressurization worked effectively.

Figure 52:
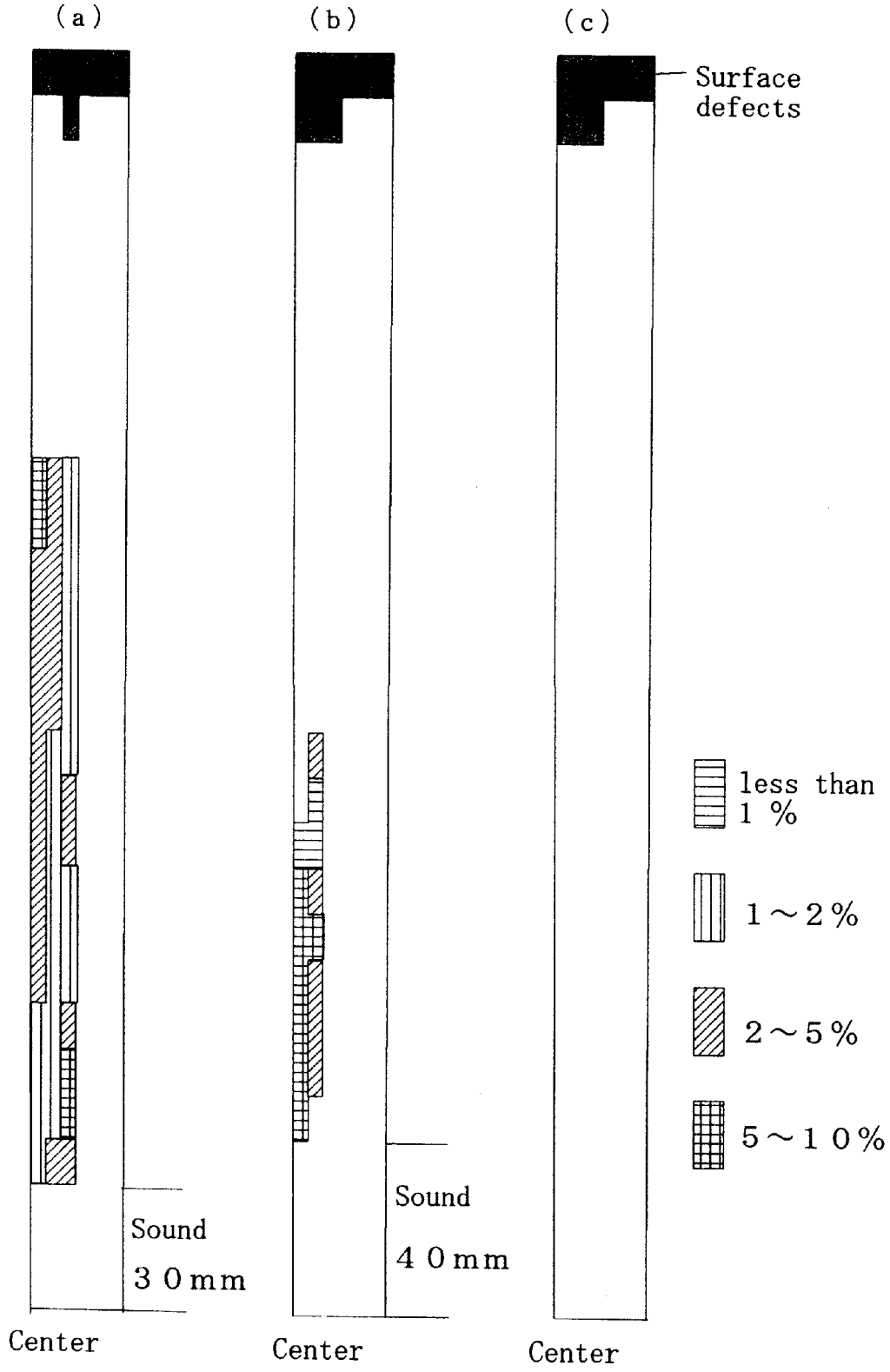
FIG. 52 shows the effects of the pressurized casting predicted by the numerical analysis. The calculated volume fractions of internal defects are shown for the cases: (a) atmospheric casting (no pressurization), (b) pressurized at 10 atm and (c) pressurized at 20 atm.

With these specimens No. 2 and No. 3, Level 3 numerical analyses were conducted with the results shown in FIG. 52 (the chemical compositions are by Table 4). The porosity decreases to some extent at 10 atm and disappears at 20 atm. The internal defects formed below the riser (FIG. 51). This is because the amount of the melt was less and the shrinkage was deepened. Also, in the numerical analysis, the formation of shrinkage cavity at the riser was not treated strictly (to strictly treat this, the partitioning of the computational elements around the riser should be fine enough, but for this particular case, not done because of the problem concerning the display of the results).

From above, it is clear that the internal defects can be eliminated by pressurization, reconfirming experimental results published in the past. However, in these past experiments, the effect of pressurization was not studied theoretically and quantitatively; therefore the experiments were inadequate. For example, in Ref. (34), the authors expressed a negative perspective about the effect of pressurization in practical use, quoting that the central segregation appeared more prominently in the pressurized casting at riser. In this reference, the sizes of the casting (3 inch rectangular cross-section×24 inch long), chemical compositions, casting temperatures, pressurization conditions at riser, measured data of temperature during solidification and the results of the observations of internal defects are all given; accordingly, it is possible to compare with the numerical analysis.

Figure 53:
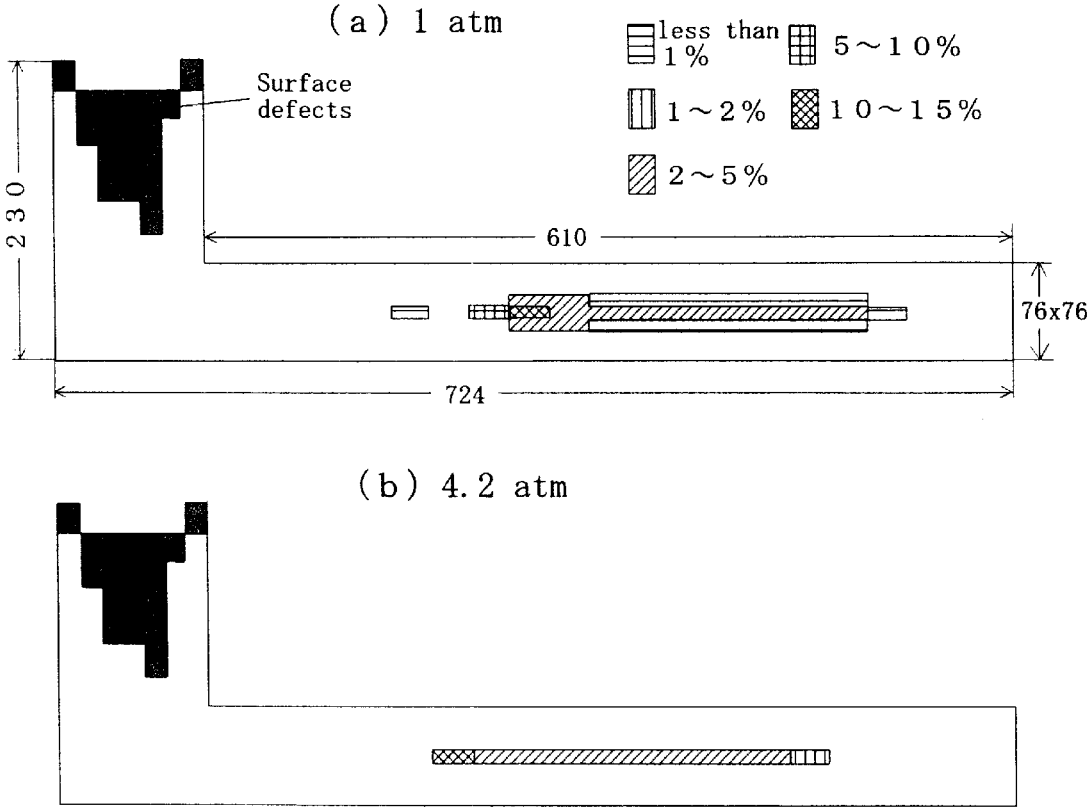
FIG. 53 shows the effects of the pressurized casting predicted by the numerical analysis for the steel castings of Ref. (34). The volume fractions of porosity are shown for the cases: (a) atmospheric casting (no pressurization) and (b) pressurized at 4.2 atm.
Figure 54:
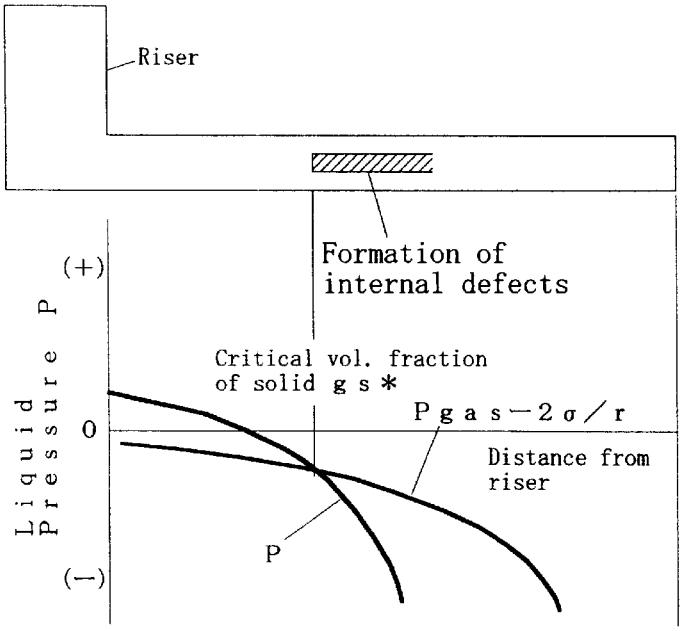
FIG. 54 is the schematic diagram for explaining the mechanism of the formation of internal defects.

Thereupon, these inventors conducted Level 3 three-dimensional analyses of this cast steel with the results shown in FIG. 53. It was found that the effect of pressurization is small at 4.2 atm, and that at least 20 atm is required to eliminate the central defects. In this connection, in terms of the criterion Eq. (65) of the formation of porosity, the relationship between the liquid pressure drop and the formation of porosity is schematically illustrated in FIG. 54. In the figure, porosity forms at the critical volume fraction of solidg s*. From the above verification, it is rational to think that the reason why the central segregation contrarily appeared more prominently in the above Ref. (34) is because when the pressurization effect on the riser is insufficient, the porosity formed and then triggered by the formation of the porosity, the high solute concentration liquid in the vicinity of the porosity flowed in. In any event, aside from the detailed discussion on dendritic scale, it can be said that if the feeding effect is sufficient, the central defects do not form.

In conclusion, the internal defects form in the region where the liquid pressure in solid-liquid coexisting zone (mushy zone) becomes less than the critical pressure during solidification, and it is possible by the use of the numerical method by this invention on the bases of the solidification theory to calculate the position of the defects in continuous castings.

Furthermore, it can be said that "When the microprosities are suppressed, the macrosegregation is suppressed simultaneously." Thus, it is important to eliminate the microporosity, or to say more precisely, not to give a chance of the formation. To accomplish this, it is necessary to restrain to the minimum the liquid pressure drop associated with the Darcy flow in the casting direction in the vicinity of the central region of thickness (the final solidification zone) and to hold it more than the critical pressure defined by Eq. (65).

C. Calculation of the Electromagnetic Force

Various methods are conceivable to exert the electromagnetic body force (Lorentz force). For example: Method of applying DC magnetic field and DC current, method of utilizing the distant propulsion force by linear motor type, etc. Thus, an appropriate method is available depending on the shape of the cross-section of cast piece, the exerting position, the magnitude of required force, cost of the equipment, etc.

Figure 2:
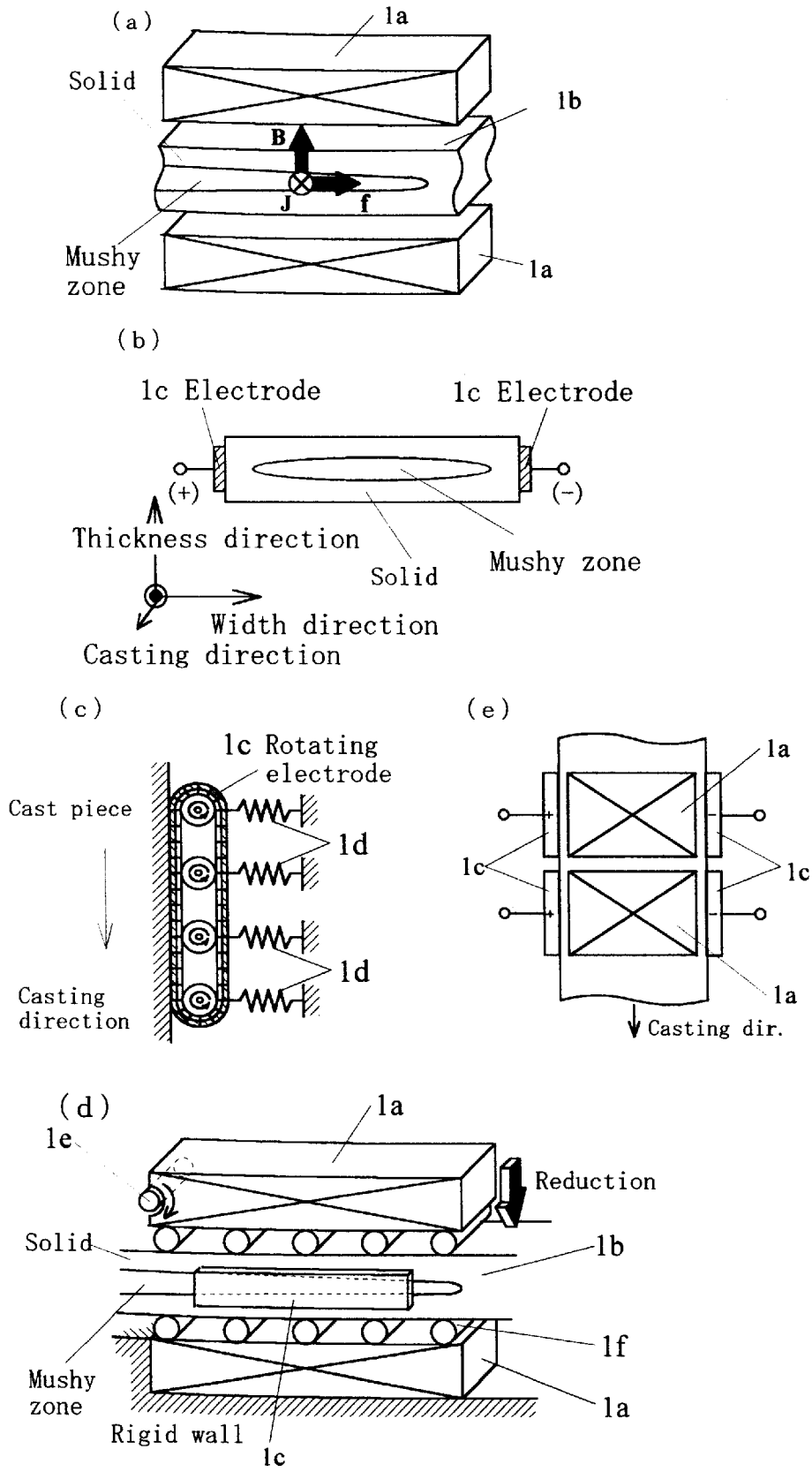
FIG. 2 is the schematic diagrams for describing the details of the electromagnetic booster of FIG. 1.

Here, the calculation method is described about the former case. As shown in FIG. 2, the electromagnetic body force (Lorentz force) f acting in casting direction is given as an outer product of the current density vector J in lateral direction and the magnetic flux density vector B in thickness direction by Eq. (67).

$$f=J\times B \tag{67}$$

J in Eq. (51) is expressed from Ohm law as Eq. (68).

$$J=\sigma E=-\sigma\nabla\phi \tag{68}$$

Where, E is the electric field strength, $\nabla\phi$ is electric potential gradient, $\sigma$ is electric conductivity. And, the electric potential distribution $\phi$ is obtained by the following Eq. (69) (from Eq. (3.4) of p.31 of Ref. (22) and the above Eq. (68)).

$$\nabla\cdot(\sigma\nabla\phi)=0 \tag{69}$$

$\phi$ is obtained by solving Eq. (69) using the boundary condition of the electricl potential defined at electrodes. Iron is nonmagnetic above the Curie point (about 770° C.) and can be regarded approximately same as that of the air. Therefore, it is relatively easy to exert an uniform static magnetic field to the solid-liquid coexisting zone. By incorporating the calculated f into the body force term X in the Darcy equation of Eq. (26) or the momentum equation of Eq. (33), and performing numerical analysis, its efficiency can be evaluated.

Further, the heat of Joule $Q_J$ is given by Eq. (70) and is taken into account in Eq. (2).

$$Q_J=\sigma J^2(J/m^3s)=0.238889\times10^{-6}\sigma J^2(c\ a\ 1/cm^3s) \tag{70}$$

EXAMPLE

Examples for carrying out the invention by this invention is described below.

A. On the Vertical-Bending Continuous Casting of Round Billet

Figure 13:
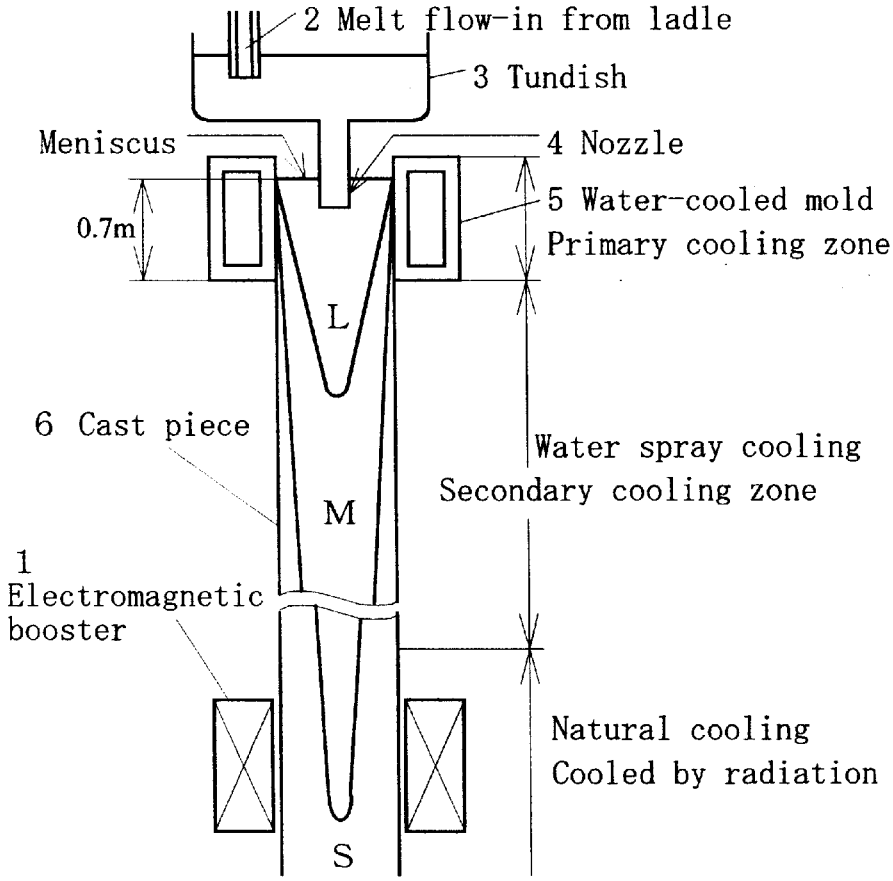
FIG. 13 is a schematic diagram of a typical conventional vertical billet caster. Symbol L denotes liquid zone, M solid-liquid coexisting zone, S solid zone.

As shown in FIG. 13, the continuous casting machine of the example No. 1 for carrying out the invention comprises water-cooled copper mold 5, tundish 3, nozzle 4 and the electromagnetic booster 1 to exert electromagnetic body force onto the solid-liquid coexisting zone (mushy zone) of the cast piece.

Figure 23:
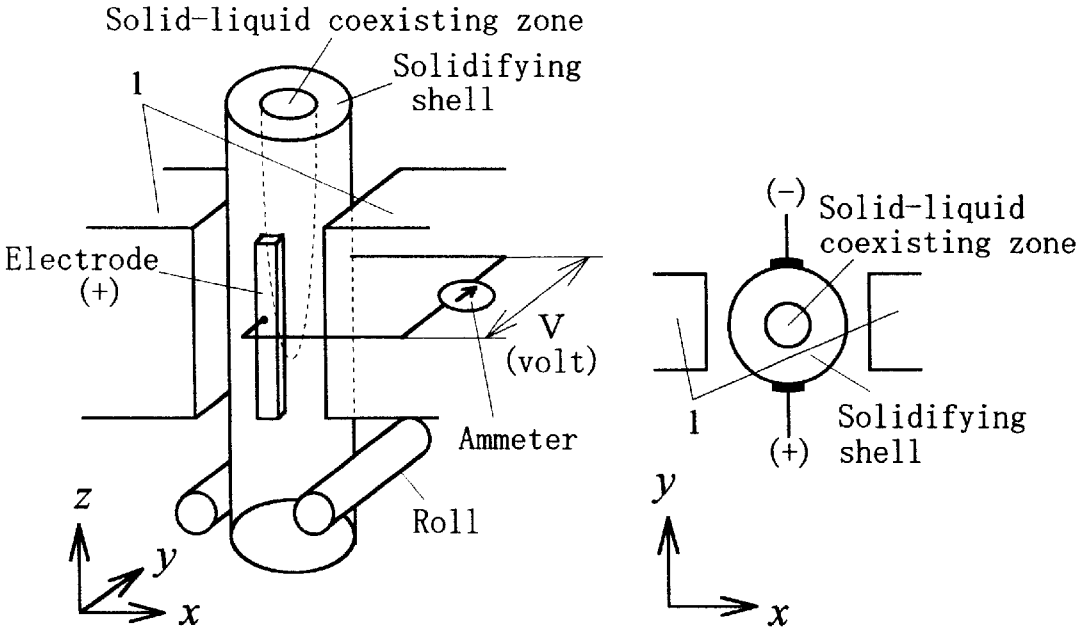
FIG. 23 is the schematic diagram of the electromagnetic booster in the example No. 1 for carrying out the invention. (a) shows the outlook and (b) the horizontal cross section. The electromagnetic body force (Lorentz force) is applied downward in vertical direction.

As shown in FIG. 23, the electromagnetic booster 1 is the apparatus to generate the electromagnetic body force toward casting direction which comprises superconductive coils or electromagnet to generate DC magnetic field and electrodes to flow DC current.

1% C-1% Cr bearing steel with 300 mm diameter was chosen. Because the bearing unit receives repeated load under high speed, excellent fatigue and wear resistances are required. Accordingly, among many specialty steels, bearing steel is the one that the most severe qualities are required about the cleanliness, the uniformity of structure, etc. This steel has a wide solidification temperature range, is easy to bring about the central segregation resulting in the formation of coarsened carbides and causes the quality deterioration of the low service life. The chemical compositions were set 1% C, 1% Cr, 0.2% Si, 0.5% Mn, 0.1% Ni, 0.01% P and 0.01% S. The physical properties used for computation are given in Table 2 and Table 3 at the end of this description, the linearized data of Fe—C phase diagram is shown in FIG. 14. The relationship between the temperature and the volume fraction of solid using the nonlinear multi-alloy model of this steel is shown in FIG. 15(*a*).

When the volume fraction of solid $g_S$ approaches 1 in the nonlinear multi-alloy model, the coefficients $\hat{A}_n$, etc. (Eqs. (12) to (19)) of the solute redistribution Eq. (10) becomes infinity. To avoid this inconvenience upon computation, the solidification was assumed to be completed when $g_S$=0.95 (Ref. (16)). In this connection, the latent heat of fusion was corrected so as to release 100% at $g_S$=0.95. Hence, the latent heat of fusion was assumed to evenly evolve, considering that the mushy zone is elongated towards the casting direction. That is, the value of 68.4 (cal/g) obtained by dividing the heat of fusion 65 by the fraction solid 0.95 was regarded as the apparent latent heat of fusion. The dissolved oxygen condenses in interdendritic liquid as the solidification proceeds, giving rise to the change of the equilibrium CO gas pressure as shown in FIG. 16(*a*) (refer to Eqs. (49) to (58). Assumed that there is no CO gas bubble). The physical properties used are given in Table 3. From the above figure, it is obvious that Pco falls off with the decrease of O content.

The computational domain were divided 10 evenly in radius direction ($\Delta r$=1.75 cm), and the partition length of the elements in casting direction was set $\Delta z$=5 cm. Prior to the computations, the number of elements in radial direction was examined where the temperature variation is steep. It was found that no essential difference was observed with more than 8 elements. The same examination was done with respect to the casting direction: Thus the number of partitions was determined as above mentioned.

With respect to the correction factor $\alpha$ of the specific surface area of dendrite Sb (Eq. (28)), $\alpha$ was determined $\alpha$=1.2 so as to coincide with the measured values of the dendrite arm spacing (DAS) of 1 C-1.5 Cr steel of Eq. (71).

$$\text{DAS}=523\ (\text{average cooling rate, }^\circ\text{ C./min})^{-0.55}\ (\mu\text{m}) \tag{71}$$

The above equation was obtained using the average cooling rate during solidification temperature range of (1453–1327=126° C). The temperature of the melt steel flowing in from the tundish was set constant and the radiation heat from the meniscus surface was ignored.

The liquid flow pattern in the upper part of the melt pool becomes complicated because of the outlet flow from nozzle, convection flow due to the temperature difference within the pool. Thus, the flow is basically turbulent and the temperature difference within the melt pool becomes small. Also, as already mentioned, the behavior of the liquid pressure drop in the mushy zone elongated in casting direction is most crucial. From this point of view, the effect of the liquid flow within the bulk liquid pool is exceedingly small. Accordingly, if we focus on the problems of internal defects, the flow within the melt pool does not necessarily need to be analyzed in detail. Considering these points, the solution method by the Darcy equation was used instead of solving the momentum equations that requires an excessive computation time. According to the Darcy solution, the fluid flow inside the bulk liquid pool becomes modest; as a result, the thermal diffusion due to the convection becomes small. To compensate this, the thermal conductivities of the liquid pool and the mushy region with the volume fraction of solid less than 0.05 was apparently multiplied by 5 that of the liquid. (This method is frequently used to calculate the temperature of continuous castings (for example, refer to Ref. (24)). However, in these computations, the flow analysis is not done and the errors brought about by neglecting the Darcy flow is corrected by using apparently increased thermal conductivity.) As an example, the comparison is shown in FIG. 17 between the case that only temperature was calculated and the case that the above Darcy solution method was used. It can be seen that compared to (1) of only temperature calculation, the solidification at the center begins earlier and the mushy zone is elongated by the influence of the flow-in of higher temperature liquid from upstream. From this example, it is obvious that the Darcy flow analysis is necessary even in a macroscopic scale.

Figure 18:
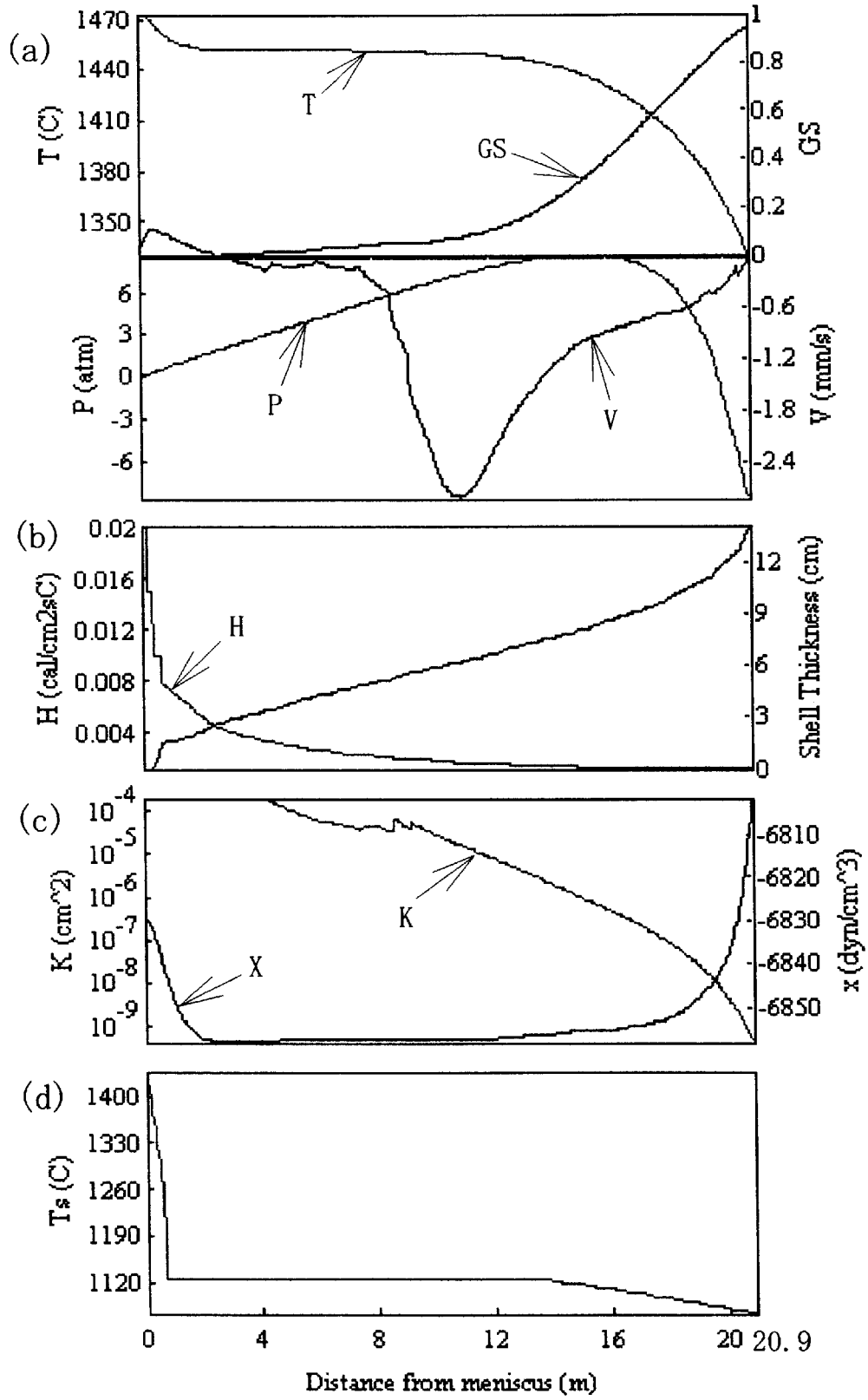
FIG. 18 shows the results of the computation No. 1 at the steady state of the example No. 1 for carrying out the invention. (a) is the distributions of the temperature T, the volume fraction of solid gS, the liquid pressure P and Darcy flow velocity at the center element. (b) is the distributions of the surface heat transfer coefficient H and the solidifying shell thickness. (c) is the distributions of the permeability K and the body force X (gravitational/Lorentz force) at the center element. (d) is the distribution of surface temperature $T_S$.
Figure 19:
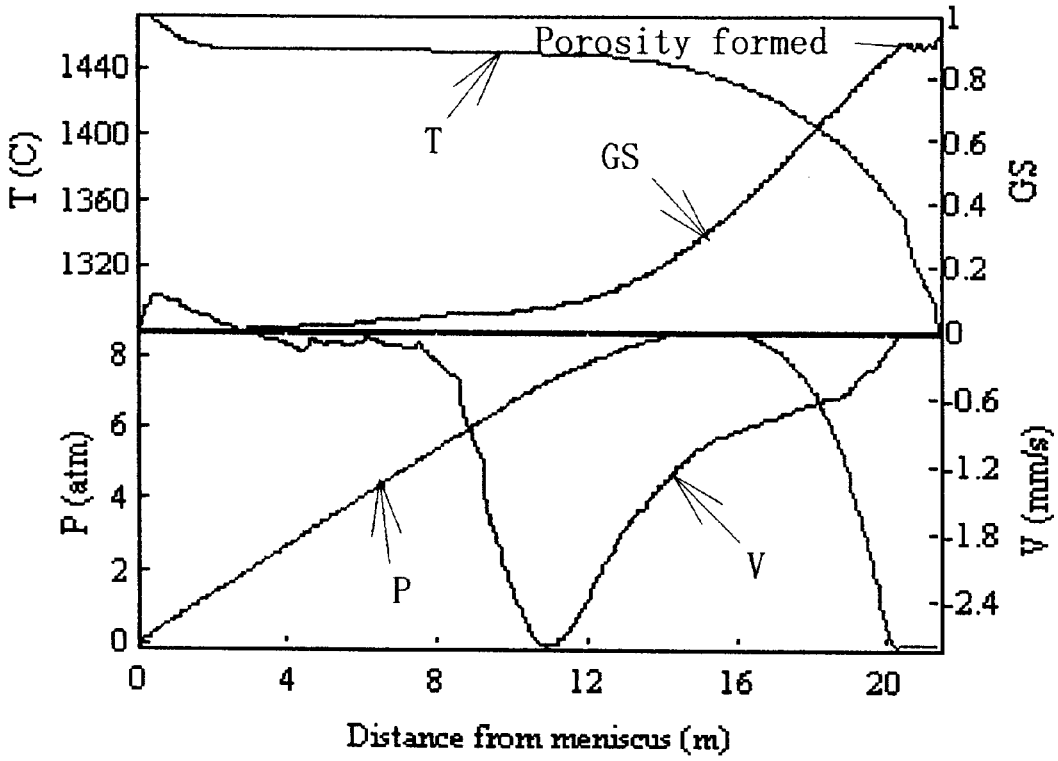
FIG. 19 shows the results of the computation No. 2 of the example No. 1 for carrying out the invention.

Hence, the computational results regarding the conventional operating conditions are shown in No. 1 and No. 2 of Table 5, FIGS. 18 and 19. The computations were done applying Level 2 and Level 3 analyses.

TABLE 5

Example No. 1 for carrying out the invention: The analytical results of 1C—1Cr bearing steel of vertical continuous casting (Casting speed 0.6 m/min, casting temperature 1473° C. (superheat = 20° C.))

| No./Casting method | Computational condition: Porosity analysis | M length (m) | Z (max) (m) | Pmax (atm) | Porosity gv (%) |
|---|---|---|---|---|---|
| 1 Conventional | Not done | 16.05 | 20.9 | −8.6 | — |
| 2 Conventional | Done | 15.45 | 20.3 | −0.10 | 9.5% at i = 1<br>5.8% at i = 2 |
| 3 Eprocess: Lorentz force of 8G exerted in range 19.5 to 21 m from meniscus | Done | 16.05 | 21.0 | −0.03 | No porosity |

Note 1: M length is from the position of the volume fraction of solid $g_S$=0.01 to the crater end at $g_S$=0.95.

Note 2: Zmax is the length from the meniscus to the crater end. The position that liquid phase disappears (in other words $g_S+g_V=1$) is defined the crater end and the next element where the liquid phase exist is defined the crater end element.

Note 3: Pmax is the liquid pressure at the crater end element.

Note 4: Symbol i in the volume fraction of porosity $g_V$ denotes the element number in radial direction.

Note 5: The segregation forms in the case that the porosity forms.

Note 6: E process is the method by this invention.

The heat transfer coefficient h at the mold surface was gradually changed from 0.02 to 0.01 (cal/cm2s° C.) to prevent the breakout (FIG. 18(*b*)).

In the secondary cooling zone by water-mist spraying, the surface temperature of the solidifying shell was set uniformly to 1125° C. Then the h can be obtained as a response. The heat flux from the surface is given by the product of h and the difference between the surface temperature and the ambient temperature. The boundary condition was changed from the mist cooling to natural radiation cooling at the position where the cooling intensity by radiation becomes larger than that by the mist cooling (refer to FIG. 18(*b*) and (*d*)).

The liquid pressure at the crater end element (the farthest from the meniscus, the final solidification position) becomes −8.6 atm in the Level 2 analysis of the computation No. 1. However, such a negative pressure can not be realized in practice, thus porosity forms according to the following critical condition for the formation of porosity.

$$P \le P_{CO} - \frac{2\sigma_{LG}}{r} \text{ (Rewritten)} \tag{65}$$

Pco increases to the maximum value of 0.9 atm with increased volume fraction of solid. On the other hand, the term $-2\sigma_{LG}/r$ increases approximately to the negative value of −1.2 atm for this particular case. Accordingly, unless the liquid pressure (in the side of the higher volume fraction of solid with bigger pressure drop) becomes less than the pressure of P (absolute pressure)=0.9−1.2=−0.3 atm, the porosity does not form.

In the computation No. 2 by Level 3 analysis with the porosity formation taken into account, the liquid pressure became less than this critical value resulting in the formation of porosity. The relationship among the liquid pressure P, the gas pressure Pco and the volume fraction of porosity $g_V$ after the formation of porosity is automatically adjusted to satisfy Eq. (65) and the already mentioned Eqs. (49) to (58). In this computer program, the Darcy flow is allowed even in the situation that the porosity exists. In this way, 5 to 10% porosity formed in the central range of about 6 cm (20% of the diameter).

$g_V$ in here represents the mean value of the volume fraction of porosity in a considerably larger volume element in comparison with the order of the dendrite arm spacing. Similarly with respect to the central segregation, the computed values are also those of the mean values in the volume elements. Hence, the segregation is not brought about upon computation. However, this does not mean that the V segregation doe not form, but the V segregation does locally form in fact as already mentioned.

Some comments are given below.

Figure 20:
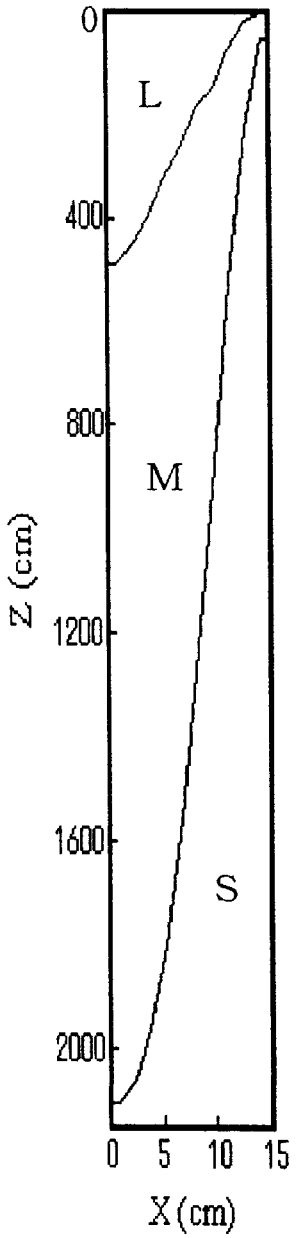
FIG. 20 shows the phase distribution in the computation No. 1 of the example No. 1 for carrying out the invention. L denotes the bulk liquid region, M the solid-liquid coexisting zone and S the solid zone. The region with more than 1% of volume fraction of solid is regarded as M.

1) As shown in FIG. 18(*a*), P increases approximately linearly in low fractions of solid region (say less than 0.2). Thus, the pressure drop is very small, which means that even if the starting point of the mushy zone at upstream is changed to some extent, its effect on the pressure drop at the higher volume fractions of solid region associated with the porosity formation is almost negligible. From this, it is understood that the strict flow analysis by the momentum equation in the melt steel pool is not necessary. The distributions of the solid, the liquid and the mushy are shown in FIG. 20.

Figure 21:
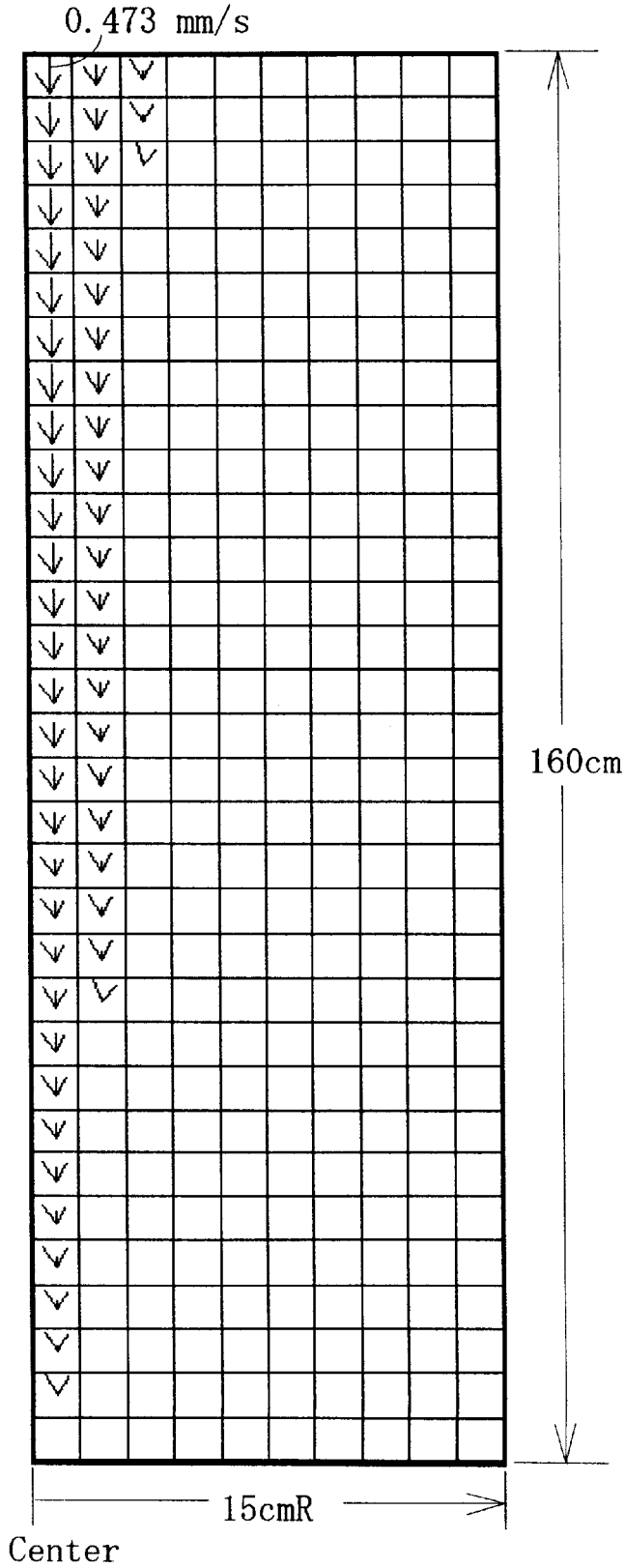
FIG. 21 shows the interdendritic liquid flow in the vicinity of the crater end in the computation No. 1 of the example No. 1 for carrying out the invention.

2) The Darcy flow is descent with the maximum value of −2.8 mm/s and becomes slower as it goes to upstream because the width of the stream becomes wider (similar to the flow of river). In the upper part of the liquid pool, ascent flow is observed which is the natural convection that results from the higher temperature at the central part compared to the side. The variation of the body force X (gravitational force) is shown in FIG. 18(*c*). The body force X becomes smaller at the crater end side. This is attributed that the effect of the condensation of the lighter solute elements (all except for Ni) than the liquid Fe is greater than the effect of temperature drop, thus resulting in smaller liquid densitypL. As already mentioned, the driving force to cause the Darcy flow is the contraction associated with solidification, and the flow is downward almost uniformly as shown in FIG. 12(*a*). The flow pattern in the vicinity of the crater end for the computation No. 1 is shown in FIG. 21. The flow channel becomes narrower toward the crater end and the flow velocity in the radial direction gradually becomes smaller compared to that in the casting direction (in the vicinity of the crater end, the flow in the radial direction is practically negligible).

3) The degree of the segregation of the alloy elements at the central portion is within the computational error of a few percents, i.e., practically no segregation (however, note that the V segregation takes place as above mentioned).

Figure 22:
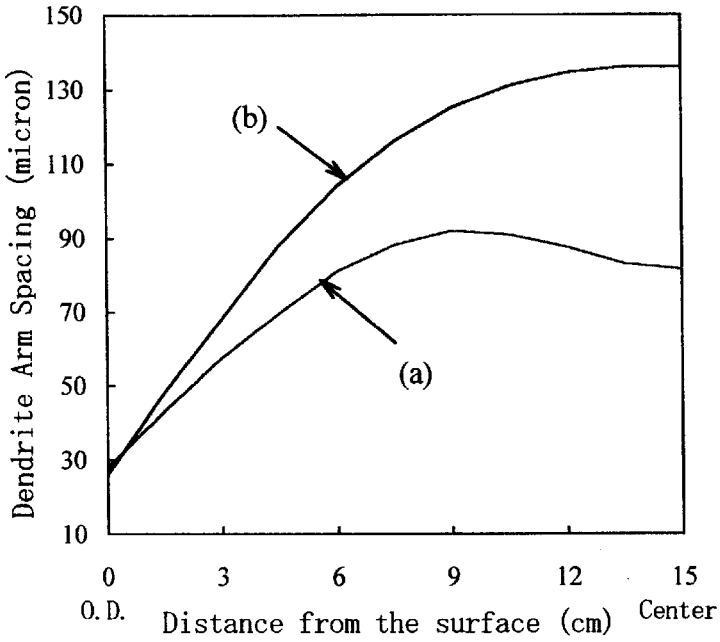
FIG. 22 shows the dendrite arm spacings in the example No. 1 for carrying out the invention. (a) is of the case using theoretical equations (28) and (29), and (b) is of the case using the empirical equation (31). Since the forms of the equations (31) and (71) are different upon the calculation of (b), A and n are determined as A=7.28 and n=0.39 respectively so that d becomes d=35 $\mu$m at the surface element where accelerated solidification phenomenon is absent.

4) The permeability K regarding the Darcy flow is one of the important factors when evaluating liquid pressure drop. In this description, the two methods for determining K were described. The dendrite arm spacing obtained by these methods are shown in FIG. 22. In the curve (a) obtained by Eqs. (28) and (29), DAS is smallest at the surface, becomes larger as it goes inward but on the contrary becomes smaller at the central portion. This is attributed to the accelerated solidification at the final stage of solidification, as is seen that the shell thickens rapidly as it approaches the crater end (FIG. 18(*b*)). On the other hand, as shown in the curve (b) by Eq. (31), the local solidification time $t_f$ becomes the biggest at the center and hence, the dendrite arm spacing DAS becomes the biggest at the center as well. The accelerated solidification phenomenon appears at the last stage of solidification more clearly in prescribed large steel ingots. It is also found in continuous casting as reported in Ref. (25), thus it is a common phenomenon. With respect to the distribution of DAS in thickness direction, it is reported that it becomes small conversely at the central part of the continuous casting of 6063 aluminum alloys (the diameter 203 mm, casting speed 0.1 m/min) of Ref. (26).

From the above, it is obvious that the solution method by this invention theoretically evaluating d and K by the use of Eqs. (27) to (29) reflects the solidification phenomena more strictly. This is one of the reasons to use these equations. [The above reversible phenomenon can not be grasped by Eqs. (30) and (31). This is because the history of solidification rate $\partial g_S/\partial t$ is not considered in these equations.]

Figure 24:
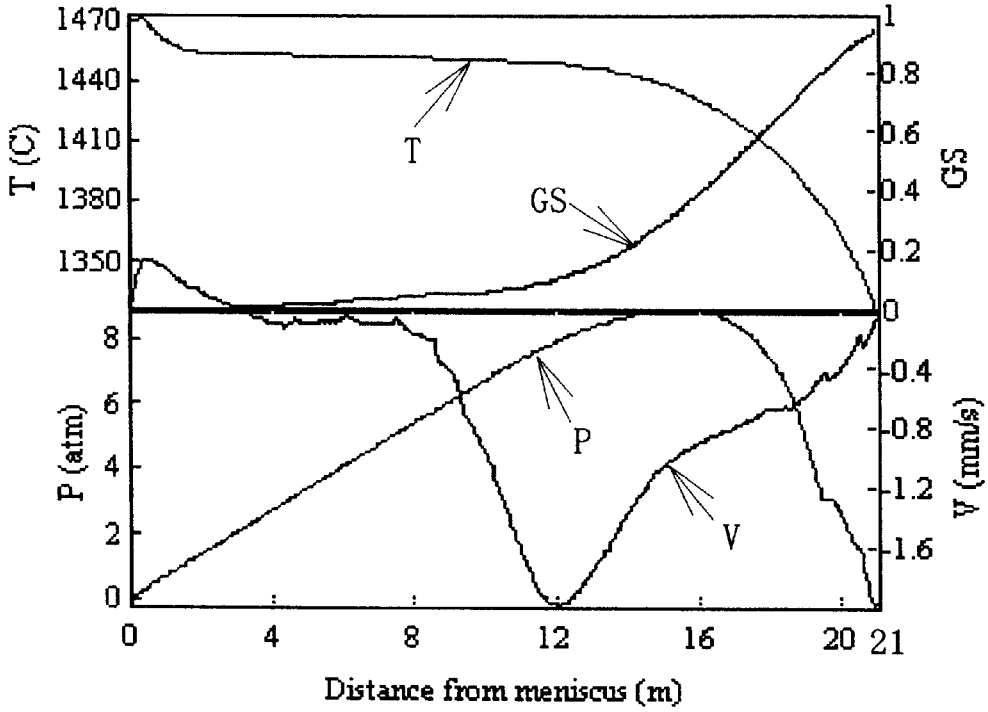
FIG. 24 shows the effect of the electromagnetic body force (Lorentz force) in the computation No. 3 of the example No.1 for carrying out the invention.

Next, the results of the computation No. 3 by Level 3 analysis for the case that applied the electromagnetic force by this invention are shown in No. 3 of Table 5 and in FIG. 24. The conceptual schematic diagram applying this method to the vertical continuous casting of round billet is as shown in FIG. 23. The Lorentz force is given by Eq. (72) as the product of uniform DC magnetic flux density $B_X$ in X direction and the DC current density $J_y$ in y direction that flows in the central part of the solid-liquid coexisting zone.

$$f_z = -J_y B_x \tag{72}$$

In the light of the P distribution in FIG. 18(*a*) and the required Lorentz force obtained from Eq. (63), the Lorentz force of $f_z$=−54900 (dyn/cm$^3$) (8 times of gravitational force, 8G) was exerted onto the range from the upstream vicinity of the position of P becoming 0 to the crater end, i.e., the range of 19.5 to 21.0 m from the meniscus. As a result, the liquid pressure drop nearby the crater end with high volume fraction of solid is relaxed to hold a positive pressure of about 1 absolute atm and the porosity did not take place as can be seen from FIG. 24. In other words, the continuous casting without the internal defects can be produced by exerting the Lorentz force larger than the above value.

With respect to the soft-reduction method by the prescribed references, it has been interpreted such that the soft-reduction method tries to suppress the interdendritic liquid flow toward casting direction by giving onto the solidifying shell the reduction gradient corresponding to the solidification contraction and thereby tries to reduce the central defects. However, this can be reinterpreted such that it relaxes the liquid pressure drop occurring in the casting direction. In this sense, since it is possible to reduce the required Lorentz force by concurrently applying the soft-reduction, it is effective to attach soft-reduction gradient by placing rolls between the round billet and rigid frame 1*a* as shown in FIG. 2(*d*). This will be discussed in detail later on.

B. On the Vertical-Bending Continuous Casting of Thick Slab

The vertical-bending continuous casting of thick slab is described as the example No. 2 for carrying out the invention.

Since the central defects in thick slab, for example, high grade thick steel plate used in ocean structures originate cracks and thus cause the quality deterioration, it has been studied energetically as an important problem that influences the quality. The central segregation appears more prominently in higher carbon content steels with a wide solidification temperature range. Thereupon, 0.55% carbon steel of JIS S55C (AISI 1055) was chosen. The chemical composition was set 0.55% C, 0.2% Si, 0.75% Mn, 0.02% P, 0.01% S. The relationship between the temperature and the volume fraction of solid obtained by the nonlinear multi-alloy model is shown in FIG. 15(*b*) and the physical properties in Tables 2 and 3 and in FIG. 25. Si is used as a deoxidizer. The oxygen content was set 0.003 wt %. The outline of the caster is shown in FIG. 26 and the operating conditions given in Table 6.

TABLE 6

The specification and the operating conditions of the vertical-bending caster used for the example No. 2 for carrying out the invention

| | |
|---|---|
| Mold length | 1.2 m |
| Length of vertical section (including mold) | 3 m |
| Bending radius of curvature | 8 m |
| Dimensions of slab | 220 mm thick × 1500 mm width |
| Casting speed | 1 m/min |
| Superheat of melt steel | 15° C. |
| Oxygen content in melt steel | 0.003 wt % |

Slab bends when department and also correction department are passed and bend and receive it deformation. The slab undergoes plastic deformation when it passes through bending and unbending zones. Assuming a simple bending mode and regarding the position of neutral axis as unchanged considering that the radius of curvature is large enough compared to the slab thickness, the strain in casting direction $\epsilon_z$ becomes maximum at the surface with the value of $\epsilon_z$=110/8000=1.375%. The radii of curvature shown in FIG. 26 were set so that the total bending strain of 1.375% was obtained by gradually bending with 5 steps by about 0.275% per each step. They were set similarly with respect to the unbending zone. In this computer program, assuming a simple bending/unbending deformation mode as above mentioned and regarding the cast piece as a complete plasticity body (elastic strain is ignored), the effect of the plastic deformation is included as solid deformation velocity in various governing equations.

The computational domain was partitioned uniformly into 19 elements throughout in thickness direction, considering the non-symmetric nature by bending (partition length $\Delta x$=22 cm/19). The partition length in casting direction was set $\Delta z$=10 cm. Since the width of slab in lateral direction is considerably larger compared to the thickness, two-dimensional analyses were performed. The correction factora of the specific surface area of dendrite Sb (Eq. (28)) was set 1 (no correction).

Figure 27:
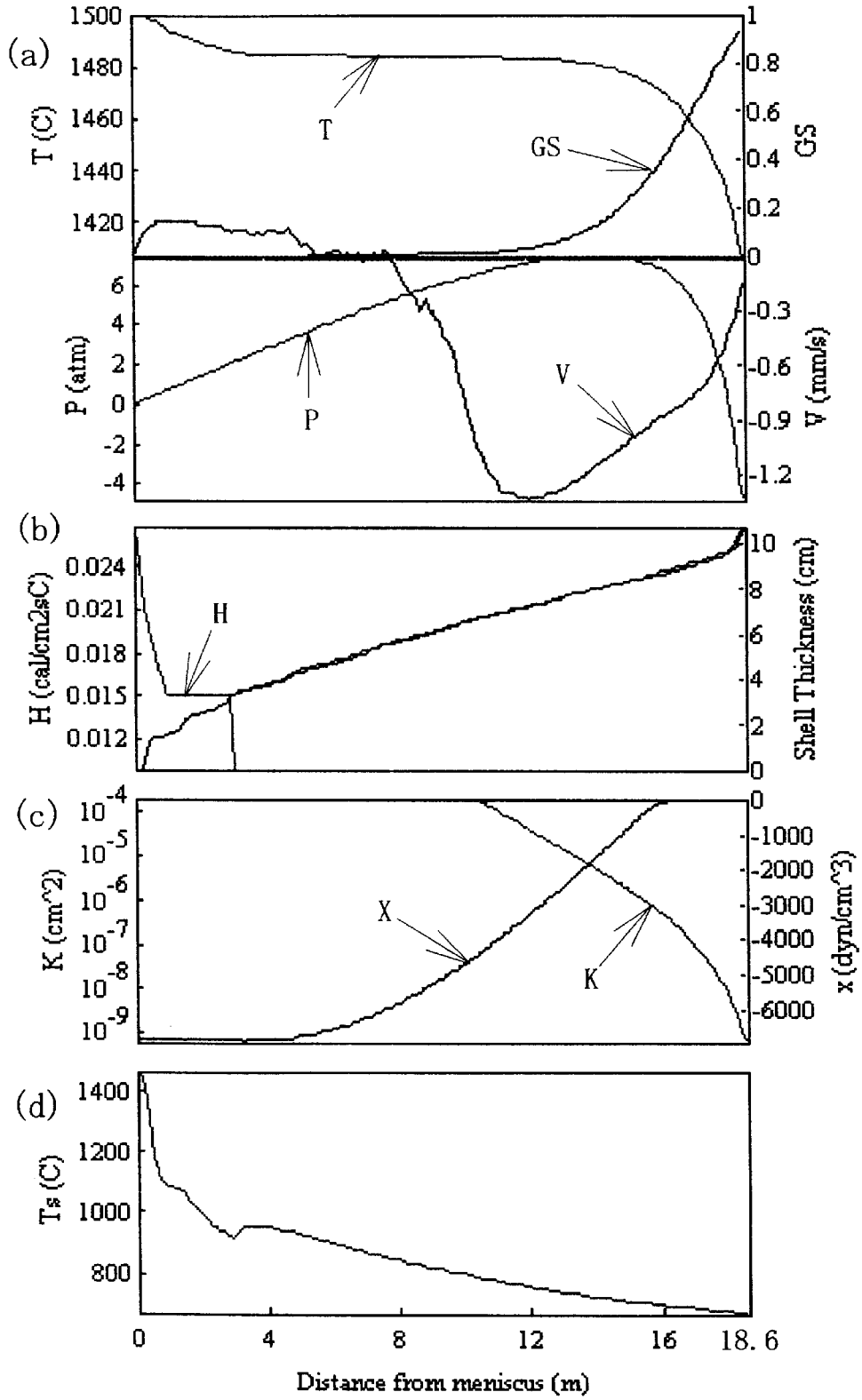
FIG. 27 shows the results of the computation No. 1 at the steady state of the example No. 2 for carrying out the invention. (a) is the distributions of the temperature T, the volume fraction of solid gS, the liquid pressure P and Darcy flow velocity at the center element. (b) is the distributions of the surface heat transfer coefficient H and the solidifying shell thickness. (c) is the distributions of the permeability K and the body force X (gravitational/Lorentz force) at the center element. (d) is the distribution of surface temperature $T_S$.

First, the results of Levels 2 and 3 analyses for the conventional operating conditions are presented in Table 7 and in FIGS. 27 to 31. The computations No. 1 and No. 2 are those for the conventional methods at present. The heat transfer coefficients at surface h (cal/cm$^2$s° C.) are set as:

$h=0.03-0.0015\sqrt{Z}$ in the mold $h=0.015$ for $Z=1$ to 3 m $h=0.010$ for $Z\geqq 3$ m Where, Z is the distance from the meniscus. The surface temperature and solidified shell thickness changes are as shown in FIG. 27(*d*) and (*b*), respectively.

TABLE 7

The example No. 2 for carrying out the invention: Analytical results for 0.55% carbon steel of vertical-bending caster (Casting speed is 1 m/min, casting temperature is 1500° C. (superheat = 16° C.))

| No./Casting process | Computational condition: Porosity analy. | M length (m) | Z (max) (m) | Pmax (atm) | Porosity gv (%) |
|---|---|---|---|---|---|
| 1 Conventional | Not done | 8.7 | 18.6 | −4.7 | — |
| 2 Conventional | Done | 8.5 | 18.4 | −0.3 | 8% at center element; Diam of pore: 50 μm |
| 3 Eprocess Range: 18.0 to 18.6 m Magnetic flux density: 0.7(T) Current density: 1.47 × 10$^6$ (A/m$^2$) Lorentz force: 15G (G: gravity) | Done | 9.1 | 19.0 | −0.1 | No porosity |
| 3 Eprocess Range: same as above Magnetic flux density: 0.5(T) Current density: 2.058 × 10$^6$ (A/m$^2$) Lorentz force: same as above | Done | 9.4 | 19.3 | 0.78 | No porosity |

Note: The meanings of Symbols, etc. are the same as in the note of Table 5

When the volume fraction of solid $g_S$ becomes more than 0.6 in the computation No. 1 by Level 2 analysis, the liquid pressure drops sharply and becomes a negative pressure of −4.7 atm at the crater end. This is attributed that the permeability K decreases rapidly as shown in FIG. 27(*c*). The casting directional component X of the gravity becomes 0 at the range more than Z=16 m, hence there is no feeding effect by the gravitational force (FIG. 27(*c*)). Consequently, the porosity forms.

Figure 28:
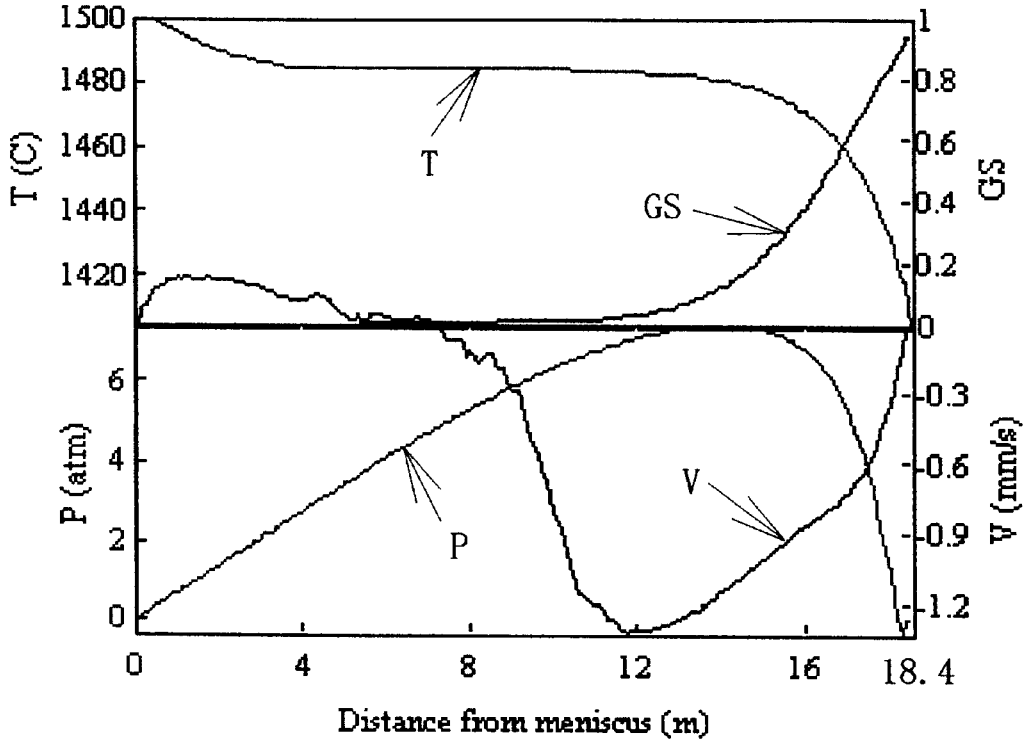
FIG. 28 shows the results of the computation No. 2 of the example No. 2 for carrying out the invention.

In the computation No. 2 with porosity analysis (refer to Table 7 and FIG. 28), about 8 vol. % of porosity were formed in the range of 11mm (5.2% of the thickness) about the center. The size of the porosity is about 50 $\mu$m in diam. That means that a severe V segregation takes place that accompanies the porosity at the central region. Attention must be paid that the liquid pressure distribution differs in the computation No. 1 and in the computation No. 2 with porosity formation taken into account. The large negative pressure of the computation No. 1 is not able to take place in reality, and the real pressure distribution becomes as shown in FIG. 28 as a result of the porosity formation.

Next, described are the computations No. 3 and No. 4 where the electromagnetic force by this invention was applied. In reference to the information about the required Lorentz force distribution (by Eq. (63)) obtained along with the computation No. 1, the parameters were set as below in the range of more than Z=18 m from the meniscus where the liquid pressure drops significantly:

Range Z=18.0 m to 18.6 m from meniscus

DC magnetic flux density in thickness direction of slab B 0.7 (T)

DC current density in width direction of slab $$J=1.47\times10^6\ (A/m^2)$$

To generate,

Lorentz force toward casting direction of slab $$f=J\times B=1.029\times10^6\ (N/m^3)$$

(equivalent to 15G, 15 times the gravity)

For this, the potential difference at both ends of the computational domain in the width direction was set as follows.

$$E=J\times0.01/\sigma=1.47\times10^6\times0.01/7.0\times10^5=0.021 \quad (V)$$

Figure 32:
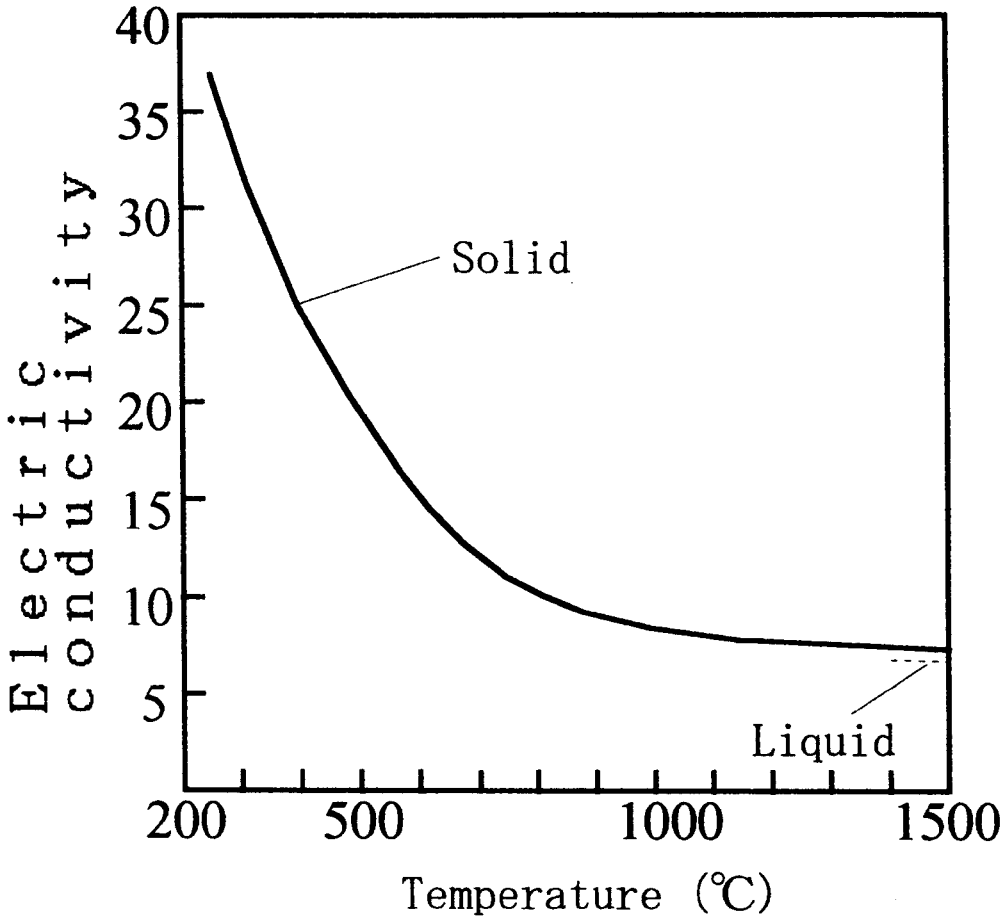
FIG. 32 shows the electric conductivity $\sigma(1/\Omega m)$ of carbon steel (The Iron and Steel Institute of Japan: Iron and Steel Handbook 3rd edition, p. 311).

The electric conductivity $\sigma$ is taken the average in mushy zone (FIG. 32). In this example, the electromagnetic booster is installed in the horizontal zone of FIG. 26. It is also possible to extend the applied range and thereby reduce the required Lorentz force.

Figure 29:
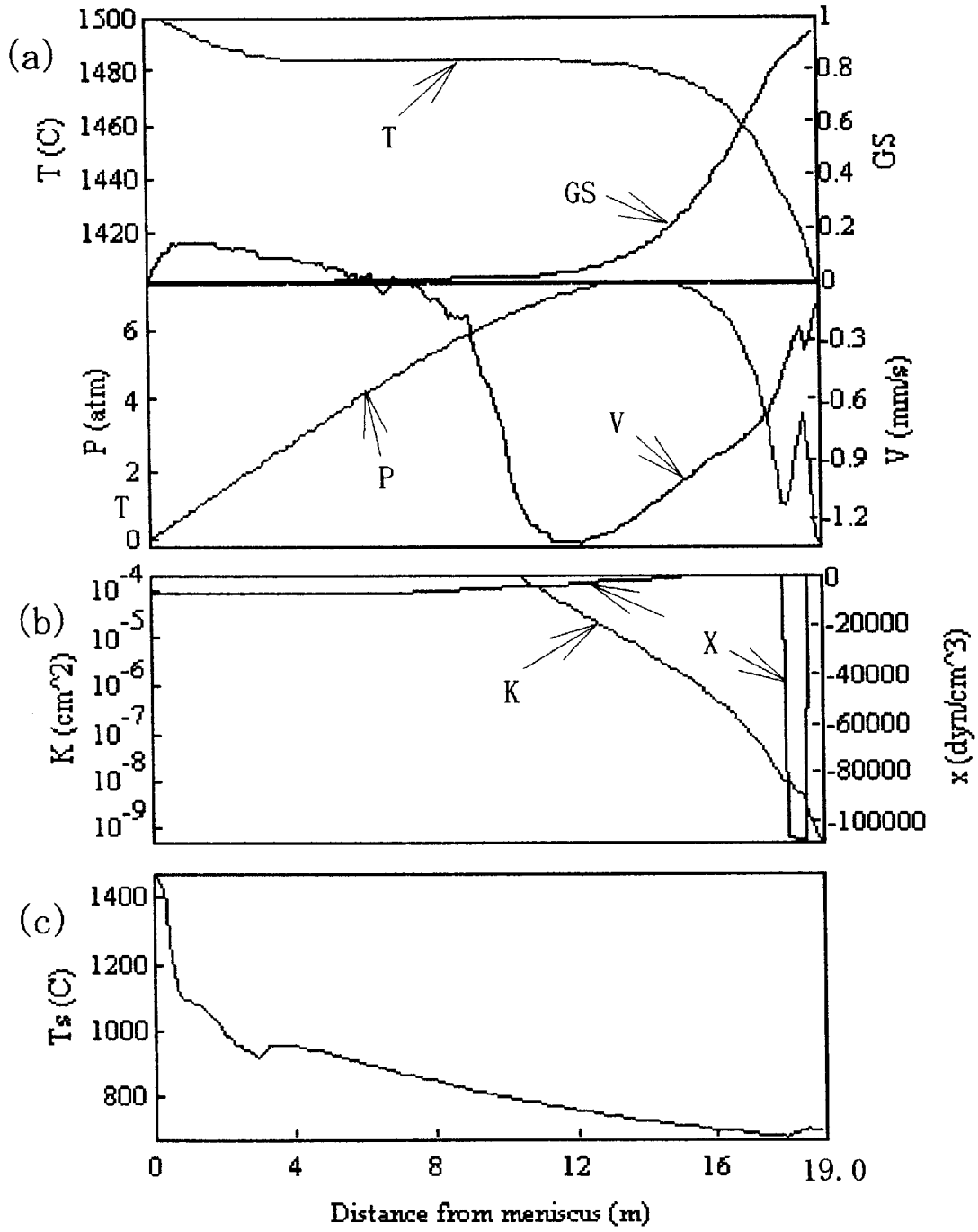
FIG. 29 shows the effect of the electromagnetic body force (Lorentz force) in the computation No. 3 of the example No. 2 for carrying out the invention.
Figure 30:
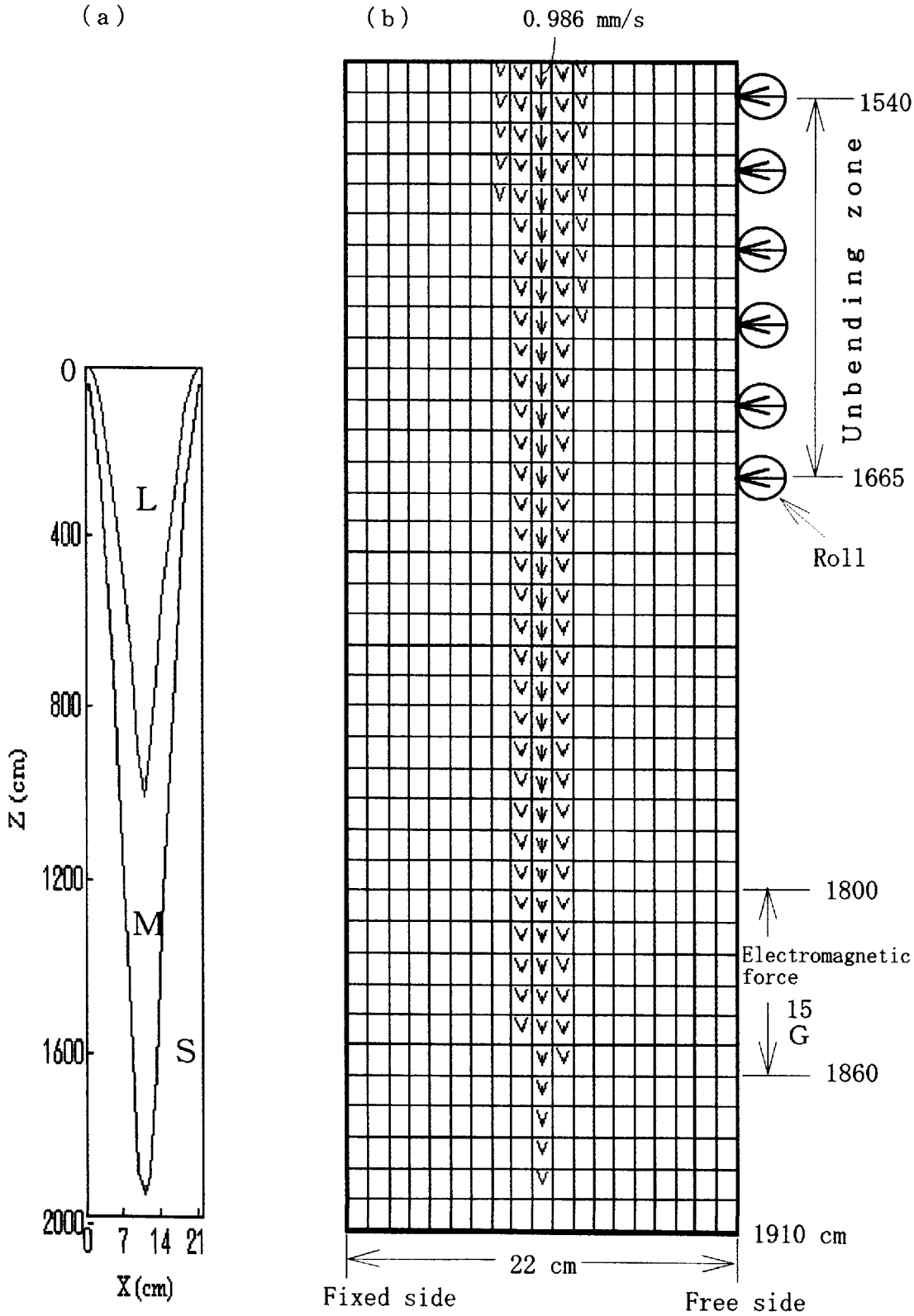
FIG. 30 shows the results of the computation No. 3 of the example No. 2 for carrying out the invention. (a) shows the solidification profile and (b) Darcy flow pattern in the neighborhood of the crater end. L denotes the bulk liquid region, M the solid-liquid coexisting zone and S the solid zone. The distance from the meniscus is that along the central axis of the slab. The slab is curved in fact, but is shown in a prolonged rectangular form for the convenience of display. The unbending rolls are denoted by circles.
Figure 31:
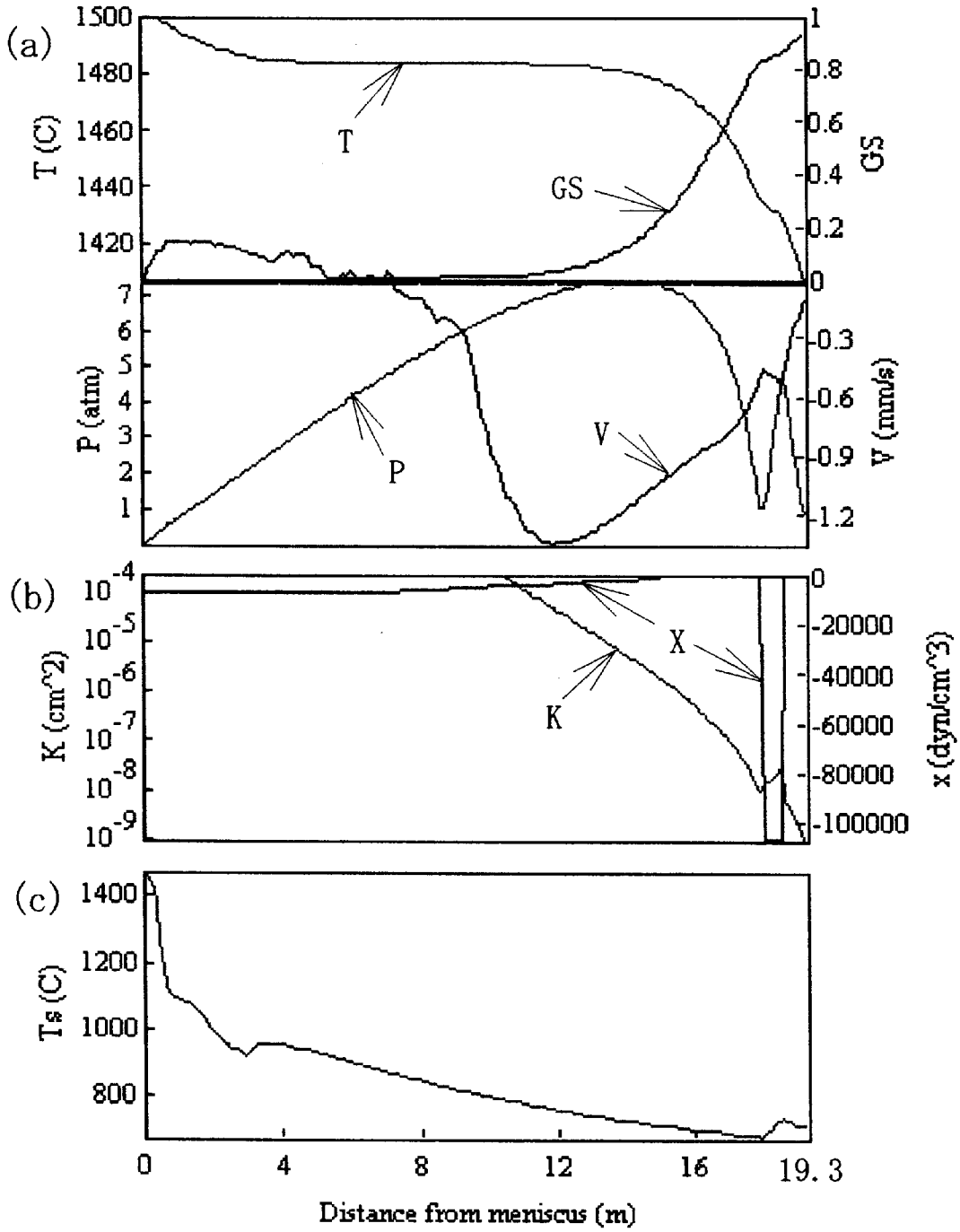
FIGS. 31*a, b* and *c* show the effect of the electromagnetic body force (Lorentz force) in the computation No. 4 of the example No. 2 for carrying out the invention.

Thus obtained results are presented in Table 7, No. 3 and in FIGS. 29 and 30. It is obvious from FIG. 29(*a*) that the liquid pressure drop was relaxed to −0.11 atm (absolute pressure of 0.89 atm) at the crater end element, thus no porosity forms. The central segregation is a few percent within the level of computational error and thus essentially does not exist. The whole solidification profile and the Darcy flow pattern in the vicinity of the crater end are shown in FIG. 30. The flow pattern is normal in the range where the electromagnetic force was exerted and in the unbending zone. In the unbending zone, the deformation mode is that of tensile at the free side (inside the curvature) and that of compressive at the fixed side (outside the curvature) about the center axis. Therefore, as a result, the interdendritic liquid is squeezed out by the reduction in thickness at the free side (this is reversed at the fixed side) and the liquid flows from the free to the fixed side (this phenomenon was clarified by the preliminary computations, but is omitted for want of space). However, in this example, such liquid flow due to unbending was not observed. This is because the bending strain is basically small with the maximum of $\epsilon_{zmax}$=1.4% at the surface, and further becomes smaller at the central region. From the above, it can be said that the unbending deformation does not influence the macrosegregation when the deformation is approximated by the simple bending deformation mode. Heat of Joule was admitted to generate to some extent in Lorentz force applied zone as can be seen from FIG. 29(*c*). This leads to the elongation of Zmax (length from meniscus to crater end, often called metallurgical length) from 18.6 m to 19.0 m (40 cm elongated).

When the product of current density J and magnetic flux density B is constant, the resulting electromagnetic body force (Lorentz force) f becomes constant too. However, it is desirable to make J as small as possible and increase B upon operation, because the vicinity of the center of slab remelts by the heat of Joule when J is too large. Here, on the contrary, B was decreased down to 0.5 (Tesla) and J increased up to $2.058\times10^6$ (A/m$^2$) to generate the same Lorentz force, and the effect of heat of Joule was investigated. The results are shown in Table 7, No. 4 and in FIG. 31. Compared to the computation No. 3, the effect of the heat of Joule becomes further larger, and Zmax is elongated 70 cm from 18.6 m to 19.3 m. At the crater end element, the liquid pressure is held at the positive value of 0.78 atm. Thus, it is understood that this level of the heat generation has no problem. However, if the remelting of central portion occurs, it takes time to re-solidify and the mushy zone is elongated again and the pressure drop occurs again. In such a case, it becomes meaningless to apply Lorentz force.

From this, it is desirable to increase the magnetic flux density and lower the current density. The apparatus using super conductive magnet that is able to produce a high magnetic flux density would be more advantageous from a viewpoint of economy, the save of space, etc. compared to conventional magnet. This will be mentioned again later. Also, in this example, the DC current was supplied through the whole thickness at the sides of the slab. But, practically, it is sufficient to supply only in the vicinity of the central region where the Lorentz is required and thereby make it possible to reduce the heat evolution by the heat of Joule.

It is clear from the above example that the internal defects can be eliminated by exerting the electromagnetic force by this invention for thick slabs as well.

C. On the Vertical-Bending High Speed Continuous Casting for Thick Slab

High-speed casting is taken up as the example No. 3 for carrying out the invention. In general, the productivity (given by output tons per caster per month) is determined by non-operating time, preparation time, dimensions in cross-section, casting speed, etc. Among these, the important factors are the dimensions in cross-section and the casting speed that are closely associated with the quality: Enlarging the cross-section is not worthy from a metallurgical point of view, thus much efforts have been paid to raise the casting speed. Thereupon, the case is described below that applies this invention to a high speed casting of slab that has increasingly been preferred. The specification and the operating conditions are such that the casting speed was set 2 m/min and all other parameters except for the cooling condition were set the same as those in the example No. 2 (of Table 6) for carrying out the invention.

Figure 33:
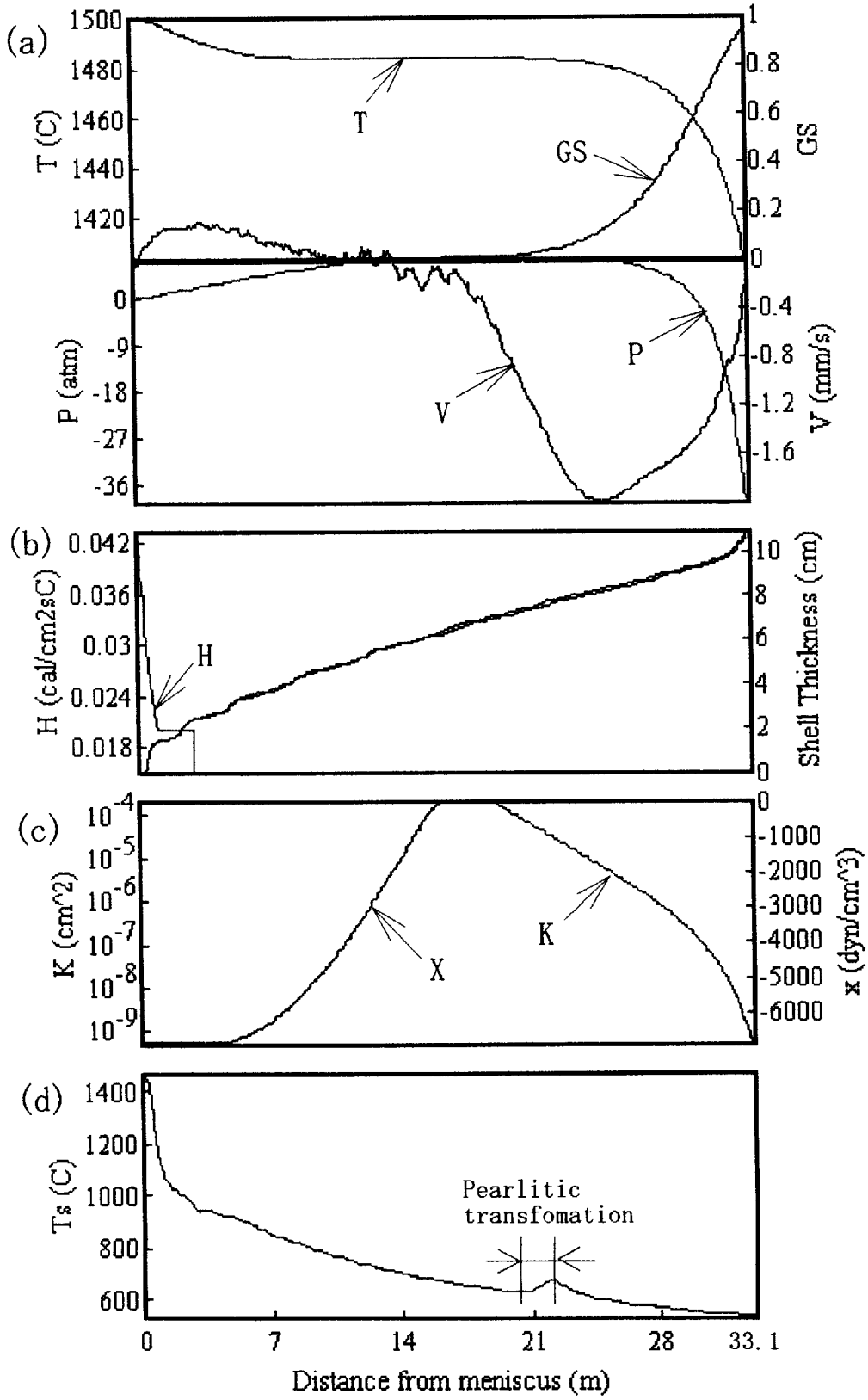
FIGS. 33*a, b, c* and *d* show the results of the computation No. 1 of the example No. 3 for carrying out the invention.

The computational results by conventional method are presented in Table 8, No. 1 and in FIG. 33.

TABLE 8

The example No. 3 for carrying out the invention: Analysis results of 0.55% carbon steel of vertical-bending high speed casting (Casting speed 2 m/min, casting temperature 1500° C. (superheat = 16°C.))

| No./Casting process | Computational condition: Porosity analy. | M length (m) | Z (max) (m) | Pmax (atm) | Porosity gv (%) |
|---|---|---|---|---|---|
| 1 Conventional | Not done | 14.5 | 33.1 | −39.2 | — |
| 2 Conventional | Done | 12.6 | 31.2 | −1.15 | 15% at center, pore diam 65 μm; 5% at both sides of the center, pore diam 60 μm |
| 3 E process: Lorentz force of 15G for Z = 30.2 to 31.7 m: B = 1.33(T) J = 7.775 × $10^5$ (A/$m^2$) Lorentz force of 34G for Z = 31.7 to 33 m: B = 3.0(T) J = 7.775 × $10^5$ (A/$m^2$) | Done | 14.8 | 33.4 | −0.16 | No porosity |
| 4 E process: Lorentz force of 8G for Z = 30.8 to 33.1 m: B = 1.38(T) J = 4 × $10^5$ (A/$m^2$) Reduction grad.: 0.1 mm/30.8 to 33.1 m | Done | 14.6 | 33.2 | 5.1 | No porosity |

Note: The meanings of Symbols, etc. are the same as in the note of Table 5

Figure 34:
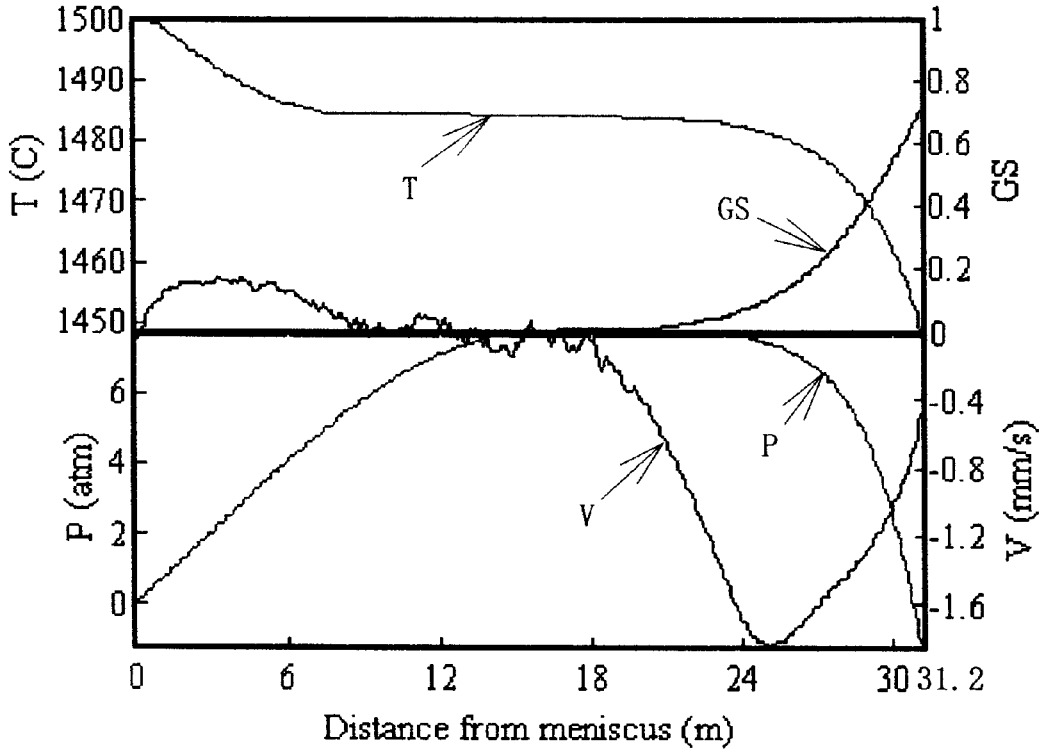
FIG. 34 shows the results of the computation No. 2 of the example No. 3 for carrying out the invention.

Zmax, 33.1 m (crater end length or termed metallurgical length), becomes 1.8 times longer in comparison with Table 7, No. 1 and the liquid pressure drop was increased to the negative value of −39.2 atm. In the computation No. 2 (Table 8, No. 2 and FIG. 34) with the porosity analysis done, about 5% (35 mm range about the center, 16% of thickness) to 15% (at the center element) porosity were formed. The size of the porosity is similarly in the range of about 60 μm to 65 μm. The Lorentz force equivalent to 22G on the average is required in the range of Z=30.2 m to 33.1 m to eliminate the porosity. Hence, dividing the negative pressure region into two zones, the Lorentz force was exerted as follows (Level 3 analysis).

No. 1 zone: Lorentz force equivalent to 15G is exerted in the range Z=30.2 to 31.7 m from meniscus. For this, the parameters are set as follows.

DC magnetic flux density B=1.33 (T)

DC current density J=7.775×$10^5$ (A/$m^2$)

Potential difference for the analytical domain in slab's lateral dir.

$$E=J\times 0.01/\sigma=0.0111 \quad (V)$$

No. 2 zone: Lorentz force equivalent to 34G is exerted in the range Z=31.7 to 33.1 m from meniscus. For this, the parameters are set as follows.

B=3.0 (T) (increased)

J=7.775×$10^5$ (A/$m^2$) (unchanged)

E=0.0111 (V) (unchanged)

Figure 35:
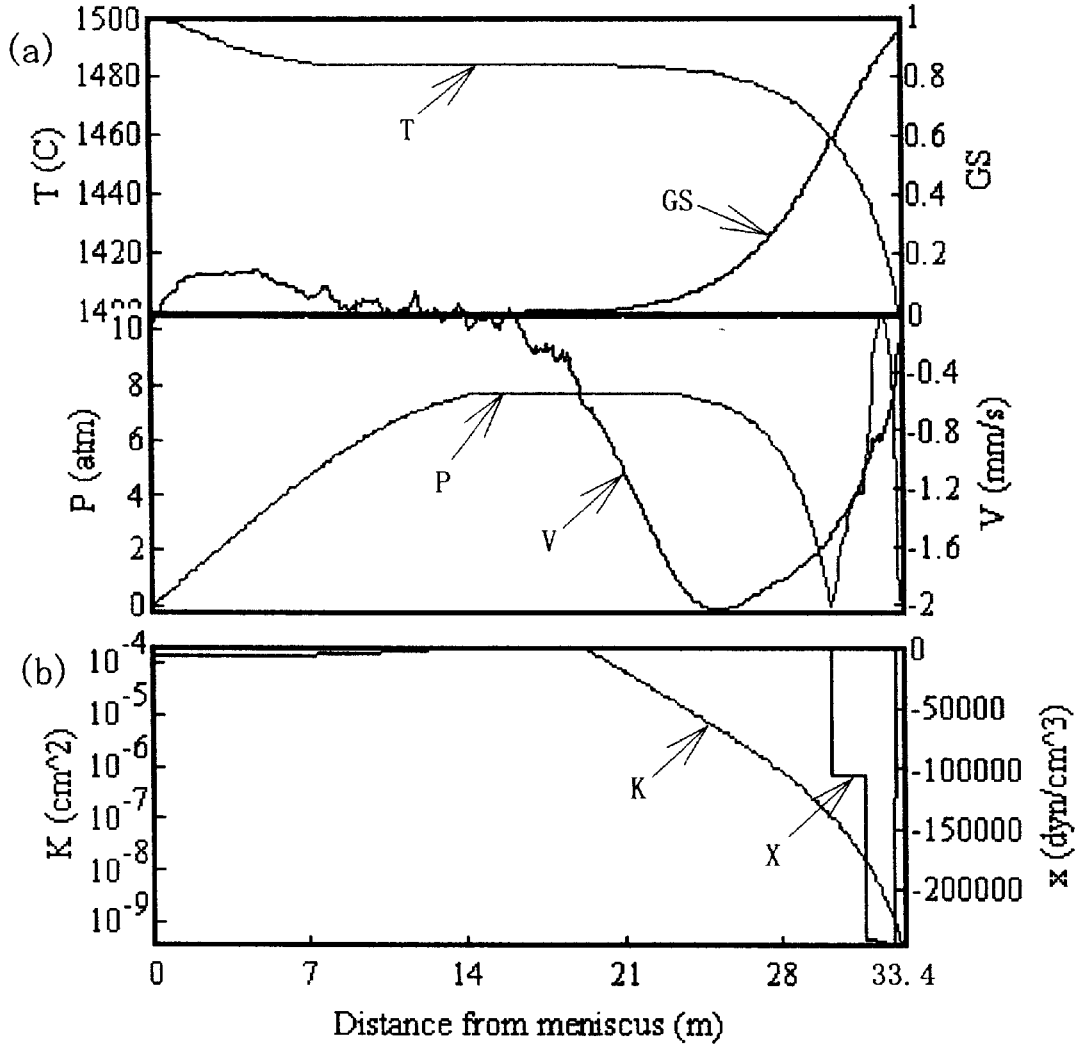
FIGS. 35*a*, and *c* show the effect of the electromagnetic body force (Lorentz force) in the computation No. 3 of the example No. 3 for carrying out the invention.

The results are shown in Table 8-No. 3 and in FIG. 35. The liquid pressure is held at P=−0.16 (atm) (absolute positive pressure of 0.84 atm) at the crater end: Therefore, no porosity or V segregation occurs. The metallurgical length Zmax was elongated from 33.1 m to 33.4 m. This is because the solidification was a little delayed by the influence of the heat of Joule. In this case, the average Lorentz force of 22G was applied over 2.8 m toward casting direction. However, it is desirable to reduce the applied range as well as the Lorentz force from the viewpoint of economy or equipment.

Thereupon, as a next logical step, it was tried to relax the liquid pressure drop by using the soft-reduction as a supplementary means and thereby reduce the required Lorentz force (by utilizing mechanical or magnetic attractive force, see FIG. 2(*d*)).

As a preparation, computations were conducted to examine the effect of soft-reduction with the results shown in FIG. 36(*a*) to (*c*). FIG. 36(*a*) shows the reduction distribution necessary to completely compensate the solidification contraction. Upon the calculation of the reduction distribution δ, the position where the volume fraction of solid $g_S$ at the center element becomes 0.1 (or any number would do) was set as the reference position (in this particular case, Z=25 m), and the volume contraction due to solidification was calculated in the mushy zone. Finally, the δ distribution was obtained by taking δ=0 at the reference position and by equating this volume contraction to δ in the thickness direction of the slab. Thus, taking Δδ as the increment of the reduction quantity during Δt, $$\Delta\delta = \frac{\Delta t}{S}\sum_i \beta(i)\dot{g}_S(i)V(i). \quad (73)$$

Figure 37:
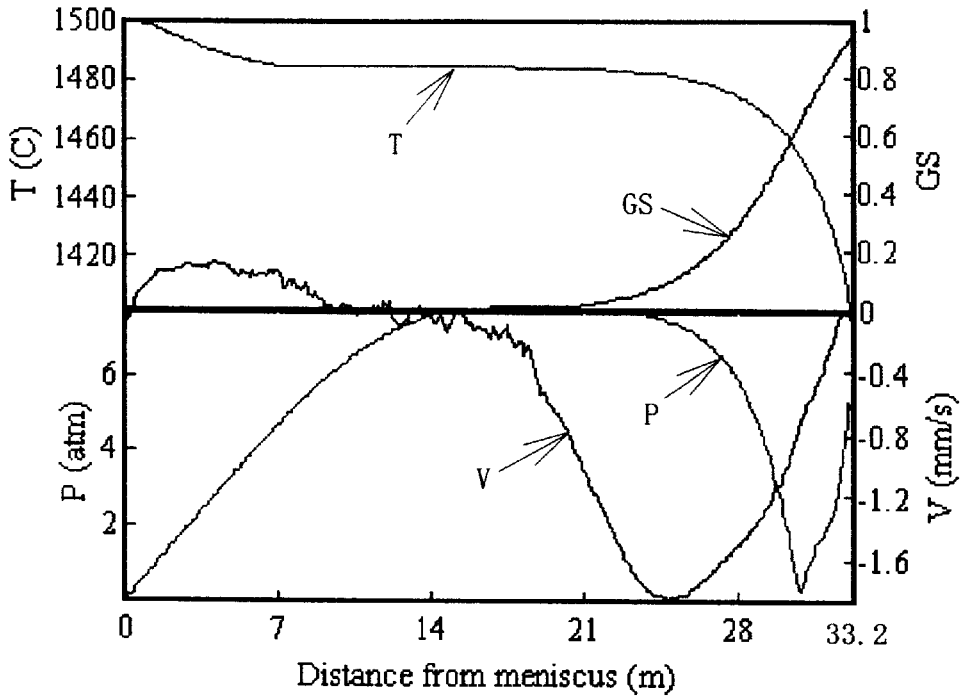
FIG. 37 shows the combined effects of the electromagnetic body force (Lorentz force) and the soft-reduction in the computation No. 4 of the example No. 3 for carrying out the invention.

Where, S is the cross-sectional area perpendicular to thickness direction of volume element, β is the solidification contraction, $g_S$ is the solidification rate, V is the volume of element and the suffix i denotes the mushy element in the thickness direction. Next, in reference to the calculated reduction distribution, the actual reduction gradients were given as shown in FIG. 36(*b*) and the computational results obtained was presented in FIG. 36(*c*) which shows the degree of relaxation of liquid pressure drop in the vicinity of the crater end. In the light of the above results, the reduction gradient of 0.10 mm/30.8 to 33.1 m was given simultaneously with the Lorentz force of 8G in the same range. The result is shown in Table 8-No. 4 and in FIG. 37. The defects disappeared completely. The applied range of Lorentz force in the casting direction was shortened 50 cm compared to the computation No. 3 with only Lorentz force exerted, and the required Lorentz force decreased down to about one third, thus indicating that even slight reduction gradient is considerably effective.

In relation to this example, the advantages and cares, etc. are discussed below upon applying this invention.

(1) On the Soft-Reduction Gradient.

The reduction gradient given to the computation No. 4 is smaller than the value to compensate the net solidification contraction, and the contraction of the cast piece due to the temperature drop toward casting direction and the deformation due to thermal stress are not considered. Accordingly, the real reduction quantity will be bigger than the value of this example. As mentioned in the Background Art, because the reduction gradient employed by present soft-reduction method aims to completely compensate the solidification contraction, it is generally larger than that described in this description. Therefore, a possibility is pointed out in Ref. (27) that when the strains in the mushy zone becomes larger than a certain limit, the dendrite crystals are destroyed mechanically and the high solute concentration liquid is sucked to give rise to internal cracking (there are much questions about the detailed mechanism).

The soft-reduction by the definition of this description is such that "the reduction quantity is fairly small (therefore less than the above-mentioned strain limit), and utmost is used as a supplementary means to relax the liquid pressure drop". In other words, the interdendritic liquid feeding by the Lorentz force plays a major role. Accordingly, it may be said that there is no possibility of the internal cracking that often brings about a problem in conventional soft-reduction method.

(2) On the Relation Between the Hydrogen Induced Cracking and the Central Segregation under Sour Gas Environment.

Since large diameter of line pipes to transport petroleum and natural gas are served under severe environments such as in the underground, the sea bed, cold district, etc., excellent properties are demanded for toughness and fracture characteristics as well as strength. If the hydrogen coming out from the humid $H_2S$ atmosphere in these crude oil and gas penetrates into the pipes and is trapped by the central defects (that formed during continuous casting and remained in the final production), so called HIC (hydrogen induced cracking) occurs. The corrosion resistance for this $H_2S$ is in general called sour resistance and has become an important technical matter since the accident by HIC of the transportation pipe in the Arabian Gulf sea bed in 1972 (Ref. (28)).

One of the measures taken for the HIC at present is to adjust the chemical compositions to eliminate HIC, admitting the central segregation (and porosity) as an unavoidable reality. For example, in Ref. (29), the chemical compositions are adjusted so that the HIC sensitivity parameter PHIC given by Eq. (74) becomes less than 6 with special attention paid to the HIC sensitive elements C, Mn and P.

$$P_{HIC}=C_{eq}^{*}+2P^{*}\leqq 0.6 \text{ (wt \%)} \tag{74}$$

Where, $C_{eq}^{*}$ is the equivalent carbon content given by Eq. (75). P* is segregated P concentration. $S_M$ denotes the degree of segregation of element M (>1).

$$C_{eq}^{*}=S_C\cdot C+S_{Mn}\cdot M_n/6+(S_{Cu}\cdot Cu+S_{Ni}\cdot Ni)/15+(S_{Cr}\cdot Cr+S_{Mo}\cdot Mo+S_V\cdot V)/5 \tag{75}$$

Take the case of API (American Petroleum Institute) standard X65 class (meaning the proof stress of more than 65000 psi (448 Mpa)) for example. To satisfy the specification of this steel, C and P were set significantly small values of C=0.03 and P=0.004 (wt %) according to this criterion, respectively and besides the compositions of Cu, Ni, etc. were severely controlled. Furthermore, special care was paid to the thermo-mechanical treatment.

The sensitivity parameterPHIc becomes 0.53 and $C_{eq}^{*}$= 0.33 from the same reference. If there is no segregation, these values becomes $P_{HIC}$=0.298, $C_{eq}^{*}$=0.29.

Applying this criterion to the above example No. 2 and No. 3 for carrying out the invention of 0.55% C steel and assuming no segregation by the use of this invention, $P_{HIC}$ becomes 0.715. PHIC decreases to 0.365 when only C is decreased to 0.2% (however, infinitesimal additions of Cu, Ni, Cr, Mo, V are not included). This means that if the segregation is eliminated, the severe control over the chemical compositions, etc., become unnecessary and that the degree of freedom for balancing the compositions expands substantially.

Considering that the demand for the strength of these line pipes is growing from X70 class to X80 class and further beyond these and at the same time stronger resistance in HIC and SSC (sulfide stress cracking), weldability and so on are increasingly demanded, the meaning of expanding the degree of freedom for the balance of compositions is significant. The relationship between compositions and mechanical properties is omitted here for want of space. However, it is relatively easy to fulfill these demands, considering the fact that high strength materials have been developed one after another. In conclusion, it can be said that such severe demands can be fulfilled by eliminating the central defects via this invention. At the same time, adjustment over the compositions becomes possible; as for this case lowering C content.

(3) With respect to the function f(T) for the 0.55% C steel in Eq. (34), it was determined from the TTT diagram of Ref. (30) as follows.

$$f(T)=3.547\times 10^{-12}\cdot\left(\frac{T-300}{100}\right)^{14.53}\left(\frac{760-T}{100}\right)^{13.62} \tag{76}$$

Figure 38:
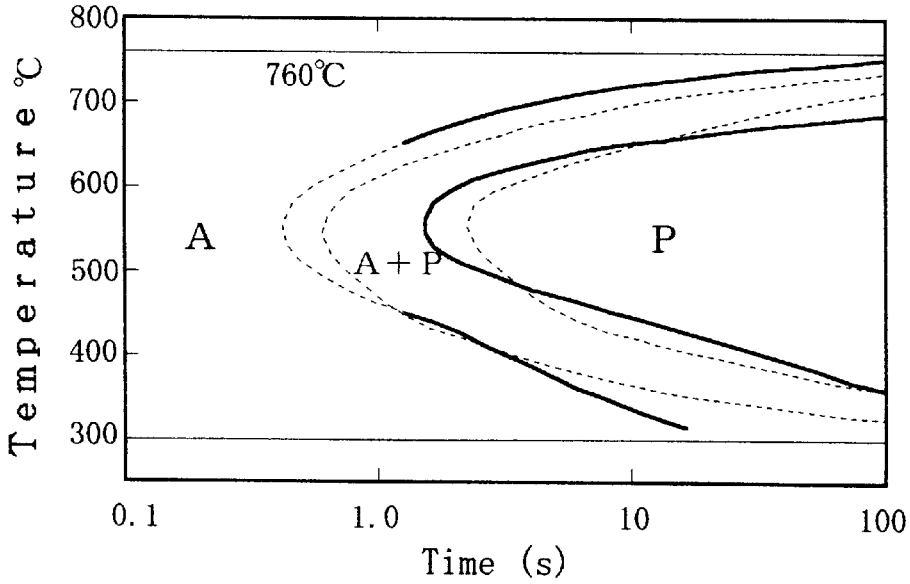
FIG. 38 shows the TTT diagram of 0.55% carbon steel where the symbol A denotes austenite and P pearlite. The solid lines indicate experimental data (from Ref. (30)) and the broken lines the calculated values using eqs. (34) and (76) in this description (Ref. (21)). The start and end of the transformation is defined as the volume fraction of pearlite becomes $g_P$=0.01 and $g_P$=0.99 respectively.
Figure 42:
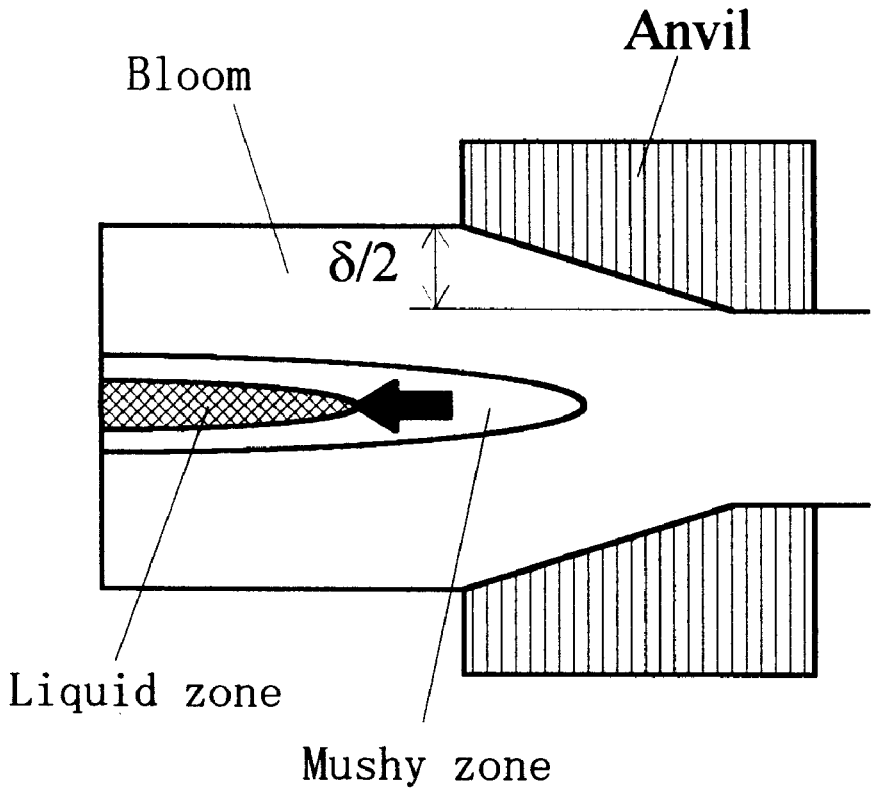
FIG. 42 is the schematic diagram of conventional continuous forging method. Shown is the flow manner in which the liquid phase in the solid-liquid coexisting zone is squeezed by anvils to the upstream. δ indicates reduction quantity.

The TTT diagram obtained from Eqs. (34) and (76) is shown in FIG. 38 along with the experimental data. Both agree relatively well. In the case of this computation, the surface temperature fell off to 540° C. and resulted in 100% pearlitic transformation at the surface elements (thickness 11.6 mm) in the range: Z=18.7 m to 22.5 m (the crater end). The recalescence of the surface temperature Ts of FIG. 33(*d*) is attributed to the latent heat of pearlitic transformation.

(4) Here, the attractive force generating between two coils was examined when using superconductive magnet. The model used is shown in FIG. 39(*a*). For the convenience of the computation, the coils are assumed circle and the total current I (=current in a superconductive wire×the number of turns) in the coil are assumed a point current as shown in the figure (in practice, it has a finite cross-sectional area). The cast piece exists between the two coils, but is regarded same as air. The magnetic flux density $B_Z$ at the center axis of Z=b/2 is given by the following equation (refer to standard text book, for example, Saburo Adachi "Electromagnetic Theory", Shokohdo (first edition, 1989), p.79 and p.89).

$$B_z=\frac{\mu_0 a^2 I}{(a^2+b^2/4)^{\frac{3}{2}}} \text{ (Tesla)} \tag{77}$$

Where, $\mu_o=4\pi\times 10^{-7}$ (H/m) is magnetic permeability of vacuum. On the other hand, the force in Z direction that the current of coil 2 receives by the magnetic field that coil 1 makes is given by the following equation.

$$F_Z=-2\pi a I B_r \text{ (N)} \tag{78}$$

Where, $B_r$ is the component in r direction of the magnetic flux density on coil 2 and is given by the following equation by using vector potential $A_\theta$ (the θ direction component).

$$B_r = -\frac{\partial A_\theta}{\partial z} \quad (79)$$

(Regarding $A_\theta$, refer to Naohei Yamada et al. "Exercise on Electromagnetic Theory" (1970), p.159 [Corona Company Ltd.] for example.) The results obtained using Eqs. (77) to (79) is shown in FIG. 39(*b*). a was fixed at 0.8 m and $B_Z$ was set 1, 2 and 3 (T). The figure shows the relationship between the pressure P (the value of $F_Z$ divided by area $\pi a^2$) between the coils and the distance between the two coils.

The aforementioned calculation uses the parameters that hypothesized actual operation, and shows that it is possible to control the pressure exerted on the cast piece by controlling the magnetic flux density, i.e., the coil current and the distance between the coils. The strength of dendritic skeleton in the mushy zone is in the range of several Kg/cm$^2$ to 50 Kg/cm$^2$ (p.72 of Ref. (27)). Hence, it can be said that it is possible to give a very small reduction gradient by utilizing the gravity (attractive force) between the coils (refer to FIG. 2(*d*)). For example in the case of example No. 3 for carrying out the invention, the volume fraction of solid $g_S$ at the central portion is 0.65 or more in the soft-reduction range of 30.8 m to 33.1 m. Then, judging from the strength of dendrite skeleton as above-mentioned, it is possible to give a prescribed soft-reduction gradient by setting the distance between the coils of 0.6 m and B=1 to 2 (T). Prior to a practical application, it is necessary to obtain in advance the empirical relationship between the magnetic attractive force and the reduction gradient on a real machine with the electromagnetic booster equipped (refer to FIG. 40). Then, the magnetic attractive force may be applied for prescribed reduction gradient in reference to thus obtained relationship. Since non-defect is guaranteed by the liquid feeding by Lorentz force with the soft-reduction used as a supplementary means to relax the liquid pressure drop, it is enough to control the magnetic attractive force within a certain degree of allowance (strict control is not necessary).

D. On the Bending Type Continuous Casting of Bloom

The bending type continuous casting of bloom is taken up as the last example. The material used is the same 0.55% carbon steel as the example No. 2 for carrying out the invention, and also the chemical compositions and the oxygen content were set the same values. The cross-section is that of rectangular with thickness 300 mm×width 400 mm, the bending radius of the curvature of the machine was set 15 m, the length of the mold 1.2 m and the length of the water-mist spraying zone below the mold 4 m.

Figure 55:
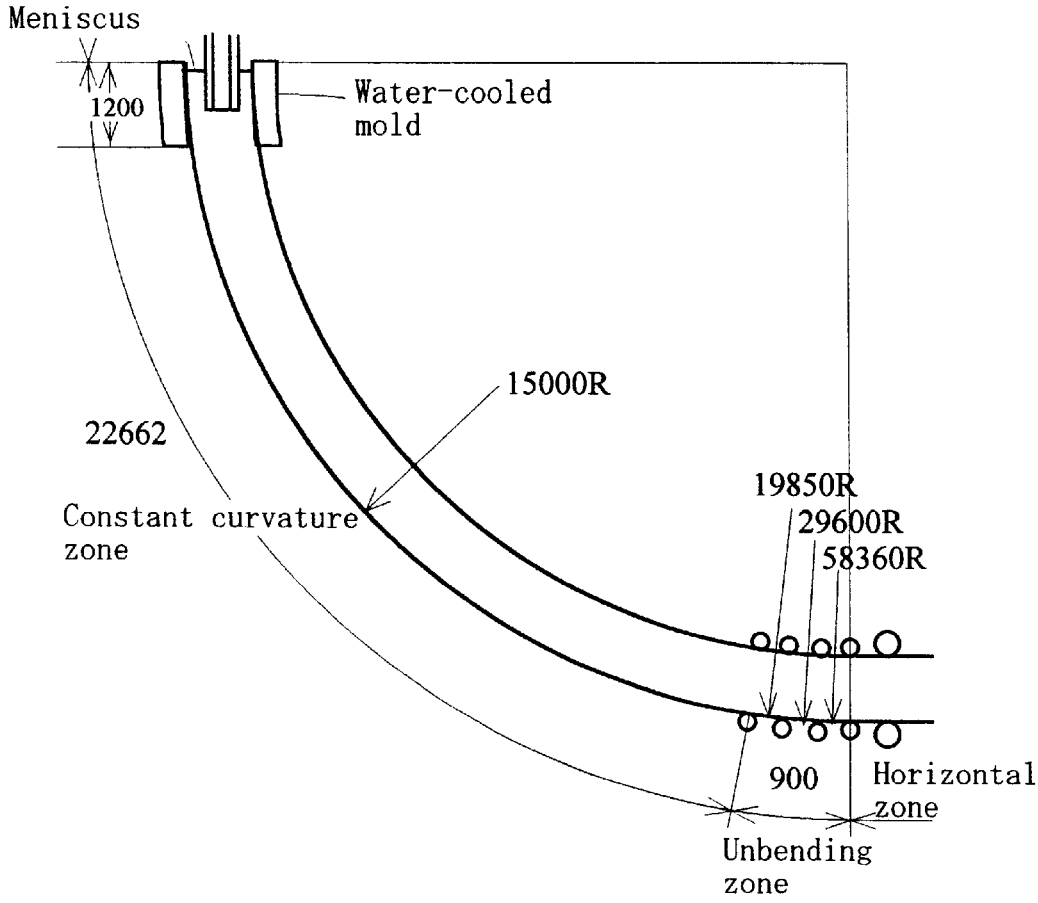
FIG. 55 is the outline of the bending type bloom caster used for the example No. 4 for carrying out the invention. Rolls other than the unbending rolls are not shown.

With respect to the bending type caster, the radius of curvature at the mold is the same 15 m. Accordingly, the cast piece undergoes only unbending deformation at the unbending zone and the radii of curvature between unbending rolls were set as shown in FIG. 55 such that the cast piece undergoes evenly with 4 steps of bending strain (total strain of 150 mm/14850 mm (radius of curvature at neutral axis)= 0.0101). The casting temperature was set 1500° C., same as the example No. 2 for carrying out the invention. The casting speed was set 1 m/min. Above specification and the operating conditions are those generally used in this kind of bloom castings.

3-dimensional analysis by Level 3 was conducted considering that the heat flow pattern becomes that of 3 dimensional in bloom. The computational domain was partitioned uniformly into 15 elements in radial direction (partition width=total thickness of 300 mm/15=20 mm) and the partition length in casting direction was set 150 mm. Considering symmetric nature in width direction, the computational domain was taken half the width and partitioned uniformly into 5 elements (200 mm/5=40 mm). The heat transfer coefficient at mold-cast piece boundary in the mold was set as h=0.03−0.00146$\sqrt{Z}$ (Z distance from the meniscus) (cal/cm$^2$s° C.), h=0.015 in water cooling zone, h=0.005 in natural cooling zone.

The physical properties used are the same as example No. 2 for carrying out the invention. The correction factor regarding the specific surface area of dendrite Sb was also set $\alpha$=1 (no correction).

Figure 56:
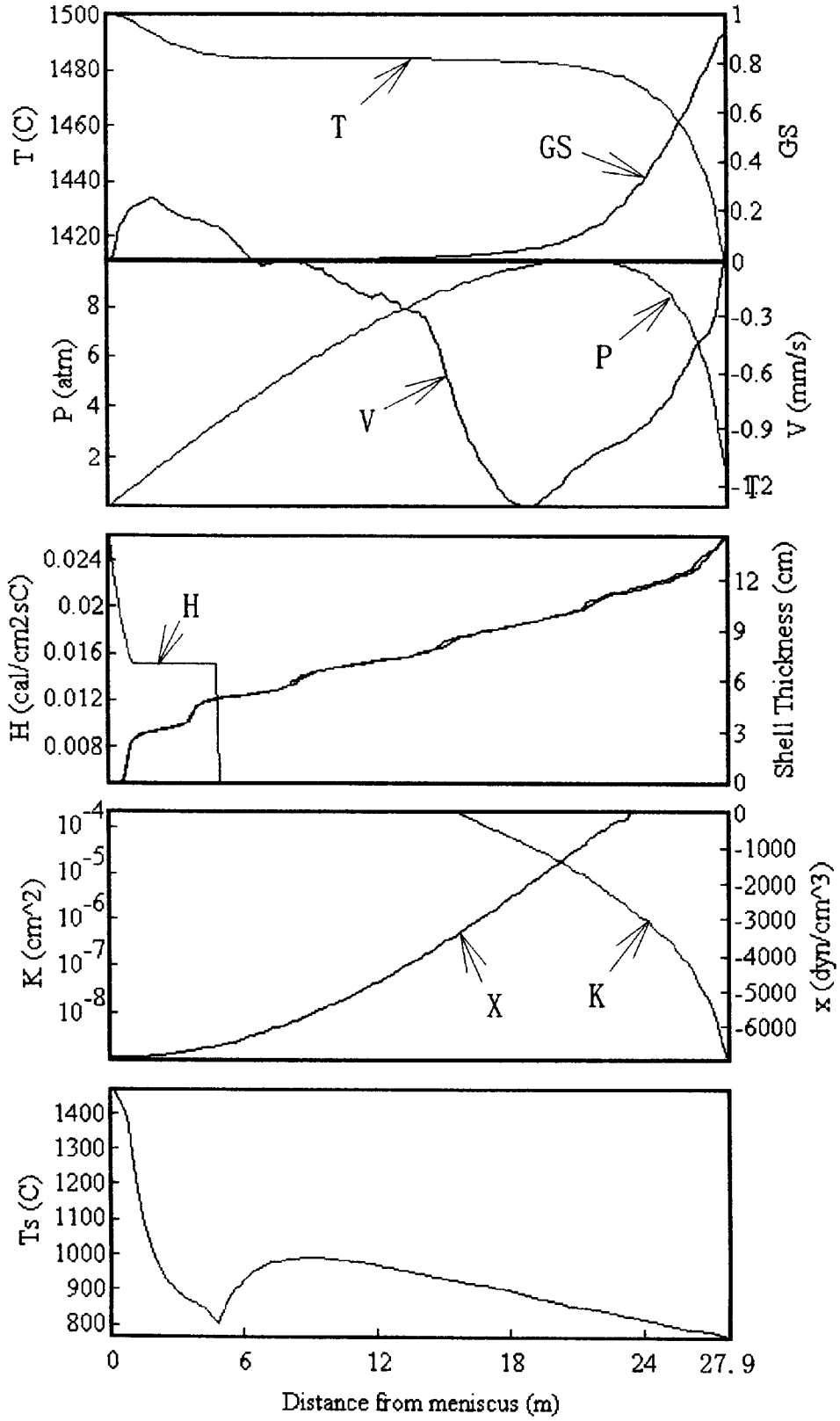
FIG. 56 shows the results of the numerical analysis of conventional casting method for the example No. 4 for carrying out the invention.

The results of the numerical analysis by Level 3 for a conventional casting method are shown in FIG. 56. The length of mushy zone is 14.1 m, the crater end length Zmax is 27.9 m and 5.6 vol % of porosity with the pore size of about 54 $\mu$m was formed at Z=27.82 m in the center element (thickness 20 mm×width 40 mm): Thus it was judged that the central defects were formed.

The Level 2 analysis was done to obtain the Lorentz force to eliminate the central defects, from which it was found that the Lorentz force equivalent to 18G was necessary in the range of Z=27.6 to 28.05 m. Hence, the Lorentz force was exerted in the range of Z=27.3 to 28.05 m as follows.

$$F=J\times B=10^6(A/m^2)\times 1.2(T)=1.2\times 10^6(N/m^3)$$

Figure 57:
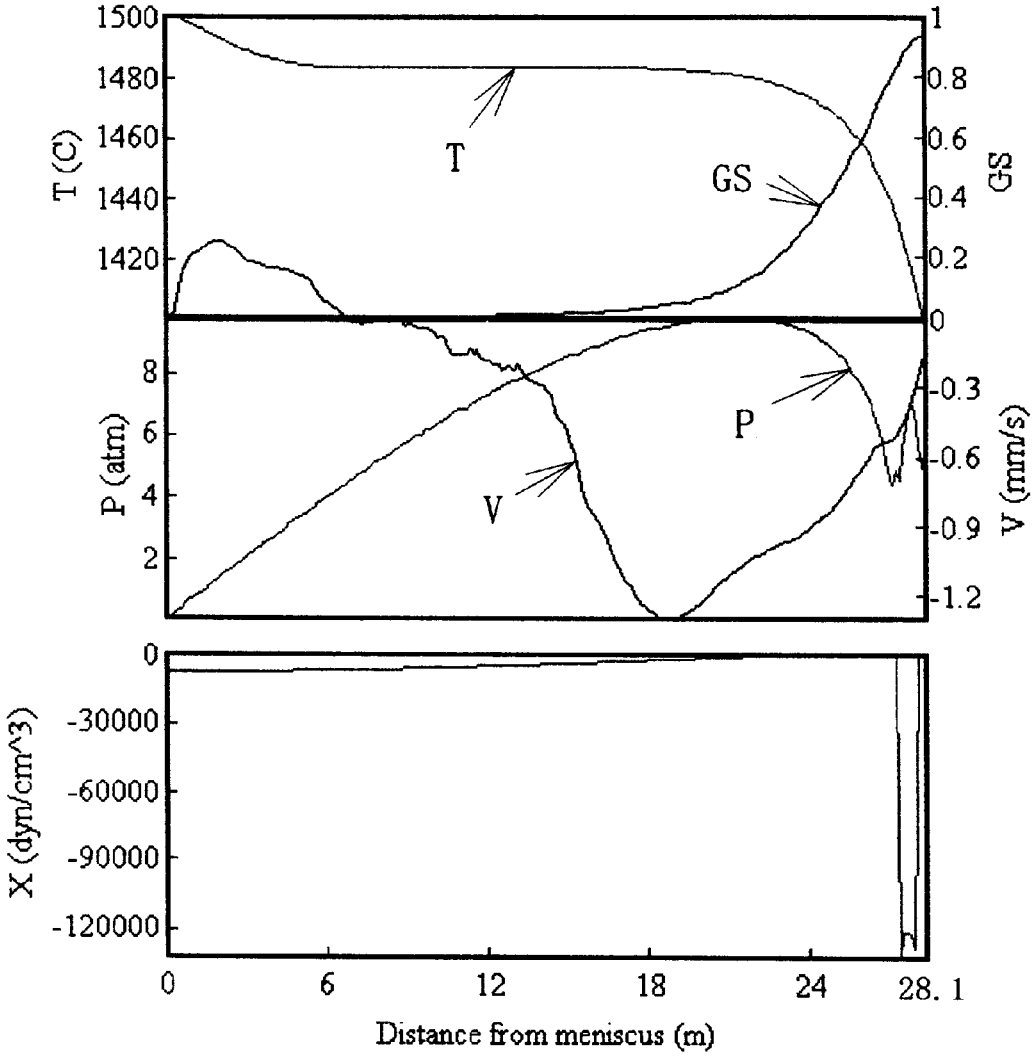
FIG. 57 shows the effect of electromagnetic body force in the example No. 4 for carrying out the invention.

The cross-sectional area at the electrode side of the bloom was set at width 140 mm×length 750 mm, considering that the solid-liquid coexisting zone exists in relatively narrow range of the cross-section. The current lines become considerably uniform in the relatively narrow range of the central mushy zone about the center between the electrodes attached at both sides. The current pattern spreads in the thickness and longitudinal directions of the cast piece to some extent. The current that flows through the same cross-sectional area at the central part of the cast piece as that at the electrode was 65% of the total current [in 3 dimensional computation of the current field, all surfaces except for the electrodes are assumed insulated]. The results obtained are shown in FIG. 57. The liquid pressure is held at sufficiently large positive pressure in the vicinity of the crater end: Thus, the central defects do not form.

E. Specific Example of Electromagnetic Booster

In this section, more detailed mechanisms of the electromagnetic booster are discussed that exerts the electromagnetic force generated by DC current and DC magnetic field as already described in the above four examples for carrying out the invention. Also, the specific mechanisms of the combined system of the electromagnetic force and the soft-reduction method will be shown. And, the mechanism to reduce the tensile force produced in cast piece by the electromagnetic force is described.

First, superconductive coils are used as the means to generate the DC magnetic field, and a single pair or plural number of pairs of coils are arranged in such a way that the cast piece is placed between the coils. As for blooms and billets whose lengths in short side and long side of the cross-section are relatively close, the racetrack type cols elongated in casting direction are basically used. On the other hand, racetrack type coils broadened in lateral direction are used-for wide slabs correspondingly. Because the superconductive coils need to be cooled to liquid helium temperature (4.2K) at present, they are enclosed in the cooling container consisting of liquid helium, etc. Also, the reaction force corresponding to the Lorentz force in casting direction is exerted on the coils. Therefore, these points should be taken into consideration upon designing. Also, because the attractive force is generated between the coils when DC current flows, it is necessary to enclose the coils into highly rigid frames which are fixed by plural number of supporting columns.

Next, as a means to supply DC current at both sides of the cast piece, the plural number of sliding electrodes fixed at space are arranged to contact with the side surfaces of the cast piece. Thin oxidized layer consisting of Fe as main component forms at the casting surface. Since this layer is an insulator, it is desirable to remove it by means for cutting, etc. Also, as a means to enhance the contact at the electrode-side surface boundary, the plane cutting is used in this invention. Further, to prevent the re-oxidization of the cut plane, the cut surface is blocked from the atmosphere by using inert gas such as argon, $N_2$ or reductive gas, etc.

The soft-reduction gradient is given through a plural number of rolls, and the pressurizing devices by means for the fluid such as oil are adopted to the bearing unit of each roll so that an optional reduction distribution can be given by controlling them independently. It is necessary to reduce the distance between superconductive coils as small as possible to obtain a strong magnetic field. Thus, it is important to make the diameter of rolls smaller. As to the rolls for blooms and billets, it is desirable to use the rolls whose central part swelled out to be able to effectively give the reduction onto the central mushy zone and to avoid cracking caused by unnecessary plastic deformation at the corners. As to wide slabs, conventional flat roll can be used. Also, it is good to use so-called divided roll which is divided into sub-rolls in the longitudinal direction of the roll to minimize the bending due to reduction force or thermal stress.

If the Lorentz force toward the casting direction is too strong, it gives rise to the tensile stress in the cast piece with mushy zone and may result in internal cracking. As a means to reduce the excessive tensile force, the drawing resistance created as a result of soft-reduction may be taken advantage of. Besides that, driving device may be equipped with to these rolls.

The above is the main mechanical means by which it becomes possible to control the current density distribution and electromagnetic force distribution appropriately. It also becomes possible to give desired reduction gradient.

It was shown in the above example No. 3 for carrying out the invention that the required Lorentz force to eliminate the central defects can be reduced by giving the soft-reduction gradient as a supplemental means. This principle can of course be applied to blooms, etc. In other words, by suitably balancing both of them, it is possible to adjust the balance of the drawing resistance due to the soft-reduction and the Lorentz force toward casting direction as well as to eliminate the central defects. The balance between them changes depending on machine profile, and operating parameters such as casting speed, shape of cross-section of cast piece, steel grade and so on.

In the case that both forces are balanced, the tensile force that occurs in the solid part of the solidifying shell due to the electromagnetic force is counterbalanced (from macroscopic point of view). When the drawing resistance is large enough compared to the electromagnetic force, the driving force by the rolls may be given toward the casting direction. On the contrary, when the electromagnetic force is too large, giving rise to a large tensile force in the solidifying shell, the rotating speed of the rolls are regulated to correspond to the casting speed. In this case, the reversed torque is exerted onto the rolls and works as a brake: Thus, the tensile force in the solidifying shell can be counterbalanced.

In summary, the electromagnetic apparatus by this invention has the following three functions.

Function I Electromagnetic force alone

Function II Combination of electromagnetic force +soft-reduction

Function III Combination of electromagnetic force +soft-reduction+roll-drive

By utilizing these functions properly, individual purposes (sound cast piece with no defects/high speed casting) can be realized.

Specific Example 1: Application to Bloom and Billet

Figure 1:
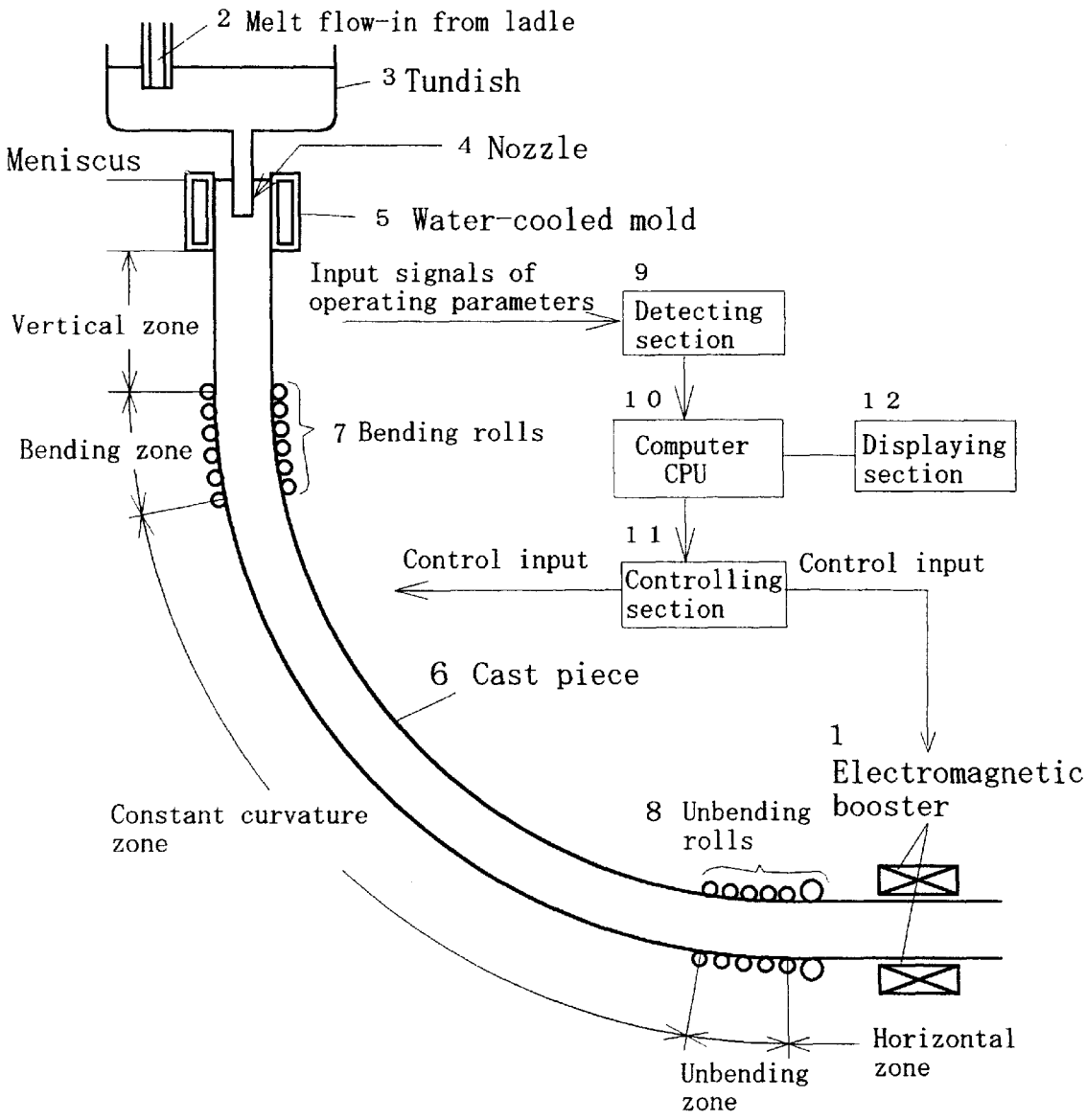
FIG. 1 is the schematic diagram composing the Electromagnetic Continuous Casting system by this invention.

The specific example applied to steel bloom or billet is shown in FIG. 58. With respect to machine profile, vertical-bending type or bending type is most widely used as schematically shown in FIG. 1. FIG. 58 shows the case that the electromagnetic booster is located in the upstream vicinity of the final solidification zone (crater end) at the horizontal zone of cast piece. FIGS. 58(*a*) is the cross-sectional plan and (b) is AA cross-sectional plan in longitudinal direction. The arrow in the diagram denotes the casting direction. The view from the top, BB cross-section, is shown in FIG. 59.

Symbol 6 in the figure denotes the cast piece and Symbol 102 denotes the electrode located at both sides of the cast piece that contacts with the side surface. The electrode is fixed to the frame 107 (details not shown) with spring 106 and slides against the moving cast piece. The plural number of electrodes is arranged over the Lorentz force zone as shown in FIG. 58(*b*). Each electrode is independent. The smaller the interval between each electrode, the better.

The connection type of the electrodes is shown in FIG. 60. FIG. 60(*a*) is a parallel type and the current density that flows through each electrode is roughly equal (contact resistance is assumed constant). FIG. 60(*b*) is a series type that is suitable for the case that the current density is changed, for example, when increased density is favored in the downstream side.

FIG. 60(*c*) is a mixed type of (a) and (b), and the current is set for each parallel group. Also, it is possible to change individual current density at electrode by changing the material of electrode. These can be selected depending on the situation.

Figure 62:
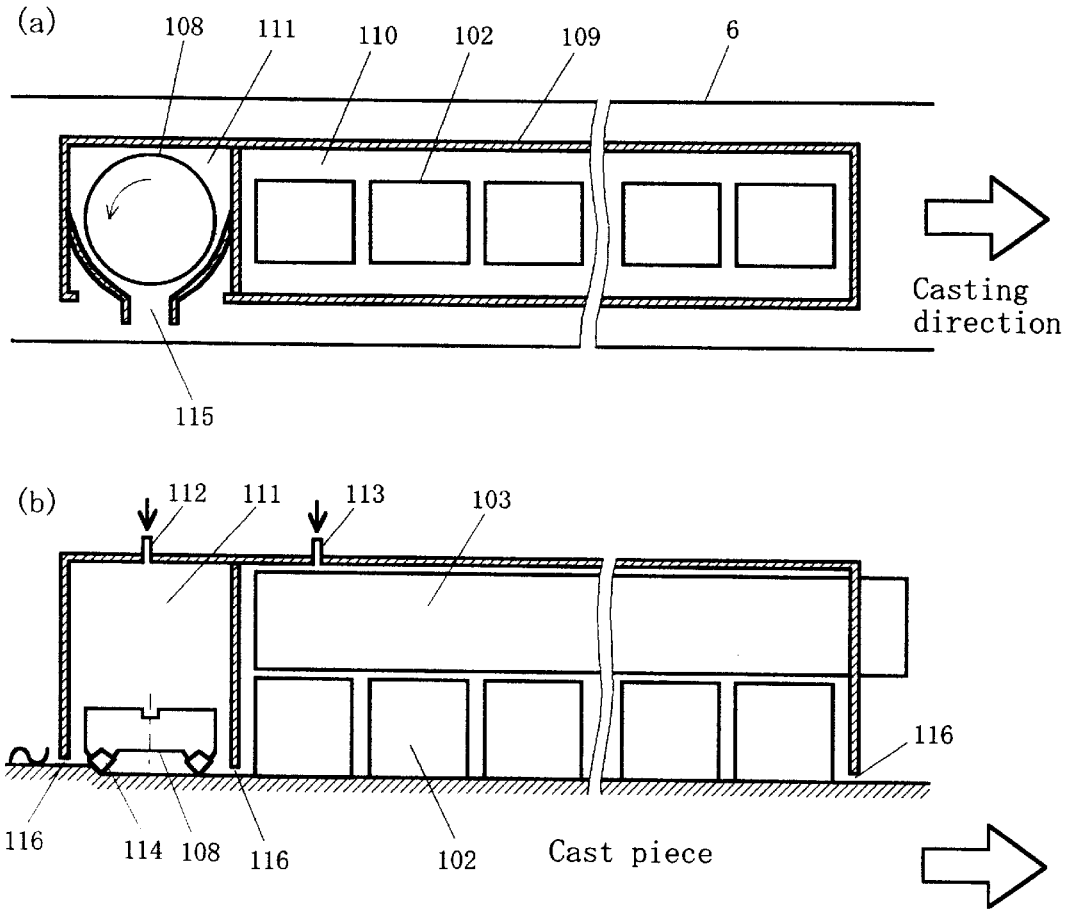
FIG. 62 shows a situation that a gas shield box is attached to prevent oxidization. (a) shows the side view and (b) the ground plan. Symbol 108 denote shows plane milling tool.

The individual electrode is stored in box 105 of insulation nature and is connected to L-type bus bar 104 and plate bus bar 103. The bus bar 103 shown in the BB cross-section of FIG. 59 corresponds to the parallel type of FIG. 60(*a*). FIG. 62 shows the situation where gas shield box 109 to prevent the oxidization at the electrodes and plane cutting milling machine 108 are attached. FIG. 62(*a*) is that of side view, (b) is that from the top. Symbol 110 denotes the electrode box room, Symbol 111 the milling machine box room and both rooms are divided. 112 and 113 are gas inlets. The oxidation-preventing gas is released little by little from the gap 116 after the air in both rooms are exchanged with it. Plural number of cutting tools 114 are attached to the milling machine. 115 is discharging outlet of cut chips. Gas inlet box is not shown to avoid the complexity in FIG. 58.

Symbol 120 in FIGS. 58 and 59 is racetrack type coil wound by superconductive wires and is built in to the stiff frame 122. 121 is a cooling chamber for the coil and cooled to liquid helium temperature (4.2K). Since upper frame 117 and lower frame 118 are heated by the radiation from high temperature cast piece, etc., it is desirable to insert cooling chamber 123 between these frames and rigid frame 122.

The upper frame 117 and lower frame 118 are supported by pillars 119, movable up and down, and can be locked at a specified position. Since these frames and pillars are burdened with the magnetic attractive force between the coils, the reaction force by reduction roll, etc., it is necessary to take the modulus of section large enough to reduce elastic deformation due to bending, etc. to minimum extent. Also, nonmagnetic materials such as stainless steel may be used. Since the rigid frame 128 is burdened with the reaction force corresponding to the Lorentz force acting in casting direction, the drawing resistant force due to soft-reduction, etc., it is necessary to give large stiffness, make movable in the longitudinal direction and lockable. Since these mechanisms are available and feasible by known technology, the detailed mechanisms are not shown in this description.

Figure 61:
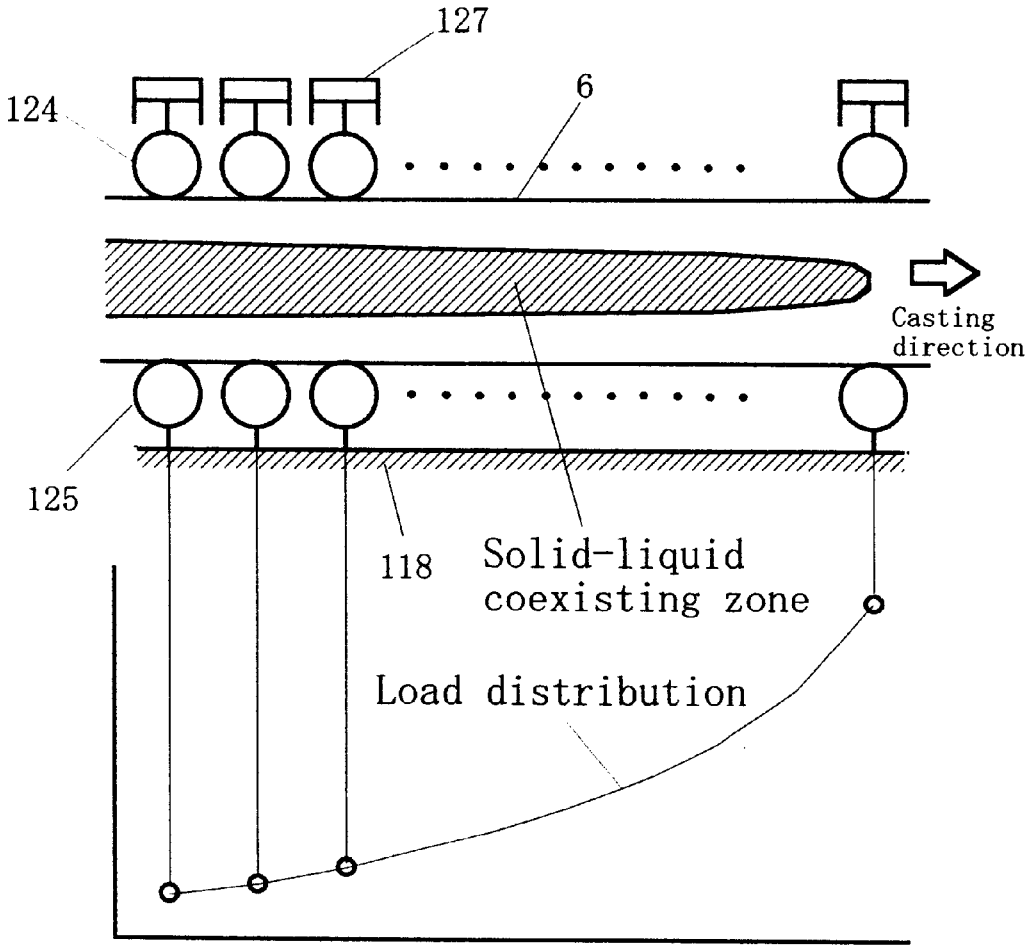
FIG. 61 shows an example of the load distribution when soft-reduction gradient is given to cast piece.

Symbols 124 and 125 are the roll to give a small amount of reduction gradient. The roll is attached with roll crown at the central part to avoid unnecessary and detrimental plastic deformation at the corners of cast piece and also to effectively transfer the compressive deformation onto the central mushy zone. In the case of this example, the reduction is done by oil-hydraulic cylinder 127 that is attached to upper bearing unit. The oil-hydraulic cylinder is not necessarily attached at upper side. The plural number of rolls are arranged in the longitudinal direction and the reduction force is independently controlled by each roll. The prescribed amount of reduction is to be given by the reduction force. Generally speaking, the reduction force needs to be increased as it goes downstream with thicker solidified layer as shown in FIG. 61. Since the amount of reduction is small (the order of solidification contraction in mushy zone), the stroke of oil-hydraulic cylinder may be small and therefore the length of cylinder may be short. Care must be taken on the occasion of a detailed design so that the strokes of both sides of the cylinder become equal or even if a little difference occurs, there be no obstacle in the operation.

Furthermore, the roll is equipped with the driving unit (usually at the lower roll). The number of driving rolls may be determined by the magnitude of required driving force, etc. The detail of the driving unit is not shown here because it can be easily assembled by known technology.

Next, the relation of the distance between superconductive coils and the width of the coil is stated. It is understood that the distance between the coils b may be reduced to obtain a stronger magnetic field from above-mentioned Eq. (77). Also, the coils with the relation of a=b is called Helmholtz-type which is possible to obtain highly uniform magnetic field.

Specific Example 2: Application to the Case Where the Distance Between Coils is Shortened.

Considering this point, the width of the coil was expanded and the distance between the coils was shortened to obtain a stronger magnetic field compared to Specific example 1. The cross-sectional view is shown in FIG. 63(*a*). For this, the distance between the coils was shortened by setting up spaces in the upper frame 117 and the lower frame 118 to house the roll units. If the distance between the coils is too short, the coils collide with or approach too close to the cast piece at the position where the coils cross the cast piece. In such a case, horse-saddle type coil may be used to secure a necessary space at both ends of the coil as shown in FIG. 63(*b*).

This example is basically applied to the case where the driving units of rolls are not required by properly adjusting the balance of the Lorentz force and the drawing resistant force due to soft-reduction (Function II of the above-mentioned). [If the roll drive is inevitably needed, it will become possible to chain-drive toward longitudinal direction of the cast piece by attaching gears to the roll edges.) Other mechanisms are similar with those of the specific example 1 (omitted).

Specific Example 3: Application to Slab

Figure 64:
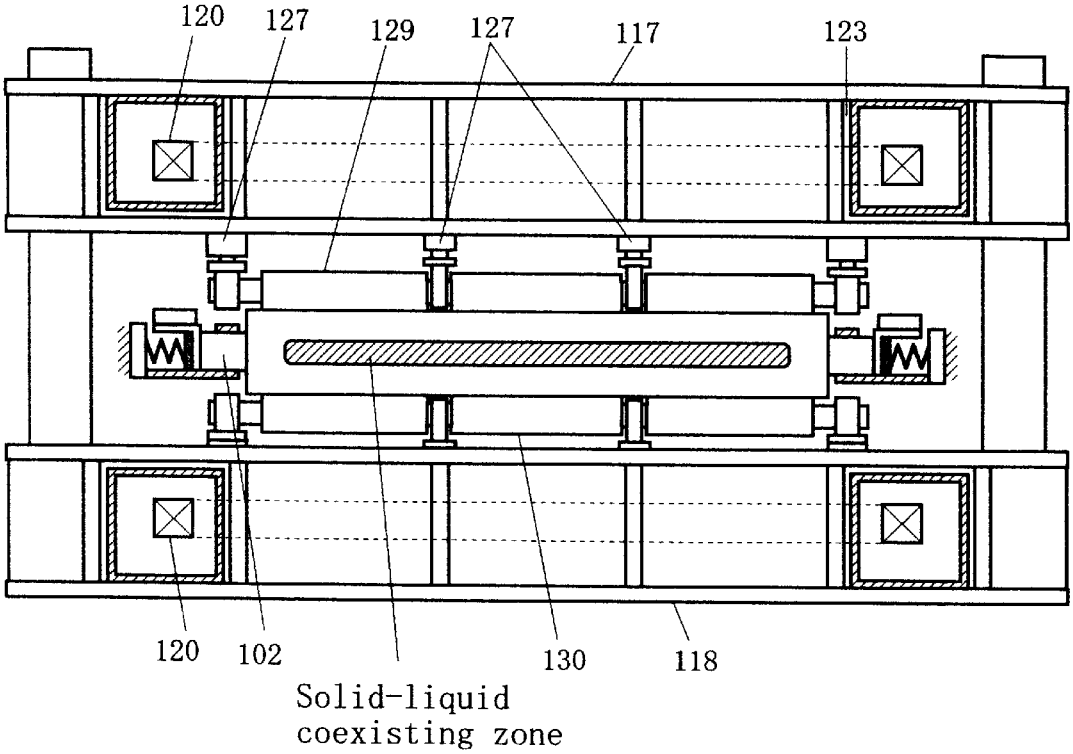
FIG. 64 is the specific diagram of the electromagnetic booster by this invention applied to the continuous castings having wide rectangular cross-sections such as slab. The diagram is that of the side sectional plan. Symbols 129 and 130 denote upper and lower split rolls respectively.
Figure 65:
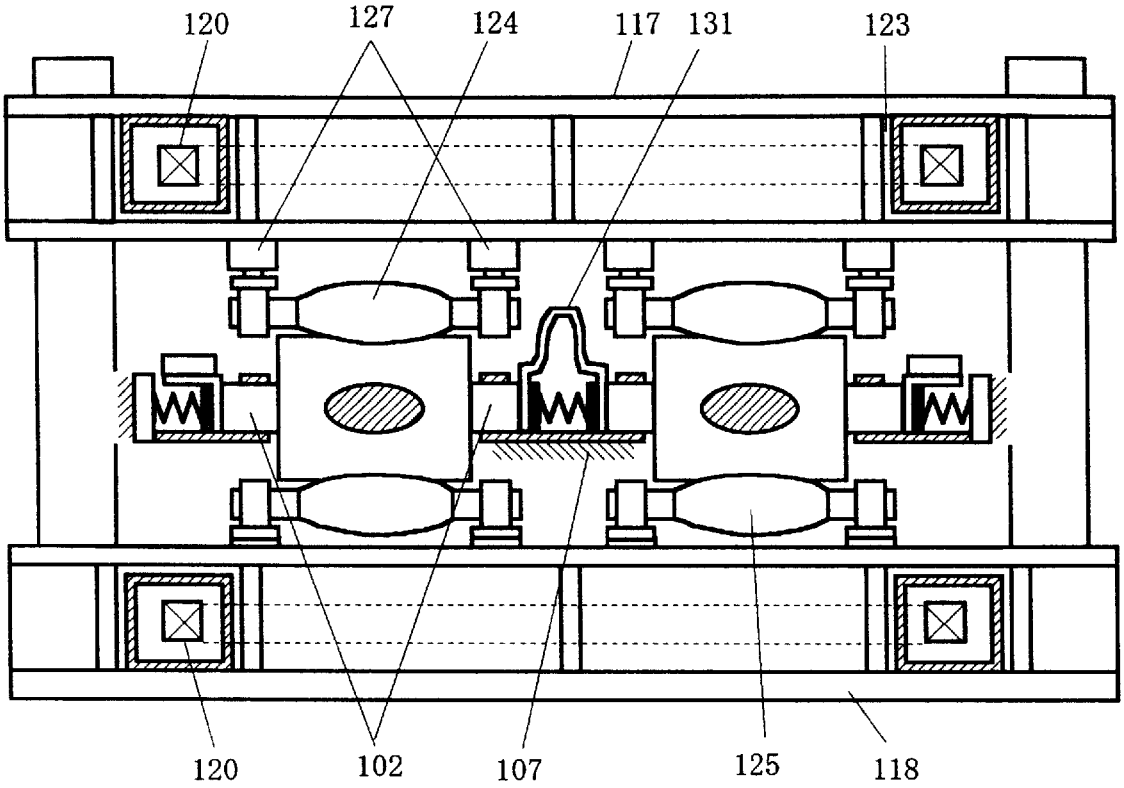
FIG. 65 is the specific diagram (the cross-section) of the electromagnetic booster by this invention applied to twin-type continuous casting. Symbol 131 denotes flexible bus bar or cable.

The specific example applied to a wide slab is shown in FIG. 64, where both Lorentz force and small amount of soft-reduction are given. Because the reduction rolls are long and slender and easy to bend due to reduction load and thermal stress, split rolls are used. The reduction force is given by oil-hydraulic cylinder. The reduction is done by upper roll in general and the hydraulic cylinder 127 is attached to each bearing unit. The cylinder stroke may be short as already mentioned. If more margin is necessary, the unit of specific example 2 can be used. As to the roll, one piece of roll may be used whose diameter is squeezed at bearing units or may be divided into split rolls and each of them supported independently at the bearing units. Also, it is desirable to prevent the plastic deformation at the cross-section corners by attaching roundness at both sides of the end rolls. Roll-drive is done by lower rolls in general. Other mechanisms such as electrode are same as those of specific example 1; therefore, omitted.

Specific Example 4

Application to parallel casting of plural number of cast pieces. There are two types in the continuous caster that cast plural number of cast pieces in parallel at the same time: One is the case that the distance between the cast pieces is sufficiently wide and the other is the case of narrow distance. In the former case, the electromagnetic booster and the reduction unit may be installed independently. This example refers to the latter type. In this case, the neighboring cast pieces are connected by flexible bus bar or cable 131. The electrode box 105 is fixed to the electrode frame 107 that extends toward the longitudinal direction of cast piece. Also, plane milling tool 108 and gas shield box 109 are attached onto the surfaces of the cast pieces. The magnetic field is generated by a pair of upper and lower superconductive coils. The roll reduction units are built in to each cast piece. Other mechanisms are as already mentioned.

The case that only electromagnetic force is applied:

In this case, the roll reduction function shown in the above four examples is unnecessary. Hence, the specific example is not shown. In the case of blooms, etc. mentioned in the specific examples 1, 2 and 4, the cast piece is sustained firmly by the solidified layer. Therefore, upper rolls to support the cast piece are not necessarily needed or only minimum number of rolls are required. On the other hand, an appropriate number of lower rolls are necessary to support the cast piece, considering that fairly strong electromagnetic force is exerted onto the cast piece.

Considering that, in the case of the slab of the above specific example 3, the width of mushy zone is wider than that of bloom and fairly strong Lorentz force acts, it is necessary to firmly support the cast piece by upper and lower rolls as in the case of conventional slab casting.

Also, in the case that the electromagnetic force is strong enough to give rise to an exccessive tensile force in the solidifying shell with mushy zone both for bloom and billet, a means is possible to relax the tensile force by installing a conventional roll reduction unit (not shown) at the downstreamside of the booster of FIG. 1 and thereby applying a brake by the friction force between the rolls and the cast piece due to the roll reduction.

Outline of the design of electromagnetic force:

Its outline is stated below. The magnitude of the electromagnetic force is set 20 times of the gravitational force and the shape of superconductive coil is assumed that of circular for the convenience of calculation (according to Eq. (77) and FIG. 39(*a*)). Take J ($A/m^2$) as DC current density to mushy zone, B (Tesla) as DC magnetic flux density, $\rho=7.0$ ($g/cm^3$) the density of liquid steel and $g_r=980.665$ ($cm/s^2$) the acceleration due to gravity, then gravitational magnification number G is given by the next equation.

$$G = \frac{JB(\mathrm{N/m^3})}{\rho g_r(\mathrm{dyn/cm^3})} = \frac{0.1\ JB(\mathrm{dyn/cm^3})}{\rho g_r(\mathrm{dyn/cm^3})} \tag{80}$$

Now, the current density is set $J=5\times10^5$ ($A/m^2$). The corresponding magnetic flux density becomes B=2.75 (T) from the above equation.

In the above specific example 1 of bloom, take the dimensions of cross-section as 300 mm×400 mm, the radius of the coil as a=0.34 m and the distance between coils as b=0.92 m. Then, the required current in the coil becomes I=3543112 (A) from Eq. (77).

Now, when the electric current in a superconductive wire (take square) is set at 2000 (A), corresponding number of turns of coil N becomes 3543112/2000=1772. Take the cross-section area of a superconductive wire (square) as 10 ($mm^2$) (accordingly the current density becomes 200 $A/mm^2$), the cross-section area of the coil becomes S=1772×10 ($mm^2$)=177.2 $cm^2$.

Next, when conducting similar calculation as to the specific example 2 where the radius of coil enlarged to a=0.48 m and the distance between the coils reduced to b=0.66 m for the same bloom as in the example 1, the design parameters become as follows:

Required coil current I=1,877,224 (A)

Number of turns N=936

(Current density of a superconductive wire=200 $A/mm^2$)

Coil cross-section area S=93.9 ($cm^2$)

With regard to the specific example 3 of slab, take the cross-section dimensions same as those of above examples No. 2 and No. 3 for carrying out the invention (i.e., 220 mm thick×1500 mm wide) and take a=b=0.94 m (Helmholtz-type). Then, the design parameters become as follows:

Required coil current I=2,874,853 (A)

Number of turns N=1,438

(Current density of a superconductive wire=200 $A/mm^2$)

Coil cross-section area S=143.7 ($cm^2$)

The design parameters can be obtained with respect to the specific example 4 similarly, but omitted. The design parameters of the above superconductive coils satisfactorily enter into the practical range of use of the NbTi based superconductive coil at present; thus, there is no technical problem. Furthermore, it is possible to obtain even bigger magnetic field. For more details, refer to a standard text book, for example, Daily Industrial Newspaper of Japan, "the Application of Superconductivity", by Hiroyasu Hagiwara. In the above calculations the shape of coil was taken as that of circular for brevity. Also, the number of pairs of upper and lower coils was taken one, but it is possible to install plural number of pairs of coils in order to optimize the uniformity and the strength of magnetic field. On the occasion of practical design, numerical analysis of static magnetic field may be conducted by finite element analysis, etc. in accordance with real configuration of coils by taking these points into consideration.

The case of applying the Lorentz force toward opposite direction:

As aforementioned, these inventors have pointed out that if the liquid pressure drop due to the interdendritic liquid flow primarily induced by the solidification contraction within elongated mushy zone in casting direction, reaches to the criterion of porosity formation (Eq. (65)), the microporosity forms in between dendrite crystals, and triggered by this, high solute concentration liquid in the vicinity of the porosity flows in along V type porosity thus, resulting in V segregation bands. The porosity lines up in V character pattern as shown in FIG. 12(*b*) and the flow occurs along V bands toward casting direction.

Accordingly, the V segregation can be lessened by exerting the electromagnetic force toward the direction to impede this flow or the opposite direction with the casting direction. This has been shown in the casting experiments of steel bloom (Ref. (9)), utilizing linear motor type electromagnetic apparatus (non-contact type) with no DC current electrodes attached.

The electromagnetic boosters described in the above specific examples can also be applied for this purpose. That is that the Lorentz force may be exerted toward upstream by reversing either the current direction or the magnetic field direction. The Lorentz force is exerted in the range from the upstream vicinity of the position reaching the criterion Eq. (65) to the crater end. The magnitude of the reversed Lorentz force may be extremely smaller than 20G of above-mentioned computational example, because the purpose is to impede the aforementioned liquid flow. If the electromagnetic force is too small, there is no impeding effect. If it is too big on the contrary, the high solute concentration liquid flows toward the opposite direction and results in inverse V segregation; thus, there is no meaning. The magnitude of appropriate electromagnetic force can be easily known by experiment on the real machine. Also, the soft-reduction gradient may be given in addition.

It has been stated in the above Ref. (9) that it is very difficult to apply their inverse method to wide slabs (because of using linear motor type apparatus). On the contrary, since the electromagnetic booster by this invention uses the DC current and DC magnetic field, highly uniform electromagnetic force distribution can be obtained for wide slabs as well as blooms (some ingenuity is of course done on designing). Thus, it will become possible to effectively impede the liquid flow causing V segregation: However, the microporosity would remain to some extent in this method.

In the following, some points about the design for electromagnetic booster will be mentioned including the items so far not referred to.

(1) Appropriate material may be selected for the electrode such as graphite, $ZrB_2$ and so on in consideration of electric conductivity, wear resistance, etc.

(2) In the case of the above specific example, taking the contact area of an electrode as 100 mm×120 mm, the current of 6000 (A) flows into the electrode and then to the bus bar. Copper plate is usually used for bus bar. The cross-sectional area of the plate is determined by using the current density of 3 to 4 ($A/mm^2$) and about 10 ($A/mm^2$) when water-cooled. In the above specific examples, L-type and plate-type bus bars were shown. These are not indispensable matters, but the cable knit with copper wire (having flexibility), etc. may be used for example. These are usual conventional technology, and needless to say, may be devised on the occasion of detailed design.

(3) The electrode and bus bar need to be fixed firmly because the electromagnetic force is generated onto these parts, by the interaction of the current that flows in these parts and the magnetic field.

(4) Because a large magnetic field is generated in the periphery of the electromagnetic booster, the frames, pillars, roll units and so on that exist in this space are basically made of nonmagnetic materials such as stainless steel, etc. Yet, magnetic material (usually, iron) may be arranged properly to obtain uniform magnetic field. Besides, the problems of the effect of magnetic field on various measuring units and the necessity of magnetic shield can be solved by known technology; hence, omitted in this description.

(5) The upper frame 117 and the lower frame 118 in FIGS. 58, 63, 64 and 65 are not necessarily built as one unit. They may be separately made dividing into the rigid frame to house the superconductive coil, the rigid frame to support the roll unit, etc.

(6) The superconductive wire is generally made of composite material where very fine superconductive wires of NbTi and as such are mounted in the copper matrix. The coil is made by winding the wires around bobbin (guide jig). The superconductive coil is usually used without iron cores. At present, since the coil needs to be cooled to an extremely low temperature (liquid helium temperature, 4.2K) to hold superconductive condition, the inside of the cooling chamber 121 is composed of the combined layers of the liquid helium, vacuum heat insulating layer, liquid nitrogen layer, etc. Superconductive technology has already been commercialized to many usage such as particle accelerator, MRI, etc. It is expected that once high temperature superconductive material(s) is developed and commercialized in the future, it will diffuse rapidly in many applications.

(7) It is necessary to know the roll reduction force distribution in order to exert compressive force onto the cast piece by means for oil-hydraulic cylinder, etc. and thereby to attach the prescribed soft-reduction gradient (refer to FIG. 61). For this, it is possible to know an appropriate reduction condition via minimum amount of experiments by utilizing analytical method such as FEM. The analytical method is especially useful in the case that the split rolls are used for slab or in the case that the crown rolls are used for bloom.

(8) The air gap 116 between the gas shield box and the cast piece is made as small as possible and other parts are devised to keep sealed from the atmosphere. One idea is to arrange something like fine stainless steel scrubbing brush in soft contact with the cast piece at the air gap 116. This enables to save the gas consumption, to hold the internal gas pressure in the box to slightly positive and thereby to effectively prevent the re-oxidization.

(9) As a means to remove the surface oxidized layer of cast piece, various methods are available besides the plane milling tool such as that of fixing a cutting tool in relative to the movement of the cast piece.

(10) Atmospheric temperature around the cast piece is raised due to the radiation, heat conduction, etc. from the surface of the cast piece. Hence, an appropriate cooling measure such as water-cooling needs to be taken to cool the roll bearing unit, oil-hydraulic cylinder, bus bar, etc.

In the above, the mechanisms utilizing plural number of sliding electrodes and the superconductive coils were described regarding the specific apparatus of this invention to exert the electromagnetic force toward the casting direction. To say more specifically, by adopting the racetrack type or horse saddle type superconductive coils in accordance to the shape of the cross-section of the cast piece, by reducing the distance between the coils as much as possible and by adjusting the balance of the distance between the coils and the width of the coils, a highly uniform and strong magnetic field can be obtained in the wide space including the cast piece, the rolls, the electrodes, etc. (In this point, it is very difficult from the view point of the mechanism to produce a highly uniform electromagnetic force in the mushy zone of slab such as shown in FIG. 64 or bloom such as shown in FIG. 58 by a non-contact linear motor-type electromagnetic generator.)

Next, as a means to supply DC current, the method of using plural number of sliding electrodes was described in this invention. This gives birth to such an effect that enables to optionally control the current density distribution and thereby to optionally control the electromagnetic force distribution in the longitudinal direction of cast piece.

As to the case that the soft-reduction is used as a supplemental means to reduce the required electromagnetic force, it is possible to optionally control the reduction force distribution by introducing the independently controlled oil-hydraulic system of this invention and thereby to control the gradient of the reduction quantity. In this case, each hydraulic system needs not to be controlled independently for each roll, but may be controlled every several rolls depending on the case. Also, oil may not necessarily be used as a pressure transmission medium. Furthermore, by installing driving unit to rolls, it becomes possible to adequately control the tensile force that takes place in solidifying shell to prevent cracking.

As above mentioned, the apparatus by this invention enables to obtain desired electromagnetic force, magnitude of reduction force and reduction distribution. As a result, it can realize to obtain the cast piece without the internal defects, and also enhance the productivity by high-speed casting. On the occasion of the application, all the functions mentioned in this description regarding the electromagnetic force, soft-reduction gradient, control of roll-drive, etc. may not necessarily be used.

Application Range of the Electromagnetic Continuous Casting Method

By the above four the examples for carrying out the invention, the electromagnetic continuous casting method by this invention (called E process) was verified, and the specific examples of the electromagnetic apparatus were shown. The E process can be applied to all continuous casting processes besides the vertical-round type bloom, the vertical-bending type slab and the bending type bloom taken up in this description: Namely, recently notified thin slab casting (thickness of the slab is the order of 50 mm or 60 mm at present), so-called near-net-shape casting with irregular cross-sections like H-type, and further the composite casting process where different grade of steels are cast simultaneously into the same mold, in addition to the conventional processes such as vertical-bending blooms and billets and bending slabs and billets. The reason for this is that the principles of E process, that pays a special attention to the pressure drop toward casting direction in interdendritic liquid within the mushy zone at the cross-section of cast piece, holds the liquid pressure higher than that of the critical pressure of porosity formation and thereby enables it possible to make castings with essentially no central defects (microporosity and segregation), possess an universality to all these processes.

The interdendritic liquid flow toward casting direction induced by the solidification contraction is a physical phenomenon generally common to metallic alloy. Therefore, E process can be applied to all steel grades such as carbon steel, low alloy steel, stainless steel, etc: E process can also be applied to non ferrous alloys such as aluminium alloys, copper alloys, etc.

E process consists of the method of exerting Lorentz force alone and the combined method of Lorentz force and soft-reduction. In either case, there is no effect if the timing of solidification, i.e., the position of Lorentz force application (the distance from meniscus) is mistaken. For example, if the Lorentz force is applied at the downstream side of the position where the liquid pressure reaches critical pressure of porosity formation, it acts to further accelerate the liquid flow to form V segregation because the V pattern of porosity has already been formed. Therefore, there is a possibility to create conversely severer V segregation depending on the magnitude of the Lorentz force. If the applied position is too upstream side on the contrary, the Lorentz force acts to uselessly increase the liquid pressure where pressure rise is not expected. And the effect to the crater end vicinity where liquid feeding is most needed becomes small; thus, unfavorable. Even in the case that the applied position is appropriate, if the Lorentz force is too small and become less than the critical pressure, there is a possibility to accelerate V segregation due to the formation of porosity. Accordingly, it is very important to quantitatively know the position of the critical liquid pressure and required Lorentz force: For this, the numerical analysis by computer disclosed in this description provides with the most effective means. (It would probably be impossible to know this critical position directly by physical measurement. Further, it is impossible to know the required Lorentz force distribution by experimental means.) This is the reason why the above-mentioned numerical method that these inventors developed is indispensable as a means to comprise E process.

This computer program takes the formality to be stored and sold in the forms of sauce program/application program to the various memory media such as MT (magnetic tape), floppy disk, CD-ROM, DVD, semiconductor memory cards, media on the internet, etc. Thus, it is possible to perform a series of analytical work of the input of operating conditions, the implementation of computation, display of the results on the computers such as personal computer, work station, large frame computer, supercomputer, etc.

Drawing of Cast Piece by the Use of Electromagnetic Force

The Lorentz force generated in E process can be utilized as a drawing force of cast piece. In bending-type or vertical-bending-type continuous casting, the cast piece undergoes drawing resistance such as the drawing resistance due to unbending, frictional resistance between the cast piece and the mold, etc. For example, it has been reported in Ref. (31) that 60 tons of drawing resistant force was measured on a real machine for slab casting (cross-section 190 mm×1490 mm, casting speed 1.5 m/min). As the casting speed is increased, the drawing resistant force is increased. In order to obtain the drawing force corresponding to such a large drawing resistant force, it is necessary to effectively act the driving torque by rolls on the cast piece. Hence, a multi-drive-system is adopted in general. However, it is considered that some influences occur to the quality of the product in the method of applying the frictional force onto the cast piece: For example, if the compressive force is too big, the solidifying shell deforms resulting in internal crack and segregation (Ref. (31)).

On the other hand, the Lorentz force acts statically on the cast piece, enables to reduce the number of driving rolls and thereby to reduce the above mentioned compressive force. Hence, it will work favorably on the quality.

Utilization Procedure of the Electromagnetic Continuous Casting (E Process)

Utilization procedure of E process to real continuous casting is as follows.

(1) Matching the Numerical Analysis with the Test on a Real Continuous Caster.

The computational results described in the above examples for carrying out the invention are of course accompanied by errors. The primary cause of the errors is associated with the heat transfer coefficient on the surface of cast piece and the accuracy of various physical properties. With respect to the physical properties used in this description are reasonable that are quoted from various published references, but it is difficult to expect accuracy for many data. The second cause of the errors lies in the modeling of the morphology of dendrite crystal and the accuracy of resulting permeability K. The validity of the modeling of complicated dendrite morphology has been proved by Ref. (18). In addition, it is known that the permeability K differs in the parallel direction to the growth direction of dendrite crystal (Kp) and in the perpendicular direction to it (Kv) (Ref. (32)). It seems that Kp and Kv depend on the cooling rate. However, the reality is that there is no accurate data on the relationship between Kp and Kv of commercial steels. Therefore, upon the matching, above two points needs to be taken into account.

It is possible to correct the error by the above primary cause by measuring the surface temperature (or internal temperature) change (for example, Ref. (33)). Good amount of data have been accumulated so far about the relationship between the cooling conditions such as water-mist spraying and the surface heat transfer coefficient. Now that the measurements of solidifying shell thickness and crater end position have become possible, an accurate correction is possible. The method of correction is optional. To cite an example, the correction can be done by thermal diffusion coefficient $\lambda/c\rho$.

With regard to the error by the second cause, the error may be corrected so that the calculated and the measured values of the critical position of porosity formation coincide, introducing a parameteraK to correct the influence of anisotropy of columnar dendrite into the equation of permeability K (Eq. (27)) besides the correction factora in Sb equation (Eq. (28)). That is, the critical position of the porosity formation may be designated by observing the conditions of internal defects (the range of formation, the size of porosity, etc.) and comparing with the numerical results.

(2) Determination of the Optimized Condition of E Process via Numerical

Once these correction factors are established by the above procedure (1), the optimized conditions to eliminate the internal defects can be found by fully utilizing the numerical computations: i.e., the range and the magnitude of Lorentz force, soft-reduction conditions (if required), etc. This has already been described.

Since thus determined optimized conditions are those corrected in the procedure (1), they are highly reliable. On the occasion of real operation, these parameters are set to safer side, needless to say.

Industrial Applicability

This invention is composed and works as above mentioned, enables it possible to predict the position, the quantity and the range of internal defects of continuous castings, and is able to evaluate optimum applied range and magnitude of the Lorentz force to suppress the formation of the internal defects. Thus, this invention can provide with unprecedented, excellent method and apparatus for continuous casting which enables it possible to obtain highly qualified continuous castings with essentially no segregation or no porosity regardless of the chemical compositions.

Because this invention can combine the electromagnetic force with the soft-reduction, it becomes possible to obtain highly qualified steels with essentially no segregation or no porosity in high-speed casting as well.

At last, the effect of this invention can be summarized as follows:

(1) The internal defects (central segregation and porosity) can completely be eliminated.

(2) High-speed casting is enabled.

(3) The degree of freedom for chemical compositions can be expanded.

(4) The variety of steel grades of continuous castings can be expanded.

(5) Drawing apparatus can be made simple and effective.

Especially, with respect to the above (2), the number of continuous casters can be cut to half by increasing the casting speed 2 or 3 times. Its economic effect is significant. As the magnetic apparatus, superconductive magnet is preferred to conventional electromagnet from the viewpoints of construction cost, operating expense, energy conservation and saving of the space.

Thus, the continuous casting process by this invention can be said a new process excellent in productivity and economic efficiency as well as in the quality.

These inventors, without staying at the macroscopic phenomena such as heat and fluid flow, have coupled these macroscopic phenomena with the microscopic solidification phenomena such as dendrite growth and solute redistribution in multi-alloy system, and developed the computer program where the effects of electromagnetic force, mechanical deformation and pearlitic transformation were further incorporated. To the best of these inventors' knowledge, the whole picture of the internal defects problem in continuous casting have been grasped for the first time.

Discretization of the Governing Equations

A: Discretization of the Energy Equation

The discretization equation regarding temperature is as follows.

$$a_P T_P = a_N T_N + a_S T_S + a_T T_T + a_B T_B + a_W T_W + a_E T_E + b \quad \text{(A.1)}$$

$$a_N = [D_N A(|P_n|) + \langle -F_n, 0\rangle] A_n \quad \text{(A.2)}$$

$$a_S = [D_S A(|P_S|) + \langle F_S, 0\rangle] A_S \quad \text{(A.3)}$$

$$a_T = [D_t A(|P_t|) + \langle -F_t, 0\rangle] A_t \quad \text{(A.4)}$$

$$a_B = [D_b A(|P_b|) + \langle F_b, 0\rangle] A_b \quad \text{(A.5)}$$

$$a_W = [D_w A(|P_w|) + \langle -F_w, 0\rangle] A_w \quad \text{(A.6)}$$

$$a_E = [D_e A(|P_e|) + \langle F_e, 0\rangle] A_e \quad \text{(A.7)}$$

$$a_P = a_N + a_S + a_T + a_B + a_W + a_E + a_P^{old} \quad \text{(A.8)}$$

$$a_P^{old} = (\overline{c\rho})_P^{old} \frac{\Delta V}{\Delta t} \quad \text{(A.9)}$$

-continued $$\begin{aligned} b = {} & a_P^{old} T_P^{old} + \{L(\overline{\rho})_P^{old}(g_S - g_S^{old})_P + \\ & c_P^L T_P^{old}(\overline{\rho} - \overline{\rho}^{old})_P\} \frac{\Delta V}{\Delta t} + Q\text{Joule} \cdot \Delta V + \\ & \{\overline{\rho} L + (c_P^L - c_P^S)\rho_S T\}_P^{old} [v_S \cdot \nabla g_S] + \\ & \{(c_P^L - c_P^S)\rho_S T\}_P^{old} g_{S,P}[\nabla \cdot v_S] - (c_P^S \rho_S)_P^{old} g_{S,P}[v_S \cdot \nabla T] \end{aligned} \quad \text{(A.10)}$$

$$[v_S \cdot \nabla g_S] = v_{1,P}^S (g_{S,s}) A_P + v_{2,P}^S (g_{S,t} - g_{S,b}) A_t + v_{3,P}^S (g_{S,w} - g_{S,e}) A \quad \text{(A. 11)}$$

$$[\nabla \cdot v_S] = A_n v_{1,n}^S - A_s v_{1,s}^S + A_t (v_{2t}^S - v_{2,b}^S) + A_w (v_{3,w}^S - v_{3,e}^S) \quad \text{(A. 12)}$$

$$[v_S \cdot \nabla T] = v_{1,P}^S (T_n - T_s) A_P + v_{2,P}^S (T_t - T_b) A_t + v_{3,P}^S (T_w - T_e) A_w \quad \text{(A. 13)}$$

$$D_n = \overline{\lambda}_n / \delta_n;\ F_n = (c_P^L \rho_L g_L v_1)_n \quad \text{(A. 14, 15)}$$

$$D_s = \overline{\lambda}_s / \delta_s;\ F_s = (c_P^L \rho_L g_L v_1)_s \quad \text{(A. 16, 17)}$$

$$D_t = \overline{\lambda}_t / \delta_t;\ F_t = (c_P^L \rho_L g_L v_2)_t \quad \text{(A. 18, 19)}$$

$$D_b = \overline{\lambda}_b / \delta_b;\ F_b = (c_P^L \rho_L g_L v_2)_b \quad \text{(A. 20, 21)}$$

$$D_w = \overline{\lambda}_w / \delta_w;\ F_w = (c_P^L \rho_L g_L v_3)_w \quad \text{(A. 22, 23)}$$

$$D_e = \overline{\lambda}_e / \delta_e;\ F_e = (c_P^L \rho_L g_L v_3)_e \quad \text{(A. 24, 25)}$$

Where, Peclet number $P_n = F_n / D_n$, etc.

Function $A(|P|) = \langle 0, (1 - 0.1 \cdot |P|)^5 \rangle$, etc.

Symbol < > means to choose the bigger of the values in the bracket.

The lower suffixes 1, 2 and 3 of the velocity express the velocity component in N, T and W directions respectively viewing from the grid point P, and are defined at the face n, s, . . . of the element (control volume). Upper suffix old denotes the value at the time Δt before. Also, $\overline{\lambda}$ takes the harmonic mean of the neighboring two elements at the element face. Namely, $$\overline{\lambda}_n = \frac{\delta n}{\delta n^- / \lambda P + \delta n^+ / \lambda N},$$

$\delta n^-$ is the distance between P and n, and $\delta n^+$ n and N.

B: Discretization of the Solute Redistribution Equation

The discretization equation of the liquid solute concentration $C_n^L$ (written as C for brevity) is as follows.

$$a_P C_P = a_N C_N + a_S C_S + a_T C_T + a_B C_B + a_W C_W + a_E C_E + b \quad \text{(B. 1)}$$

$$a_N = [D_n A(|P_n|) + \langle -F_n, 0\rangle] A_n \quad \text{(B. 2)}$$

$$a_S = [D_S A(|P_s|) + \langle F_s, 0\rangle] A_s \quad \text{(B. 3)}$$

$$a_T = [D_t A(|P_t|) + \langle -F_t, 0\rangle] A_t \quad \text{(B. 4)}$$

$$a_B = [D_b A(|P_b|) + \langle F_b, 0\rangle] A_b \quad \text{(B. 5)}$$

$$a_W = [D_w A(|P_w|) + \langle -F_w, 0\rangle] A_w \quad \text{(B. 6)}$$

$$a_E = [D_e A(|P_e|) + \langle F_e, 0\rangle] A_e \quad \text{(B.7)}$$

$$a_P = a_N + a_S + a_T + a_B + a_W + a_E + a_P \quad \text{(B.8)}$$

$$a_P^0 = \frac{\Delta V}{\Delta t} \quad \text{(B .9)}$$

-continued $$b = a_P^0\left\{C_P^{old} + \frac{1}{2}\left(\hat{A}_n^{old} + \hat{A}_n^*\right)(g_S - g_S^{old}) - \frac{1}{2}\left(\hat{B}_n^{old} + \hat{B}_n^*\right)(g_V - g_V^{old})\right\} + \frac{1}{2}\left(\hat{C}_P^{old} + \hat{C}_n^*\right)[\nabla\cdot(g_S v_S)] - \frac{1}{2}\left(\hat{D}_n^{old} + \hat{D}_n^*\right)\left[v_S\cdot\nabla\overline{C}_n^S\right] \quad \text{(B.10)}$$

Where, $\hat{A}_n$ is given by Eqs. (12) and (16), $\hat{B}_n$ by Eqs. (13) and (17), $\hat{C}_n$ by Eqs. (14) and (18) and $\hat{D}_n$ by Eqs. (15) and (19) in this description. Upper suffix * in the term b expresses the updated value in the iterative convergence computation and takes the average value of the time t and t-Δt (Crank-Nicholson scheme).

$$[\nabla\cdot(g_S v_S)] = (g_S v_1^S)_n A_n - (g_S v_1^S)A_S + \{(g_S v_2^S)_t - (g_S v_2^S)_b\}\cdot A_t + \{(g_S v_3^S)_w - (g_S v_3^S)_e\}\cdot A_w \quad \text{(B. 11)}$$

For alloy element n, $$[v_S\cdot\nabla\overline{C}_n^S] = v_{1,P}^S(\overline{C}_{n,n}^S - \overline{C}_{n,s}^S)A_{n,P} + v_{2,P}^S(\overline{C}_{n,t}^S - \overline{C}_{n,b}^S)A_t + v_{3,P}^S(\overline{C}_{n,w}^S - \overline{C}_{n,e}^S)A_w \quad \text{(B. 12)}$$

In the above equation, $C_j^S$ is used instead of $\overline{C}_n^S$ for j-type alloy (equilibrium solidification).

$$D_n = \overline{D}_n/\delta_n;\ F_n = v_{1,n} \quad \text{(B. 13)}$$

$$D_S = \overline{D}_S/\delta_S;\ F_S = v_{1,S} \quad \text{(B. 14)}$$

$$D_t = \overline{D}_t/\delta_t;\ F_t = v_{2,t} \quad \text{(B. 15, 16)}$$

$$D_b = \overline{D}_b/\delta_b;\ F_b = v_{2,b} \quad \text{(B. 17, 18)}$$

$$D_w = \overline{D}_w/\delta_w;\ F_w = v_{3,w} \quad \text{(B. 19, 20)}$$

$$D_e = \overline{D}_e/\delta_e;\ F_e = v_{3,e} \quad \text{(B. 21, 22)}$$

Peclet number $P_n = F_n/D_n$, etc.

Function $A(|P|) = <0, (1-0.1\cdot|P|)^5>$), etc.

The meanings of symbol and lower suffixes 1, 2 and 3 of velocity are the same as in the previous section A. Also, the diffusion coefficient $\overline{D}(=D_0 \exp(-Q/RT))$ similarly takes the harmonic mean at the element face. There are as many equations as the number of alloy elements.

C: Discretization of Temperature-Volume Fraction of Solid Equation

The discretization equation of temperature T vs. volume fraction of solid gs is as follows.

$$a_P T_P = a_N T_N + a_S T_S + a_T T_T + a_B T_B + a_W T_W + a_E T_E + b \quad \text{(C. 1)}$$

$$a_N = <-F_n, 0> A_n;\ F_n = v_{1,n} \quad \text{(C. 2)}$$

$$a_S = <F_s, 0>)A_s;\ F_s = v_{1,s} \quad \text{(C. 3, 4)}$$

$$a_T = <-F_t, 0> A_t;\ F_t = v_{2,t} \quad \text{(C. 5, 6)}$$

$$a_B = <F_b, 0> A_b;\ F_b = v_{2,b} \quad \text{(C. 7, 8)}$$

$$a_W = <-F_w, 0> A_w;\ F_w = v_{3,w} \quad \text{(C. 9, 10)}$$

$$a_E = <F_e, 0> A_e;\ F_e = v_{3,e} \quad \text{(C. 11, 12)}$$

$$a_P = a_N + a_S + a_T + a_B + a_W + a_E + a_P \quad \text{(C. 13)}$$

$$a_P^0 = \frac{\Delta V}{\Delta t} \quad \text{(C. 14)}$$

$$b = a_P^0(T_P^{old} + S_1 - S_2) + S_3 + S_4 \quad \text{(C. 15)}$$

-continued $$S_1 = \left\{\sum_i m_{i,k(i)}^L \hat{A}_i + \sum_j m_{j,k(j)}^L \hat{A}_j\right\}_P (g_S - g_S^{old})_P \quad \text{(C. 16)}$$

$$S_2 = \left\{\sum_i m_{i,k(i)}^L \hat{B}_i + \sum_j m_{j,k(j)}^L \hat{B}_j\right\}_P (g_V - g_V^{old}) \quad \text{(C. 17)}$$

$$S_3 = \left\{\sum_i m_{i,k(i)}^L \cdot \frac{C_i^L - C_i^{*S}}{(1-\bar{\beta})g_L} + \left(\sum_j m_{j,k(j)}^L A_{j,k(j)} C_j^L + \frac{B_{j,k(j)}}{(1-\bar{\beta})g_L}\right)\right\}_P [\nabla\cdot(g_S v_S)] \quad \text{(C. 18)}$$

$$S_4 = -\left\{\frac{g_S}{(1-\bar{\beta})g_L}\right\}_P \left[V_S\cdot\left\{\sum_n m_{n,k(n)}\nabla\overline{C}_n^S\right\}\right] \quad \text{(C. 19)}$$

Where $\nabla\cdot(g_S v_S)]$ is given by Eq. (B. 11). Because the influence of $S_4$ is small, it was neglected. $\hat{A}_n$ is given by Eqs. (12) and (16), $\hat{B}_n$ by Eqs. (13) and (17), $\hat{C}_n$ by Eqs. (14) and (18) and $\hat{D}_n$ by Eqs. (15) and (19) in this description.

D: Discretization of the Darcy Equation-Pressure Equation

The velocity equations by Darcy's law (Eq. (26) in this description) are as follows.

$$v_{1,n} = \left(\frac{K_1}{\mu g_L}\right)_n \left\{GF_{1,n} + EMF_{1,n} + \frac{P_P - P_N}{\delta n}\right\} \quad \text{(D.1)}$$

$$v_{2,t} = \left(\frac{K_2}{\mu g_L}\right)_t \left\{GF_{2,t} + EMF_{2,t} + \frac{P_P - P_T}{\delta t}\right\} \quad \text{(D.2)}$$

$$v_{3,w} = \left(\frac{K_3}{\mu g_L}\right)_w \left\{GF_{3,w} + EMF_{3,w} + \frac{P_P - P_W}{\delta w}\right\} \quad \text{(D.3)}$$

Where, $GF_1$, etc. and $EMF_1$, etc. are the components in $X_1$, $X_2$ and $X_3$ directions of gravitational and electromagnetic forces, respectively. Namely, $GF_1 = \alpha GF_1 \rho_L g_r$, etc.

$\alpha GF_1$, etc. are the coefficients in $X_1$, . . . directions of the curved coordinates $(X_1, X_2, X_3)$. For example, $\alpha GF_1 = \alpha GF_3 = 0$ and $\alpha GF_2 = -1$ for a vertical continuous casting. Suffixes 1,2,3 of K take into account the anisotoropy of columnar dendrite crystal: For example, in the case of slab, take $K_1 = K_P$ (parallel to the growth direction of columnar dendrite) and $K_2 = K_3 = K_V$ (vertical to the growth direction). In the case of equiaxed crystal, set $K_1 = K_2 = K_3$. Also, the harmonic mean is taken at element's faces.

Next, the pressure equation is derived by combining with the continuity equation (Eq. (9) of this description and the above (D. 1)).

Thus, discretization of Eq. (9) is given by, $$(\bar{\rho} - \bar{\rho}^{old})_P \frac{\Delta V}{\Delta t} + (\rho_L g_L v_1)_n A_n - (\rho_L g_L v_1)_s A_s + \{(\rho_L g_L v_2)_t - (\rho_L g_L v_2)_b\}A_t + \{(\rho_L g_L v_3)_w - (\rho_L g_L v_3)_e\}A_w + (\rho_S g_S v_1^S)_n A_n - (\rho_S g_S v_1^S)_s A_s + \{(\rho_S g_S v_2^S)_t - (\rho_S g_S v_2^S)_b\}A_t + \{(\rho_S g_S v_3^S)_w - (\rho_S g_S v_3^S)_e\}A_w = 0 \quad \text{(D.4)}$$

On the other hand, Eq. (D. 1), etc. are put into the following form.

$$v_{1,n} = \hat{v}_{1,n} + d_n(P_P - P_N); \quad \text{(D .5, 6, 7)}$$

$$\hat{v}_{1,n} = \left(\frac{K_1}{\mu g_L}\right)_n (GF_{1,n} + EMF_{1,n});$$

$$d_n = \left(\frac{K_1}{\mu g_L}\right)_n \Big/ \delta n$$

$$v_{3,e} = \hat{v}_{3,e} + d_e(P_E - P_P); \quad \text{(D .20, 21, 22)}$$

$$\hat{v}_{3,e} = \left(\frac{K_3}{\mu g_L}\right)_e (GF_{3,e} + EMF_{3,e});$$

$$d_e = \left(\frac{K_3}{\mu g_L}\right)_e \Big/ \delta$$

Substituting these equations into Eq. (D. 4) and arranging, the following discretization equation is obtained.

$$a_P P_P = a_N P_N + a_S P_S + a_T P_T + a_B P_B + a_W P_W + a_E P_E + b \quad \text{(D. 23)}$$

$$a_N = (\rho_L g_L)_n d_n A_n \quad \text{(D. 24)}$$

$$a_S = (\rho_L g_L)_s d_s A_s \quad \text{(D. 25)}$$

$$a_T = (\rho_L g_L)_t d_t A_t \quad \text{(D. 26)}$$

$$a_B = (\rho_L g_L)_b d_b A_b \quad \text{(D. 27)}$$

$$a_W = (\rho_L g_L)_w d_w A_w \quad \text{(D. 28)}$$

$$a_E = (\rho_L g_L)_e d_e A_e \quad \text{(D. 29)}$$

$$a_P = a_N + a_S + a_T + a_B + a_W + a_E \quad \text{(D. 30)}$$

$$b = (\bar{\rho}^{old} - \bar{\rho})_P \frac{\Delta V}{\Delta t} + [divL] + [divS] \quad \text{(D .31)}$$

$$[divL] = A_s(\rho_L g_L \bar{v}_1)_s - A_n(\rho_L g_L \overline{84}_1)_n + A_t\{(\rho_L g_L \bar{v}_2)_b - (\rho_L g_L \bar{v}_2)_t\}$$

$$+A_w\{(\rho_L g_L \bar{v}_3)_e - (\rho_L g_L \bar{v}_3)_w\} \quad \text{(D. 32)}$$

$$[divS] = A_s(\rho_S g_S v^S{}_1)_s - A_n(\rho_S g_S v^S{}_1)_n + A_t\{(\rho_S g_S v^S{}_2)_b - (\rho_S g_S v^S{}_2)_t\}$$

$$+A_w\{(\rho_S g_S v^S{}_3)_e - (\rho_S g_S v^S{}_3)_w\} \quad \text{(D. 33)}$$

Where, $\rho = \rho_L g_L + \rho_S g_S$ and $g_L + g_S + g_V = 1$. It is emphasized again that P field is determined so as to satisfy the continuity condition which include the effect of Lorentz force, in addition to porosity, solid deformation and gravitational force.

E: Discretization of the Momentum Equation

Staggered grid is used for the momentum equation (refer to Ref. (20)). The discretization equation of $v_1$ is expressed as follows by the use of staggered grid in $X_1$ (r) direction (refer to FIG. 41(*a*)). The suffix 1 is omitted for brevity.

$$a_n v_n = a_{nn} v_{nn} + a_S v_S + a_{NT} v_{NT} + a_{NB} v_{NB} + a_{NW} v_{NW} + a_{NE} v_{NE} + +(P_P - P_N) \cdot A_{PN} \quad \text{(E. 1)}$$

$$a_n = a_{nn} + a_s + a_{NT} + a_{NB} + a_{NW} + a_{NE} + a_n{}^0 - S_n \quad \text{(E. 2)}$$

$$a_{nn} = [D_N A(|P_N|) + <-F_N, 0>]A_N \quad \text{(E. 3)}$$

$$a_s = [D_P A(|P_P|) + <F_P, 0>]A_P \quad \text{(E. 4)}$$

$$a_{NT} = [D_{nt} A(|P_{nt}|) + <-F_{nt}, 0>]A_{nt} \quad \text{(E. 5)}$$

$$a_{NB} = [D_{nb} A(|P_{nb}|) + <F_{nb}, 0>]A_{nb} \quad \text{(E. 6)}$$

$$a_{NW} = [D_{nw} A(|P_{nw}|) + <-F_{nw}, 0>]A_{nw} \quad \text{(E. 7)}$$

$$a_{NE} = [D_{ne} A(|P_{ne}|) + <F_{ne}, 0>]A_{ne} \quad \text{(E. 8)}$$

$$a_t^0 = (\rho_L g_L + \bar{\rho}^{old} - \bar{\rho})_n \frac{\Delta V_n}{\Delta t} \quad \text{(E .9)}$$

$$b = a_n{}^{old} v_n{}^{old} + S_{c,n} + v_n{}^* \cdot [\nabla \cdot (\rho_S g_S v_S)]_n \quad \text{(E. 10)}$$

(Symbol * of $V_n{}^*$ denotes the updated value in iterative convergence computation. Similarly thereafter)

$$a_n^{old} = (\rho_L g_L)_n^{old} \Delta \frac{V_n}{\Delta t} \quad \text{(E .11)}$$

As for orthogonal coordinates system (Cartesian coordinates):

$$S_n = -\left(\frac{\mu g_L}{K_1}\right)_n \Delta V_n \quad \text{(E .12)}$$

$$S_{c,n} = (GF_1 + EMF_1)_n \cdot \Delta V_n \quad \text{(E. 13)}$$

$$[\nabla \cdot (\rho_S g_S v_S)]_n = A_N(\rho_S g_S v_1{}^S)_N - A_P(\rho_S g_S v_1{}^S)_P +$$

$$A_{nt}\{(\rho_S g_S v_2{}^S)_{nt} - (\rho_S g_S v_2{}^S)_{nb}\} + A_{nw}\{(\rho_S g_S v_3{}^S)_{nw} - (\rho_S g_S v_3{}^S)_{ne}\} \quad \text{(E. 14)}$$

As for the staggered grid in r direction of the orthogonal curvilinear coordinates of FIG. 9: All other terms are common except for $S_{c,n}$ and $S_n$, which are given as follows.

$$S_n = -\left(\frac{\mu g_L}{K_1}\right)_n \Delta V_n - \mu_n \ln\left(\frac{r_P}{r_N}\right) \cdot \Delta x_3 \Delta\theta \quad \text{(E .15)}$$

$$S_{c,n} = (GF_1 + EMF_1)_n \cdot \Delta V_n - 2\mu_n(v_{2,nt} - v_{2,nb})\left(\ln\frac{r_P}{r_N}\right)\Delta x_3 - (\rho_L v_2^2)_n \Delta x_1 \Delta\theta \Delta x_3 \quad \text{(E .16)}$$

As for the staggered grid (omitted in this description for want of space) in r direction of (r,θ,z) cylindrical coordinates.

$$S_n = -\left(\frac{\mu g_L}{K_1}\right)_n \Delta V_n - \mu_n \ln\left(\frac{r_N}{r_P}\right) \cdot \Delta\theta \Delta z \quad \text{(E .17)}$$

$S_{c,n}$ is same as Eq. (E. 13).

$$D_N = \mu_{N/\delta N};\ F_N = (\rho_L g_L v_1)_N \quad \text{(E. 18, 19)}$$

$$D_P = \mu_P \delta P;\ F_P = (\rho_L g_L v_1)_P \quad \text{(E. 20, 21)}$$

$$D_{nt} = \mu_{nt}/\delta NT;\ F_{nt} = (\rho_L g_L v_2)_{nt} \quad \text{(E. 22, 23)}$$

$$D_{nb} = \mu_{nb}/\delta NB;\ F_{nb} = (\rho_L g_L v_2)_{nb} \quad \text{(E. 24, 25)}$$

$$D_{nw} = \mu_{nw}/\delta NW;\ F_{nw} = (\rho_L g_L v_3)_{nw} \quad \text{(E. 26, 27)}$$

$$D_{ne} = \mu_{ne}/\delta NE;\ F_{ne} = (\rho_L g_L v_3)_{ne} \quad \text{(E. 28, 29)}$$

$\mu$ takes harmonic mean.

Using staggered grid in Z direction (refer to FIG. 41(*b*)), the discretization equation of $v_2$ is as follows (suffix 2 is omitted for brevity).

$$a_t v_t = a_{nnt} v_{nnt} + a_{sst} v_{sst} + a_{tt} v_{tt} + a_b v_b + a_{wwt} v_{wwt} + a_{eet} v_{eet} + +(P_P - P_T) \cdot A_t \quad \text{(E. 30)}$$

$$a_t = a_{nnt} + a_{sst} + a_{tt} + a_b + a_{wwt} + a_{eet} + a_t{}^0 - S_t \quad \text{(E. 31)}$$

$$a_{nnt} = [D_{nt} A(|P_{nt}|) + <-F_{nt}, 0>]A_{nt} \quad \text{(E. 32)}$$

$$a_{sst} = [D_{st} A(|P_{st}|) + <F_{st}, 0>]A_{st} \quad \text{(E. 33)}$$

$$a_{tt}=[D_T A(|P_T|)+<-F_T,0>]A_t \quad (E.\ 34)$$

$$a_b=[D_P A(|P_P|)+<F_P,0>]A_t \quad (E.\ 35)$$

$$a_{wwt}=[D_{wt} A(|P_{wt}|)+<-F_{wt},0>]A_{wt} \quad (E.\ 36)$$

$$a_{eet}=[D_{et} A(|P_{et}|)+<F_{et},0>]A_{wt} \quad (E.\ 37)$$

$$a_t^0 = (\rho_L g_L + \bar{p}^{old} - \bar{p})_t \Delta \frac{V_t}{\Delta t} \quad (E.38)$$

$$b=a_t^{old} v_t^{old}+S_{c,t}+v_t^*[\nabla\cdot(\rho_S g_S v_S)]_t \quad (E.\ 39)$$

$$a_t^{old} = (\rho_L g_L)_t^{old} \Delta \frac{V}{\Delta t} \quad (E.40)$$

$$[\nabla\cdot(\rho_S g_S v_S)]_t=A_{nt}(\rho_S g_S v_1^S)_{nt}-A_{st}(\rho_S g_S v_1^S)_{st}$$
$$+A_t\{(\rho_S g_S v_2^S)_T-(\rho_S g_S v_2^S)_P\}+A_{wt}\{(\rho_S g_S v_3^S)_{wt}-(\rho_S g_S v_3^S)_{et}\} \quad (E.\ 41)$$

As for Z direction staggered grid of orthogonal and cylindrical coordinates:

$$S_t = -\left(\frac{\mu g_L}{K_2}\right)_t \Delta V_t \quad (E.42)$$

$$S_{c,t}=(GF_2+EMF_2)_t \cdot \Delta V_t \quad (E.\ 43)$$

As for Z direction staggered grid of curvilinear coordinates system (FIG. 9): all common except that $S_{c,t}$ and $S_t$ are given by the following equations.

$$S_t = -\left(\frac{\mu g_L}{K_2}\right)_t \Delta V_t - (\rho_L g_L)_t \langle -v_{1,t}^*, 0\rangle \Delta x_1 \Delta x_3 \Delta\theta - \mu_t \ln\left(\frac{r_{st}}{r_{nt}}\right)\Delta x_3 \Delta\theta \quad (E.44)$$

$$S_{c,t} = (GF_2 + EMF_2)_t \cdot \Delta V_t + (\rho_L g_L)_t \langle v_{1,t}^*, 0\rangle v_{2,t}^* \Delta x_1 \Delta x_3 \Delta\theta - 2\mu_t (v_{1,T} - v_{1,P}) \ln\left(\frac{r_{st}}{r_{nt}}\right) \cdot \Delta x_3 \quad (E.45)$$

$$D_{nt}=\mu_{nt}/\delta nnt;\ F_{nt}=(\rho_L g_L v_1)_{nt} \quad (E.\ 46, 47)$$

$$D_{st}=\mu_{st}/\delta sst;\ F_{st}=(\rho_L g_L v_1)_{st} \quad (E.\ 48, 49)$$

$$D_T=\mu_T/\delta tt;\ F_T=(\rho_L g_L v_2)_T \quad (E.\ 50, 51)$$

$$D_P=\mu_P/\delta b;\ F_P=(\rho_L g_L v_2)_P \quad (E.\ 52, 53)$$

$$D_{wt}=\mu_{wt}/\delta W;\ F_{wt}=(\rho_L g_L v_3)_{wt} \quad (E.\ 54, 55)$$

$$D_{et}=\mu_{et}/\delta E;\ F_{et}=(\rho_L g_L v_3)_{et} \quad (E.\ 56, 57)$$

Using the staggered grid in $X_3$ (Y) direction (refer to FIG. 41(*c*)), The discretization equation of $v_3$ is as follows (suffix 3 is ommited for brebity).

$$a_w v_w=a_{NW} v_{NW}+a_{SW} v_{SW}+a_{TW} v_{TW}+a_{BW} v_{BW}+a_{ww} v_{ww}+a_e v_e++(P_P-P_W)\cdot A_w \quad (E.\ 58)$$

$$a_w=a_{NW}+a_{SW}+a_{TW}+a_{BW}+a_{ww}+a_e+a_w^0-S_w \quad (E.\ 59)$$

$$a_{NW}=[D_{nw} A(|P_{nw}|)+<-F_{nw},0>]A_{nw} \quad (E.\ 60)$$

$$a_{SW}=[D_{sw} A(|P_{sw}|)+<F_{sw},0>]A_{sw} \quad (E.\ 61)$$

$$a_{TW}=[D_{tw} A(|P_{tw}|)+<-_{tw},0>]A_{tw} \quad (E.\ 62)$$

$$a_{BW}=[D_{bw} A(|P_{bw}|)+<F_{bw},0>]A_{tw} \quad (E.\ 63)$$

$$a_{ww}=[D_w A(|P_w|)+<-F_w,0>]A_w \quad (E.\ 64)$$

$$a_e=[D_P A(|P_P|)+<F_P,0>]A_w \quad (E.\ 65)$$

$$a_w^0 = (\rho_L g_L + \bar{p}^{old} - \bar{p})_w \Delta \frac{V_w}{\Delta t} \quad (E.66)$$

$$b=a_w^{old} v_w^{old}+S_{c,w}+v_w^*[\nabla\cdot(\rho_S g_S V_S)]_w \quad (E.\ 67)$$

$$a_w^{old} = (\rho_L g_L)_w^{old} \Delta \frac{V_w}{\Delta t} \quad (E.68)$$

$$[\nabla\cdot(\rho_S g_S v_S)]_w=A_{nw}(\rho_S g_S v_1^S)_{nw}-A_{sw}(\rho_S g_S v_1^S)_{sw}$$
$$+A_{tw}\{(\rho_S g_S v_2^S)_{tw}-(\rho_S g_S v_2^S)_{bw}\}+A_w\{(\rho_S g_S v_3^S)_W-(\rho_S g_S v_3^S)_P\} \quad (E.\ 69).$$

As for Y direction staggered grid of curvilinear (FIG. 9) and orthogonal coordinates systems:

$$S_w = -\left(\frac{\mu g_L}{K_3}\right)_w \Delta V_w \quad (E.70)$$

$$S_{c,w}=(GF_3+EMF_3)_w \Delta V_w \quad (E.\ 71)$$

As for θ direction staggered grid (omitted for want of space) of cylindrical coordinates (r,θ, z):

$$S_w = -\left(\frac{\mu g_L}{K_3}\right)_w \Delta V_w - (\rho_L g_L)_w \langle v_{1,w}^*, 0\rangle \Delta r \Delta\theta \Delta z - \mu_w \ln\left(\frac{r_{nw}}{r_{sw}}\right) \cdot \Delta\theta \Delta z \quad (E.72)$$

$$S_{c,w} = (GF_3 + EMF_3)_w \Delta V_w + (\rho_L g_L)_w \langle -v_{1,w}^*, 0\rangle v_{3,w}^* \Delta r \Delta\theta \Delta z + 2\mu_w (v_{1,W} - v_{1,P}) \ln\left(\frac{r_{nw}}{r_{sw}}\right) \cdot \Delta z \quad (E.73)$$

$$D_{nw}=\mu_{nw}/\delta NW;\ F_{nw}=(\rho_L g_L v_1)_{nw} \quad (E.\ 74, 75)$$

$$D_{sw}=\mu_{sw}/\delta SW;\ F_{sw}=(\rho_L g_L v_1)_{sw} \quad (E.\ 76, 77)$$

$$D_{tw}=\mu_{tw}/\delta TW;\ F_{tw}=(\rho_L g_L v_2)_{tw} \quad (E.\ 78, 79)$$

$$D_{bw}=\mu_{bw}/\delta BW;\ F_{bw}=(\rho_L g_L v_2)_{bw} \quad (E.\ 80, 81)$$

$$D_W=\mu_W/\delta ww;\ F_w=(\rho_L g_L v_3)_w \quad (E.\ 82, 83)$$

$$D_P=\mu_P/\delta e;\ F_P=(\rho_L g_L v_3)_P \quad (E.\ 84, 85)$$

Pressure discretization equation:

The discretization equation regarding the pressure in the momentum equations Eqs. (E. 1), (E. 30) and (E. 58) are derived by combining these momentum equations with the continuity equation (Eq. (9)), similarly as in the case of Darcy analysis. For this, the momentum equations are deformed as follows.

$$v_{1,n} = \frac{\sum a_{nb} v_{1,nb} + b}{a_n} + \frac{P_P - P_N}{a_n} \cdot A_{PN} = \hat{v}_{1,n} + d_n (P_P - P_N) \quad (E.86)$$

-continued $$v_{1,s} = \frac{\sum a_{nb} v_{1,nb} + b}{a_S} + \frac{P_P - P_S}{a_S} \cdot A_{PS} = \hat{v}_{1,s} + d_s(P_S - P_P) \quad \text{(E.87)}$$

$$v_{2,t} = \frac{\sum a_{nb} v_{2,nb} + b}{a_t} + \frac{P_P - P_T}{a_t} \cdot A_t = \hat{v}_{2,t} + d_t(P_P - P_T) \quad \text{(E.88)}$$

$$v_{2,b} = \frac{\sum a_{nb} v_{2,nb} + b}{a_b} + \frac{P_P - P_B}{a_b} \cdot A_t = \hat{v}_{2,b} + d_b(P_B - P_P) \quad \text{(E.89)}$$

$$v_{3,w} = \frac{\sum a_{nb} v_{3,nb} + b}{a_w} + \frac{P_P - P_W}{a_w} \cdot A_w = \hat{v}_{3,w} + d_w(P_P - P_W) \quad \text{(E.90)}$$

$$v_{3,e} = \frac{\sum a_{nb} v_{3,nb} + b}{a_e} + \frac{P_P - P_E}{a_e} \cdot A_w = \hat{v}_{3,e} + d_e(P_E - P_P) \quad \text{(E.91)}$$

Symbol Σ is the sum of the products of the coefficients and the velocities of surroundings. Substituting the above Eqs. (E. 86) to (E. 91) into Eq. (D. 4) and arranging with respect to P, the discretization equation of P is obtained. P is, as seen from Eq. (E. 92), defined not in the staggered grid but in the original grid (refer to FIGS. 8 and 9).

$$a_P P_P = a_N P_N + a_S P_S + a_T P_T + a_B P_B + a_W P_W + a_E P_E + b \quad \text{(E. 92)}$$

$$a_P = a_N + a_S + a_T + a_B + a_W + a_E \quad \text{(E. 93)}$$

$$a_N = (\rho_L g_L)_n d_n A_n;\ d_n = A_{PN}/a_n \quad \text{(E. 94, 95)}$$

$$a_S = (\rho_L g_L)_s d_s A_s;\ d_s = A_{PS}/a_s \quad \text{(E. 96, 97)}$$

$$a_T = (\rho_L g_L)_t d_t A_t;\ d_t = A_t/a_t \quad \text{(E. 98, 99)}$$

$$a_B = (\rho_L g_L)_b d_b A_t;\ d_b = A_t/a_b \quad \text{(E. 100, 101)}$$

$$a_W = (\rho_L g_L)_w d_w A_w;\ d_w = A_w/a_w \quad \text{(E. 102, 103)}$$

$$a_E = (\rho_L g_L)_e d_e A_w;\ d_e = A_w/a_e \quad \text{(E. 104, 105)}$$

$$b = (\bar{\rho}^{old} - \bar{\rho})_P \Delta \frac{V}{\Delta t} + (\rho_L g_L \hat{v}_1)_s A_s - (\rho_L g_L \hat{v}_1)_n A_n + \{(\rho_L g_L \hat{v}_2)_b - (\rho_L g_L \hat{v}_2)_t\} A_t + \{(\rho_L g_L \hat{v}_3)_e - (\rho_L g_L \hat{v}_3)_w\} A_w - [\nabla \cdot (\rho_s g_s v_S)] \quad \text{(E.106)}$$

The term $-[\nabla \cdot (\rho_S g_S V_S)]$ in Eq. (E. 106) is given by Eq. (D. 33) (note the negative sign in front of bracket [ ]).

Pressure correction and velocity correction equations:

If the velocity field is converged in iterative computations, the pressure field can be obtained at once by solving the pressure equation. Thus, it is required to correct the velocity field. For this, correct the pressure field first. This is the iterative solution method by SIMPLER algorithm.

The algorithm is as follows: now, put as follows.

$$P\ (\text{solution}) = P^*\ (\text{updated value}) + P'(\text{correction}) \quad \text{(E. 107)}$$

$$V\ (\text{solution}) = v^*\ (\text{updated value}) + v'(\text{correction}) \quad \text{(E. 108)}$$

The momentum equations for P and P* are given respectively as follows.

$$a_n v_{1,n} = \Sigma a_{nb} v_{1,nb} + b + (P_P - P_N) A_{PN} \quad \text{(E. 109)}$$

$$a_n v_{1,n} = \Sigma a_{nb} v_{1,nb}^* + b + (P_P^* - P_N) A_{PN} \quad \text{(E. 110)}$$

Take the difference between the above two equations and regard as follows (for the sake of convenience).

$$a_n v'_{1,n} = \sum a_{nb} v'_{1,nb} + (P'_P - P'_N) A_{PN} \equiv (P'_P - P'_P) A_{PN} \quad \text{(E.111)}$$

$$v'_{1,n} = (P'_P - P'_N) \frac{A_{PN}}{a_n} = d_n (p'_P - P'_N)$$

By substituting Eq. (E. 111) back to Eq. (E. 108), a series of velocity correction equations are obtained as follows:

$$v_{1,n} = v_{1,n}^* + d_n(P'_P - P'_N) \quad \text{(E. 112)}$$

$$v_{1,s} = v_{1,s}^* + d_s(P'_S - P'_P) \quad \text{(E. 113)}$$

$$v_{2,t} = v_{2,t}^* + d_t(P'_P - P'_T) \quad \text{(E. 114)}$$

$$v_{2,b} = v_{2,b}^* + d_b(P'_B - P'_P) \quad \text{(E. 115)}$$

$$v_{3,w} = v_{3,w}^* + d_w(P'_P - P'_W) \quad \text{(E. 116)}$$

$$v_{3,e} = v_{3,e}^* + d_e(P'_E - P'_P) \quad \text{(E. 117)}$$

$d_n$, . . . are given by Eq. (E. 95) . . . . Substituting Eqs. (E. 112) to (E. 117) into the continuity Eq. (D. 4) and arranging with respect to P', the pressure correction equation is derived as follows.

$$a_P P'_P = a_N P'_N + a_S P'_S + a_T P'_T + a_B P'_B + a_W P'_W + a_E P'_E + b \quad \text{(E. 118)}$$

Where the coefficients $a_P$ and $a_N$, . . . are given by Eq. (E. 93) and Eq. (E. 94), . . . , respectively. b is given by Eq. (E. 106). Yet, $v_{1,n}^*$, . . . are used instead of $\hat{v}_{1,n}$, . . . . Also, when v* field is converged, b=0; therefore, the convergency is judged by if b≈0 (a small number).

References:

1) Masanori Hashio, Isao Yamazaki, Mikio Yamashita, Mamoru Toyoda, Morio Kawasaki and Keiji Nakajima: "Reduction of Central Segregation by Forced Cooling and Split Rolls", Tetsu To Hagane, vol. 73 (1987), p. S204 (in Japanese)

2) Hisao Yamazaki, Mairu Nakado, Takeshi Saitou, Tutomu Yamazaki, Katuo Kinoshita and Toshio Fujimura: "Reduction of Central Porosity by Forced Cooling at the Last Stage of Solidification in Continuous Casting of blooms", Tetsu To Hagane, vol. 73 (1987), p. S902 (in Japanese)

3) Kohichi Isobe, Hirobumi Maede, Kiyomi Syukuri, Satoru Satou, Takashi Horie, Mitsuru Nikaidou and Isao Suzuki: "Development of Soft Reduction Technology Using Crown Rolls for Improvement of Centerline Segregation of Continuously Cast Bloom", Tetsu To Hagane, vol. 80 (1994), p. 42 (in Japanese)

4) Satoshi Sugimaru, Kenichi Miyazawa, Toshio Kikuma, Hiromi Takahashi and Shigeaki Ogibayashi: "Theoretical analysis on the suppression of solidification shrinkage flow in continuously cast steel bloom", CAMP-ISIJ, vol. 6 (1993), p. 1192 (in Japanese)

5) Hajime Amano, Gen Takahashi, Shuichi Nakatubo, Inagaki Yoshio, Ken Morii and Shizunori Hayakawa, "Improvement of Center Quality of Continuously Cast Round Bloom by Soft Reduction", CAMP-IJIS, vol. 7 (1994), p. 194 (in Japanese)

6) Isao Takagi, Isamu Wakasugi, Takanori Konami, Kohji Fujii, Gorou Akaishi and Kenzoh Ayata: "Improvement of Center Defects in Cast Bloom by Hard Reduction", CAMP-IJIS, vol. 7 (1994), p. 183 (in Japanese)

7) Seiji Nabeshima, Hakaru Nakato, Tetsuya Fujii, Kohichi Kushida, Hisakazu Mizota and Toshio Fujita: "Controlling of Centerline Segregation of Continuously Cast Bloom by Continuous Forging Process", Tetsu To Hagane, vol. 79 (1993), p. 479 (in Japanese)

8) Seiji Nabeshima, Hakaru Nakato, Hisakazu Mizota, Takeshi Asahina, Hajime Umada and Masanobu Kawabuchi: "Control of centerline segregation in continuously cast blooms with continuous forging process", CAMP-ISIJ, vol. 7 (1994), p. 179 (in Japanese)

9) Touru Kitagawa: "Recent progress in the continuous casting technology of steel II", 110th and 111th Nishiyama memorial lecture (1986), p. 163 (in Japanese)

10) Tadao Watanabe, Atsushi Satou, Katsuma Yoshida and Mamoru Toyoda and Morio Kawasaki: "Influence of Liquid Flow at the Final Solidification Stage on Centerline Segregation in Continuously Cast Slabs", CAMP-ISIJ, vol. 2 (1989), p. 1146 (in Japanese)

11) Akihiro Yamanaka, Kazunari Kimura, Masamichi Suzuki, Yasuo Hitomi and Katsuyoshi Iwata: "Improvement of center segregation and center porosity in continuously cast bloom and round billet", CAMP-ISIJ, vol. 7 (1994), p. 186 (in Japanese)

12) F. P . Pleschiutschnigg, G. Gosio, M. Morando, L. Manini, C. Maffini, U. Siegers, B Kruger, H. G. Thurm, L. Parschat, D. Stalleicken, P. Meyer, E. Windhaus, I. Von Hagen: MPT-Metallurgical Plant and Technology International, No. 2 (1992)

13) G. Gosio, M. Morando, L. Manini, A. Guindani, F. P. Pleschiutschnigg, B. Kruger, H . D. Hoppmann, I. V. Hagen: "The Technology of Thin Slab Casting, Production and Product Quality at the Arvedi I. S. P. Works, Cremona", 2nd European Continuous Casting Conference, Dusseldolf, Jun. 20–22 (1994), p. 345

14) M. C. Flemings: "Solidification Processing", McGraw-Hill, Inc. (1974), p. 77

15) Yoshio Ebisu: "Research on the Mechanical Behavior during Solidification and Subsequent Cooling Processes of Metals", Yokohama National University, Doctoral Thesis (1992), p. 79

16) T. Fujii, D. R. Poirier and M. F. Flemings: "Macrosegregation in a Multicomponent Low Alloy Steel", Metallurgical Transaction B, vol. 10B (1979), p. 331

17) P. C. Carman: Trans. Inst. Chem. Eng. , Vol. 15 (1937), p. 150

18) Kimio Kubo and Tatsuichi Fukusako: "Computer simulation of dendritic solidification process", Japan Society of Metals, Symposium on the formation of casting defects (October, 1983), p. 204 (in Japanese)

19) K. Kubo, R. D. Pehlke: "Mathematical Modeling of Porosity Formation in Solidification", Metallurgical Transaction B, Vol. 16 B (1985), p. 359

20) S. V. Patankar: Numerical Heat Transfer and Fluid Flow,McGraw-Hill, Inc. (1980), p. 149

21) Yoshio Ebisu, Kazuyoshi Sekine and Masujiroh Hayama: "Analysis of Thermal and Residual Stresses of a Low Alloy Cast Steel Ingot by the Use of Viscoplastic Constitutive Equations Considering Phase Transformation", Tetsu To Hagane, vol. 78 (1992), p. 894 (in Japanese)

22) Saburo Adachi: "Electromagnetic Theory", Shokohdo (first edition, 1989) (in Japanese)

23) The Iron and Steel Institute of Japan, Edited by Solidification Dept.: "The collection of data on the solidification of iron and steel" (1977), Appendix p. 3 (in Japanese)

24) E. A. Mizikar: "Mathematical Heat Transfer Model for Solidification of Continuously Cast Steel Slabs", Trans. Met. Soc. , AIME, Vol. 239 (1967), p. 1747

25) Toru Yoshida, Tadashi Atsumi, Wataru Ohashi, Koji Kagaya, Osamu Tsubakihara, Hiromu Soga and Katsuhiro Kawashima: "On-line Measurement Solidification Shell Thickness and Estimation Crater-end Shape of CC-slabs by Electromagnetic Ultrasonic Method", Tetsu To Hagane, vol. 70 (1984), p. 1123 (in Japanese)

26) Akihiko Kamio: "The Solidification Structure of Ingot", Light Metals Society of Japan, Report No. 6 of Research Dept. (1984), p. 45 (in Japanese)

27) Takateru Umeda: "Foundation of The Solidification Phenomena", Japan Iron and Steel organization publishing, 153rd and 154th Nishiyama memorial lecture (1994), p. 67 (in Japanese)

28) Takahiro Kashida, Hiroo Ohtani: "Tube & Pipe for Production and Transportation of Oil and Gas", Tetsu To Hagane, vol. 80 (1994), p. 263 (in Japanese)

29) Fukuyama Works and Technical Research Center: "High Strength Line Pipe for Sour Gas Service", NKK Technical Report No. 110 (1985), p. 101 (in Japanese)

30) W. C. Leslie: "The Physical Metallurgy of Steels", (1981) [McGraw-Hill]

Japanese Edition, edited by Nariyasu Kohda, translated by Hiroshi Kumai and Tatsuhiko Noda, (1985), p. 273 [Maruzen]

31) Masaru Wakabayashi and Shinji Hayase: "Planning and Designing of Wide Slab Continuous Casting Plant", Hitachi Zohsen Technical Report, vol. 34 (1973), p. 65

32) K. Murakami, A. Shiraishi and T. Okamoto: "Fluid Flow in Interdendritic Space in Cunbic Alloys", Acta Metall. , Vol. 32 (1984), p. 1423

33) Takeshi Takawa, Tutomu Takamoto, Hiroshi Tomono, Keigo Okuno, Hirotaka Miki and Yoshitoshi Enomoto: "Control Technology of Secondary Cooling Process in Round Billet Continuous Casting Based on a Mathematical Model", Tetsu To Hagane, vol. 74 (1988), p. 2294 (in Japanese)

34) J. M. Middlaton and W. J. Jackson: "Compressed air feeder heads," The British Foundryman, November 1962, p. 443

35) W. S. Pellini: "Factors which determine riser adequacy and feeding range", Trans. AFS, vol. 61 (1953), p. 61

TABLE 1

| Explanation of symbols used in this description | |
|---|---|
| Energy equation: | |
| T | Temperature (° C.) |
| t | Time (s) |
| $\Delta t$ | Time increment in computation (s) |
| $c_p^L$, $c_p^S$ | Specific heat of liquid and solid (cal/g ° C.) |
| $\rho_L$, $\rho_S$ | Density of liquid and solid (g/cm3) |
| $\lambda_L$, $\lambda_S$ | Thermal conductivity of liquid and solid (cal/cm s ° C.) |
| $g_S$ | Volume fraction of solid |
| $g_L$ | Volume fraction of liquid |
| $g_V$ | Volume fraction of porosity |
| $\bar{\rho}$ | Average density (g/cm3) of mushy zone: given by $\rho_S g_S + \rho_L g_L$ |
| $\bar{\lambda}$ | Average thermal conductivity (cal/cm s ° C.) of mushy zone: given by $\lambda_S g_S + \lambda_L g_L$ |
| $\mathbf{V}_L$ | Liquid flow velocity vector (cm/s) |
| $\mathbf{V}_S$ | Deformation velocity vector of solid (cm/s) |
| L | Latent heat of fusion (cal/g) |
| $Q_J$ | Heat of Joule by electric current (cal/cm3s) |
| Solute redistribution equation: | |
| $C_n^L$ | Liquid concentration of solute element n (wt %) |

TABLE 1-continued

| Explanation of symbols used in this description | |
|---|---|
| $\overline{C}_n^S$ | Average solid concentration of solute element n (wt %) |
| $\overline{C}_n$ | Average concentration of solute element n in mushy phase (wt %) |
| $D_n^L$ | Diffusion coefficient of solute element n in liquid ($cm^2/s$): given by $D^L = D_0 \exp(-Q/RT)$ $D_0$ = Diffusion constant ($cm^2/s$) Q = Activation energy of diffusion (cal/mol) R = Gas constant, 1.987 (cal/molK) T = Absolute temperature (K.) |
| $C_n^{S*}$ | Solid concentration of solute n at solid-liquid interface (wt %) |
| $m_n^L$; $m_n^S$ | Slope of liquidus and solidus line of solute element n (° C./wt %) |
| $T_M$ | Melting point of base metal (° C.) |
| $C_n^0$ | Solute content of alloy element n (wt %) |
| $T_n^0$ | Starting temperature of solidification for $C_n^0$ in an alloy of base metal-alloy element n phase diagram. |
| $g_S^{old}$ | Volume fraction of solid at time t − Δt (s) |
| $g_V^{old}$ | Volume fraction of porosity at time t − Δt (s) |
| β | Solidification contraction defined by $(\rho_S - \rho_L)/\rho_S$ |
| Darcy equation and Momentum equation | |
| μ | Viscosity of liquid (dyn s /$cm^2$) |
| K | Permeability ($cm^2$) |
| P | Liquid Pressure (dyn/$cm^2$) |
| **X** | Body force vector (dyn/$cm^3$) |
| $g_r$ | Acceleration due to gravity 980.67 cm/$s^2$) |
| Sb | Specific surface area of dendrite crystal ($cm^2/cm^3$) |
| f | Dimensionless constant in permeability K having the value of 5.0 |
| ϕ | Configuration coefficient of dendrite cell. ⅔ for cylinder. |
| d | Diameter of dendrite cell (cm) |
| $\sigma_{LS}$ | Surface energy at solid-liquid interface (cal/$cm^2$) |
| Electromagnetic analysis | |
| **f** | Electromagnetic body force vector (Lorentz force) (N/$m^3$) |
| J, **J** | Current density, Current density vector (A/$m^2$) |
| **B** | Magnetic flux density vector (Tesla) |
| σ | Electric conductivity (1/Ωm) |
| **E** | Electric field vector (V/m) |
| ϕ | Electric potential (V) |

TABLE 2

Physical properties of 1C—1Cr steel and 0.55% carbon steel

Figure 25:
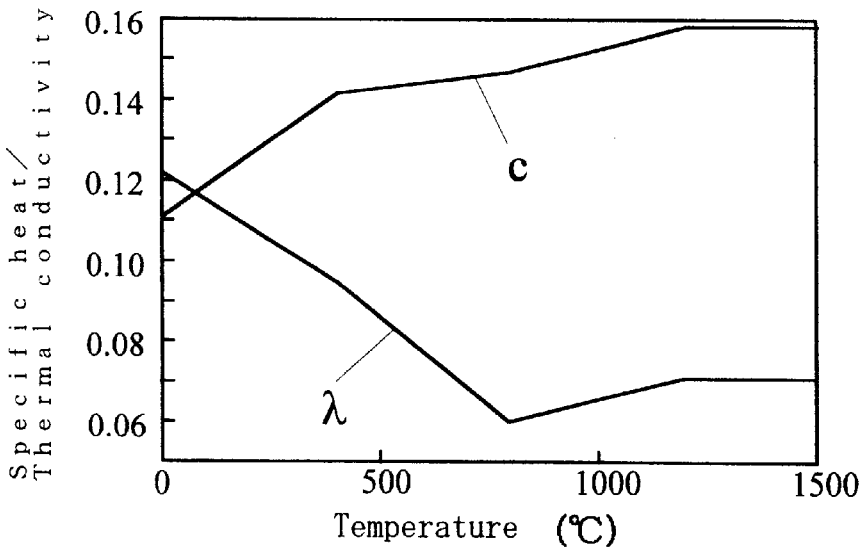
FIG. 25 shows the specific heat C (cal/g° C.) and the thermal conductivity $\lambda$ (cal/cms° C.) of 0.55% carbon steel.
Figure 26:
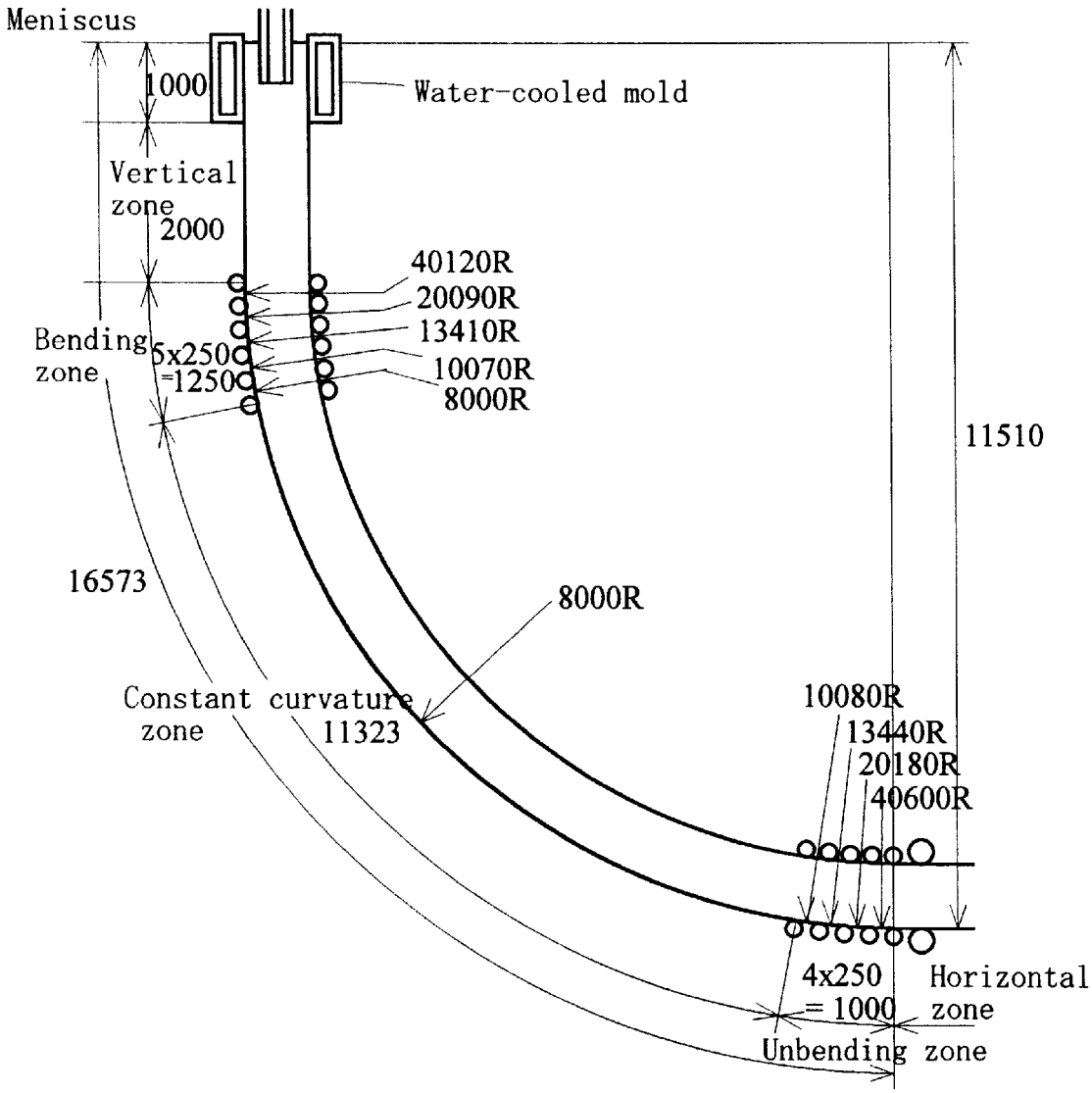
FIG. 26 shows the schematic diagram of the typical vertical bending continuous caster used for the example No.2 for carrying out the invention. In the diagram, the supporting rolls and water-spray cooling unit are not shown except for bending and unbending rolls.

| | 1C—1Cr bearing steel | 0.55% C steel |
|---|---|---|
| Specific heat of liquid $C_L$ (cal/g ° C.) | 0.15 | 0.158 |
| Specific heat of solid $C_S$ (cal/g ° C.) | 0.15 | FIG. 25 |
| Thermal conductivity of liquid $\lambda_L$ (cal/cms ° C.) | 0.083 | 0.071 |
| Thermal conductivity of solid $\lambda_S$ (cal/cms ° C.) | 0.064 | FIG. 25 |
| Solid density (austenite) $\rho_S$ (g/$cm^3$) | 7.34 | 7.30 |
| Density of pearlite $\rho_P$ (g/$cm^3$) | 7.8 | 7.8 |
| Latent heat of fusion L (cal/g) | 66.0 | 65.0 |
| Viscosity of liquid μ (poise) | 0.085 | 0.08 |
| Radiation coefficient at surface ε | 0.3 | 0.3 |
| Latent heat of pearlitic transformation Lp (cal/g) | 20.0 | 20.0 |
| Upper temp. of pearlitic transformation (° C.) | 735.0 | 760.0 |
| Lower temp. of pearlitic transformation (° C.) | 400.0 | 300.0 |
| Surface tension at liquid-CO gas interface $\sigma_{LV}$ (dyn/cm) | 1700.0 | 1700.0 |

TABLE 2-continued

Constant in liquid density by $\rho_L = \rho_L^0 + \sum_n h_n C_n^L + h^0 T_L$ :

Constant $\rho_L^0$ (g/$cm^3$) = 9.265
Constant $h^0$ (g/$cm^3$) = −1.45 × $10^{-3}$

| $h_n$ (g/$cm^3$ · wt %) Equilibrium partition ratio | | |
|---|---|---|
| C | −0.08 | Locally linearized (FIG. 14) |
| Si | −0.087 | 0.5 |
| Mn | −0.014 | 0.75 |
| Cr | −0.059 | 0.85 |
| Ni | 0.004 | 0.95 |
| P | −0.084 | 0.06 |
| S | −0.09 | 0.05 |

Physical properties in Sb equation Eq. (28)
Configuration factor of dendrite ϕ = 0.67
Solid-liquid interfacial energy $\sigma_{LS}$ (cal/$cm^2$) = 6 × $10^{-6}$ $D_0^L$ and Q in diffusion coefficient $D^L = D_0^L \exp(-Q/RT)$
$D_0^L$ ($cm^2/s$) activation energy Q (cal/mol)

| | | |
|---|---|---|
| C | 1.74 × $10^{-3}$ | 7570 |
| Si | 7.1 × $10^{-4}$ | 14000 |
| Mn | 2.24 × $10^{-4}$ | 8000 |
| Cr | 2.67 × $10^{-3}$ | 16000 |
| Ni | 7.5 × $10^{-3}$ | 14000 |
| P | 3.1 × $10^{-3}$ | 11000 |
| S | 2.8 × $10^{-4}$ | 7500 |

Gas constant R = 1.987 (cal/K · mol)
Correction factor α: 1.2 for 1C—1Cr steel
1.0 for 0.55% C steel (no correction)

TABLE 3

Symbols and physical properties in the equations of equilibrium partial pressure of CO gas

| Symbol | | 1C—1Cr steel | 0.55% C steel |
|---|---|---|---|
| Pco | Equilibrium CO gas pressure (atm) | | |
| $C_0$ | Carbon content (wt %) | 1.0 | 0.55 |
| $O_0$ | Oxygen content (wt %) | 0.003 | 0.003 |
| $Si_0$ | Si content (wt %) | 0.2 | 0.2 |
| $C_L$ | Carbon concentration in liquid (wt %) | | |
| $C_S$ | Carbon concentration in solid (wt %) | | |
| $O_L$ | Oxygen concentration in liquid (wt %) | | |
| $O_S$ | Oxygen concentration in solid (wt %) | | |
| $Si_L$ | Si concentration in liquid (wt %) | | |
| $\rho_S$ | Density of solid (g/$cm^3$) | 7.34 | 7.30 |
| $\rho_L$ | Density of liquid (g/$cm^3$) | 7.00 | 7.00 |
| Kco | Equilibrium constant ((wt %)$^2$/atm) | 0.002 | 0.0021 |
| $KSiO_2$ | Equilibrium constant ((wt %)$^2$/atm) | 1.94 × $10^{-7}$ | 7.21 × $10^{-7}$ |
| | (Kco and are the values at the average temperatures of 1390° C. and 1443° C. in solidification temperature range, respectively) | | |
| $k_{Fe—C}$ | Equilibrium partition ratio in Fe—C system | 0.39 | 0.37 |
| $k_{Fe—O}$ | Equilibrium partition ratio in Fe—O system | 0.076 | 0.076 |
| $k_{Fe—Si}$ | Equilibrium partition ratio in Fe—Si system | 0.5 | 0.5 |
| $\alpha_C$ | Constant in Eq. (38) $14.6/(\rho_S g_S + \rho_L g_L)$ | | |
| $\alpha_O$ | Constant in Eq. (39) $19.5/(\rho_S g_S + \rho_L g_L)$ | | |
| | (Note: $\alpha_C$ and $\alpha_O$ are obtained by applying the state equation of gas to CO gas pore) | | |

TABLE 3-continued

| Symbols and physical properties in the equations of equilibrium partial pressure of CO gas | | | |
|---|---|---|---|
| Symbol | | 1C—1Cr steel | 0.55% C steel |
| $\Delta SiO_2$ | Amount of $SiO_2$ (wt %) | | |
| $\gamma$ | Constant in Eq. (44) | 0.467 | |

What is claimed is:

1. A continuous casting method comprising the steps of:

exerting an electromagnetic body force (Lorentz force) toward a casting direction onto a solid-liquid coexisting zone of a cast piece, in such a magnitude so as to prevent formation of an internal defect of at least one of microporosity and central segregation (V segregation) in the entire solid-liquid coexisting zone.

2. The continuous casting method as claimed in claim 1, further comprising the step of exerting the electromagnetic body force on a region of the solid-liquid coexisting zone in the vicinity of the final solidification portion of said cast piece.

3. The continuous casting method as claimed in claim 1, further comprising the steps of: exerting the electromagnetic body force on a region of the solid-liquid coexisting zone of said cast piece, and providing said electromagnetic body force (Lorentz force) with a magnitude sufficient to maintain the interdendritic liquid pressure larger than the critical pressure of porosity formation.

4. The continuous casting method as claimed in claim 3, wherein said exerting region is defined as a formation range of internal defects or at the upstream side of said formation range in the solid-liquid coexisting zone, and further comprising the step of calculating both said formation range of internal defects and said magnitude of the electromagnetic body force on the basis of operating parameters which include at least one of a profile of continuous caster, alloy composition, cross-sectional shape and dimensions, casting temperature, casting speed and cooling conditions at the surface of said cast piece.

5. The continuous casting method as claimed in claim 3, wherein said exerting region is defined as a formation range of internal defects or at the upstream side of said formation range in the solid-liquid coexisting zone, further comprising the step of calculating both said formation range of internal defects and said magnitude of the electromagnetic body force on the basis of operating parameters which include at least one of a profile of continuous caster, alloy composition, cross-sectional shape and dimensions, casting temperature, casting speed, cooling conditions at the surface, dissolved gas contents in liquid phase and deformation velocity due to bending, unbending, and reduction of said cast piece.

6. The continuous casting method as claimed in claim 4, further comprising the step of determining the exerting zone of said electromagnetic body force (Lorentz force) from the position of porosity formation which is obtained on the basis of the pressure drop of the liquid phase caused by the interdendritic liquid flow in the solid-liquid coexisting zone of said cast piece.

7. The continuous casting method as claimed in claim 5, further comprising the step of determining the exerting zone of said electromagnetic body force (Lorentz force) from the position of porosity formation which is obtained on the basis of the pressure drop of the liquid phase caused by the interdendritic liquid flow in the solid-liquid coexisting zone of said cast piece.

8. The continuous casting method as claimed in claim 4, further comprising the step of correcting the magnitude of said electromagnetic body force (Lorentz force) and said formation range of internal defects by corrected values obtained on the basis of the measured values.

9. The continuous casting method as claimed in claim 5, further comprising the step of correcting the magnitude of said electromagnetic body force (Lorentz force) and said formation range of internal defects by corrected values obtained on the basis of the measured values.

10. The continuous casting method as claimed in claim 8, further comprising the step of obtaining said corrected values on the basis of the measured data by experiments.

11. The continuous casting method as claimed in claim 9, further comprising the step of obtaining said corrected values on the basis of the measured data by experiments.

12. The continuous casting method as claimed in claim 1, further comprising the step of applying a reduction gradient to the cast piece in the exerting region of said electromagnetic body force or in its vicinity.

13. The continuous casting method as claimed in claim 12, wherein said reduction gradient is smaller than a solidification contraction gradient in the solid-liquid coexisting zone of said cast piece, further comprising the step of applying the reduction gradient through the surface of said cast piece.

14. The continuous casting method as claimed in claim 12, further comprising the steps of applying said reduction gradient by passing the cast piece between a plural number of pairs of rolls of a roll reduction unit, adjusting a resulting drawing resistant force of said cast piece and the electromagnetic body force (Lorentz force) applied toward the casting direction to hold these two forces at a proper balance, and providing said roll reduction unit a driving force toward the drawing direction or a braking force to a direction opposite to the direction of drawing.

15. The continuous casting method as claimed in claim 13, further comprising the steps of applying said reduction gradient by passing the cast piece between a plural number of pairs of rolls of a roll reduction unit, adjusting a resulting drawing resistant force of said cast piece and the electromagnetic body force (Lorentz force) applied toward the casting direction to hold these two forces at a proper balance, and providing said roll reduction unit a driving force toward the drawing direction or a braking force to a direction opposite to the direction of drawing.

16. The continuous casting method as claimed in claim 1, further comprising the step of applying a braking force onto the cast piece in a complete solid zone of the cast piece at the downstream side of where the electromagnetic body force is exerted on the cast piece.

17. In a continuous casting apparatus, the improvement comprising:

means for exerting an electromagnetic body force to exert an electromagnetic body force (Lorentz force) toward a casting direction onto a solid-liquid coexisting zone of a cast piece, in order to suppress formation of internal defects of at least one of microporosity and central segregation (V segregation), wherein said means for exerting an electromagnetic body force is arranged to exert said electromagnetic body force (Lorentz force) with a magnitude sufficient to hold an interdendritic liquid pressure larger than the critical pressure of porosity formation onto the solid-liquid coexisting zone of said cast piece; and calculator means for calculating the magnitude of said electromagnetic body force (Lorentz force) and the formation range of internal defects in the solid-liquid coexisting zone of said cast piece, on the basis of operating parameters including at least profile of continuous caster, alloy composition, cross-sectional shape and dimensions, casting temperature, casting speed and cooling conditions at the surface of said cast piece, said electromagnetic body force exerting device exerting said electromagnetic body force onto said formation range of internal depths or at the upstream side of that range.

18. The continuous casting apparatus as claimed in claim 17, wherein said means for exerting an electromagnetic body force is arranged to exert said electromagnetic body force (Lorentz force) toward the casting direction onto the solid-liquid coexisting zone in the vicinity of the final solidification portion of said cast piece.

19. The continuous casting apparatus as claimed in claim 17, wherein said calculating means includes means for calculating the position of porosity formation, on the basis of the pressure drop of the liquid phase caused by the interdendritic liquid flow in the solid-liquid coexisting zone of said cast piece, and wherein said exerting region of electromagnetic body force is determined based on the calculated position.

20. The continuous casting apparatus as claimed in claim 17, wherein said calculating means includes correction means for correcting said magnitude of electromagnetic body force (Lorentz force) and said formation range of internal defects, on the basis of measured values.

21. The continuous casting apparatus as claimed in claim 20, wherein said correction means includes means for conducting calculation processing, on the basis of data measured by experiments.

22. The continuous casting apparatus as claimed in claim 20, wherein said correction means performs real time feed back control for said magnitude of electromagnetic body force, said formation range of internal defects and operating parameters, on the basis of the measured data of operating parameters.

23. The continuous casting apparatus as claimed in claim 17, wherein said calculating means includes displaying means for displaying in real time the solidification process of said cast piece, on the basis of the measured values.

24. The continuous casting apparatus as claimed in claim 17, further comprising reduction means for providing a reduction gradient to said cast piece.

25. The continuous casting apparatus as claimed in claim 24, wherein said reduction means provides a reduction gradient smaller than the solidification contraction gradient, through the surface of said cast piece, in the solid-liquid coexisting zone in the final solidification portion or its vicinity of said cast piece.

26. The continuous casting apparatus as claimed in claim 24, wherein said reduction means includes at least a pair of rollers between which said cast piece is passed.

27. The continuous casting apparatus as claimed in claim 24, in which said reduction means includes means for providing a reduction force by magnetic attractive action.

28. In continuous casting apparatus, the improvement comprising:

means for exerting an electromagnetic body force to exert an electromagnetic body force (Lorentz force) toward a casting direction onto a solid-liquid coexisting zone of a cast piece, in order to suppress formation of internal defects of at least one of microporosity and central segregation (V segregation), wherein said means for exerting said electromagnetic body force is arranged to exert said electromagnetic body force (Lorentz force) with a magnitude sufficient to hold an interdendritic liquid presure larger than the critical pressure of porosity formation onto the solid-liquid coexisting zone of said cast piece; and calculating means for calculating the magnitude of said electromagnetic body force (Lorentz force) and the formation range of internal defects in the solid-liquid coexisting zone of said cast piece, on the basis of the operating parameters including at least profile of continuous caster, alloy composition, cross-sectional shape and dimensions, casting temperature, casting speed, cooling conditions at the surface, dissolved gas content in liquid phase and the deformation velocity due to bending, unbending, reduction of said cast piece, said means for exerting said electromagnetic body force exerting said electromagnetic body force onto said formation range of internal defects or at the upstream side of that range.

29. The continuous casting apparatus as claimed in claim 28, wherein said calculating means includes means for calculating the position of porosity formation, on the basis of the pressure drop of the liquid phase caused by the interdendritic liquid flow in the solid-liquid coexisting zone of said cast piece, and wherein said exerting region of electromagnetic body force is determined based on the calculated position.

30. The continuous casting apparatus as claimed in claim 28, wherein said calculating means includes correction means for correcting said magnitude of electromagnetic body force (Lorentz force) and said formation range of internal defects, on the basis of measured values.

31. The continuous casting apparatus as claimed in claim 30, wherein said correction means includes means for conducting calculation processing, on the basis of data measured by experiments.

32. The continuous casting apparatus as claimed in claim 30, wherein said correction means performs real time feed back control for said magnitude of electromagnetic body force, said formation range of internal defects and operating parameters, on the basis of the measured data of operating parameters.

33. The continuous casting apparatus as claimed in claim 28, wherein said calculating means includes displaying means for displaying in real time the solidification process of said cast piece, on the basis of the measured values.

34. A continuous casting apparatus, comprising:

an electromagnetic body force exerting device which exerts an electromagnetic body force (Lorentz force) toward a casting direction onto a solid-liquid coexisting zone of a cast piece, in order to suppress formation of internal defects of at least one of microporosity and central segregation (V segregation), wherein said electromagnetic body force exerting device is arranged to exert said electromagnetic body force (Lorentz force) with a magnitude sufficient to hold an interdendritic liquid pressure larger than the critical pressure of porosity formation onto the solid-liquid coexisting zone of said cast piece; and a calculator device which calculates the magnitude of said electromagnetic body force (Lorentz force) and the formation range of internal defects in the solid-liquid coexisting zone of said cast piece, on the basis of operating parameters including at least profile of continuous caster, alloy composition, cross-sectional shape and dimensions, casting temperature, casting speed and cooling conditions at the surface of said cast piece, said electromagnetic body force exerting device exerting said electromagnetic body force onto said formation range of internal defects or at the upstream side of that range.

35. The continuous casting apparatus as claimed in claim 34, wherein said electromagnetic body force exerting device is arranged to exert said electromagnetic body force (Lorentz force) toward the casting direction onto the solid-liquid coexisting zone in the vicinity of the final solidification portion of said cast piece.

36. The continuous casting apparatus as claimed in claim 34, wherein said calculator device includes a porosity formation calculator which calculates the position of porosity formation, on the basis of the pressure drop of the liquid phase caused by the interdendritic liquid flow in the solid-liquid coexisting zone of said cast piece, and wherein said exerting region of electromagnetic body force is determined based on the calculated position.

37. The continuous casting apparatus as claimed in claim 34 wherein said calculator device includes a corrector which corrects said magnitude of electromagnetic body force (Lorentz force) and said formation range of internal defects, on the basis of measured values.

38. The continuous casting apparatus as claimed in claim 37, wherein said corrector includes a calculation processor which conducts calculation processing, on the basis of data measured by experiments.

39. The continuous casting apparatus as claimed in claim 37, wherein said corrector performs real time feed back control for said magnitude of electromagnetic body force, said formation range of internal defects and operating parameters, on the basis of the measured data of operating parameters.

40. The continuous casting apparatus as claimed in claim 34, wherein said calculator device includes a display which displays in real time the solidification process of said cast piece, on the basis of the measured values.

41. The continuous casting apparatus as claimed in claim 34, further comprising a reducer which provides a reduction gradient to said cast piece.

42. The continuous casting apparatus as claimed in claim 41, wherein said reducer gives a reduction gradient smaller than the solidification contraction gradient, through the surface of said cast piece, in the solid-liquid coexisting zone in the final solidification portion or its vicinity of said cast piece.

43. The continuous casting apparatus as claimed in claim 41, wherein said reducer includes at least a pair of rollers between which said cast piece is passed.

44. The continuous casting apparatus as claimed in claim 41, in which said reducer includes means for providing a reduction force by magnetic attractive action.

45. A continuous casting apparatus, comprising:

an electromagnetic body force exerting device which exerts an electromagnetic body force (Lorentz force) toward a casting direction onto a solid-liquid coexisting zone of a cast piece, in order to suppress formation of internal defects of at least one of microporosity and central segregation (V segregation), wherein said electromagnetic body force exerting device is arranged to exert said electromagnetic body force (Lorentz force) with a magnitude sufficient to hold an interdendritic liquid pressure larger than the critical pressure of porosity formation onto the solid-liquid coexisting zone of said cast piece; and a calculator device which calculates the magnitude of said electromagnetic body force (Lorentz force) and the formation range of internal defects in the solid-liquid coexisting zone of said cast piece, on the basis of the operating parameters including at least profile of continuous caster, alloy composition, cross-sectional shape and dimensions, casting temperature, casting speed, cooling conditions at the surface, dissolved gas content in liquid phase and the deformation velocity due to bending, unbending, reduction of said cast piece, said electromagnetic body force exerting device exerting said electromagnetic body force onto said formation range of internal defects or at the upstream side of that range.

46. The continuous casting apparatus as claimed in claim 45, wherein said calculator device includes a porosity formation calculator which calculates the position of porosity formation, on the basis of the pressure drop of the liquid phase caused by the interdendritic liquid flow in the solid-liquid coexisting zone of said cast piece, and wherein said exerting region of electromagnetic body force is determined based on the calculated position.

47. The continuous casting apparatus as claimed in claim 45, wherein said calculator device includes a corrector which corrects said magnitude of electromagnetic body force (Lorentz force) and said formation range of internal defects, on the basis of measured values.

48. The continuous casting apparatus as claimed in claim 47, wherein said corrector includes a calculation processor which conducts calculation processing, on the basis of data measured by experiments.

49. The continuous casting apparatus as claimed in claim 47, wherein said corrector performs real time feed back control for said magnitude of electromagnetic body force, said formation range of internal defects and operating parameters, on the basis of the measured data of operating parameters.

50. The continuous casting apparatus as claimed in claim 45, wherein said calculator device includes a display which displays in real time the solidification process of said cast piece, on the basis of the measured values.

* * * * *